US010189625B2

(12) United States Patent
Bressan

(10) Patent No.: US 10,189,625 B2
(45) Date of Patent: Jan. 29, 2019

(54) TAMPER-EVIDENT CONTAINER AND PROCESS FOR MAKING THE SAME

(71) Applicant: I.G.B. S.R.L., Milan (IT)

(72) Inventor: Michel Bressan, Induno Olona (IT)

(73) Assignee: I.G.B. S.r.l., Milan (IT)

( * ) Notice: Subject to any disclaimer, the term of this patent is extended or adjusted under 35 U.S.C. 154(b) by 0 days.

(21) Appl. No.: 15/306,639

(22) PCT Filed: Apr. 1, 2015

(86) PCT No.: PCT/IB2015/052400
§ 371 (c)(1),
(2) Date: Oct. 25, 2016

(87) PCT Pub. No.: WO2015/170203
PCT Pub. Date: Nov. 12, 2015

(65) Prior Publication Data

US 2017/0043929 A1 Feb. 16, 2017

(30) Foreign Application Priority Data

May 5, 2014 (IT) ..... MI2014A0812
Feb. 3, 2015 (IT) ..... MI2015A0141

(51) Int. Cl.
*B65D 79/02* (2006.01)
*B65D 5/10* (2006.01)
*B65D 5/02* (2006.01)

(52) U.S. Cl.
CPC ..... *B65D 79/02* (2013.01); *B65D 5/0254* (2013.01); *B65D 5/10* (2013.01); *B65D 5/106* (2013.01); *B65D 2101/0015* (2013.01)

(58) Field of Classification Search
CPC ..... B65D 79/02; B65D 5/106; B65D 2101/0015; B65D 5/10; B65D 5/0254;
(Continued)

(56) References Cited

U.S. PATENT DOCUMENTS 5,207,374 A * 5/1993 Lo Duca ..... B65D 5/0254 206/807
2008/0308619 A1* 12/2008 Adam ..... B65D 5/0254 229/222
2011/0180537 A1 7/2011 Zimmermann

FOREIGN PATENT DOCUMENTS

BE 410524 A 8/1935
EP 0519389 A1 12/1992
(Continued)

OTHER PUBLICATIONS

International Search Report and Written Opinion for PCT/IB2015/052400 dated Jul. 23, 2015, 10 pages.

*Primary Examiner* — Christopher Demeree
(74) *Attorney, Agent, or Firm* — Fish & Richardson P.C.

(57) ABSTRACT

A tamper-evident container includes a storage compartment made of sheet material, defining an internal volume, and configured for housing products. The storage compartment includes multiple lateral walls defining a passage opening delimited by a free edge. The passage opening is configured to communicate the internal volume of the storage compartment with an external environment. The tamper-evident container further includes a closure system engaged at the free edge of the storage compartment and movable with respect to the storage compartment. The closure system can define a closed condition in which the closure system prevents communication between the internal volume of the storage compartment and the external environment and an open condition in which the closure system enables communication between the internal volume of the storage compartment and the external environment. The tamper-evident container further includes a safety device made of sheet material and including first and second coupling portions.

18 Claims, 27 Drawing Sheets

(58) Field of Classification Search
CPC . B65D 5/6608; B65D 2101/00; B65D 5/6661
USPC ..... 229/102, 151, 152, 153, 122.32, 143; 206/807
See application file for complete search history.

(56) References Cited

FOREIGN PATENT DOCUMENTS

| | | | | |
|---|---|---|---|---|
| EP | 2036821 | A1 * | 3/2009 | ..... B65D 5/0254 |
| FR | 2993538 | A | 1/2014 | |
| GB | 2251600 | A | 7/1992 | |
| JP | H11105852 | | 4/1999 | |

* cited by examiner

FIG.13
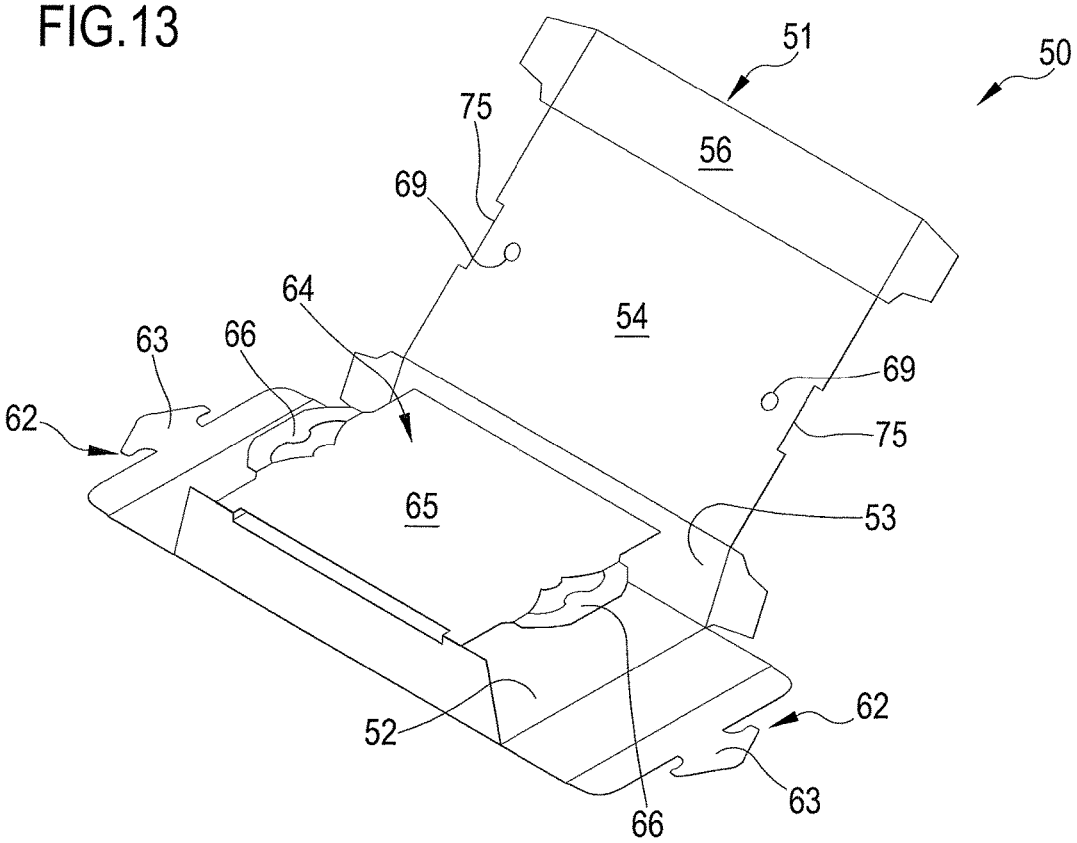
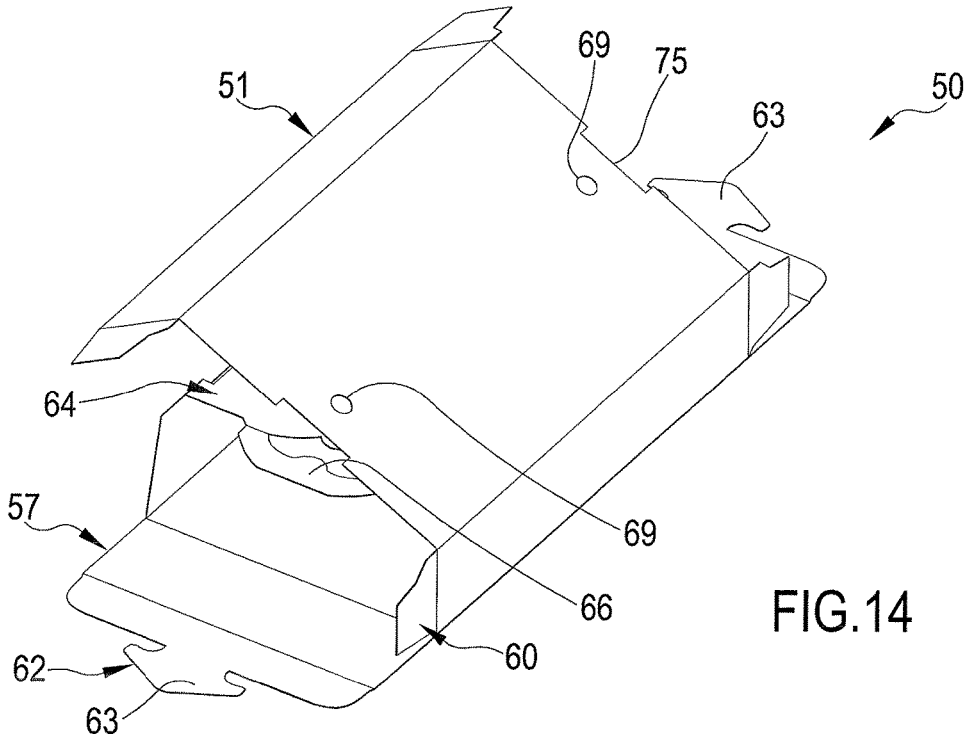
FIG.14

TAMPER-EVIDENT CONTAINER AND PROCESS FOR MAKING THE SAME

CROSS REFERENCE TO RELATED APPLICATIONS

This patent application is a 371 U.S. National Application of PCT/IB2015/052400, filed Apr. 1, 2015, which claims priority to MI2014A000812, filed May 5, 2014, and which claims priority to MI2015A000141, filed Feb. 3, 2015, the entire contents of which are incorporated herein by reference.

TECHNICAL FIELD

The present invention refers to a tamper-evident container and to a process for making the same. The container can find an application, generally, in all the fields which provide to wrap finished products for ensuring the closure of the container itself and provide a safety which enables to give evidence, also to sight-impaired persons, of a possible tampering of this latter. Specifically, the container, object of the present invention, can find an advantageous application in the pharmaceutical and cosmetic fields, for example for defining portable dispensers able to house tablets or pills because, in such fields, it is of importance to ensure the provision of intact and in any way unaltered products.

BACKGROUND

It is known the use of containers of paper or plastic material, provided with safety systems configured for providing evidence of a tampering of the container itself. These containers, called also "tamper-evident" containers, are configured for enabling to insert products inside them and, then in a first closed condition, enabling the activation of the safety device—in the field the activation of the safety device is generally called as an "arming device" condition—so that, following a first open condition, the container can provide evidence. These systems are generally used in the pharmaceutical, cosmetic and food fields, in which it is particularly important ensuring the provision of intact products and in compliance with the specifics indicated on the container.

For example, boxes or containers of paper or plastic material which use as "tamper-evident" systems, additional wrappers of plastic material adapted to wrap the whole box to define a substantially further envelope, are known. These boxes exhibit several limitations and disadvantages; de facto, the further packaging appears to be particularly expensive because it provides the use of additional raw materials (an additional plastic film) and requires a high number of steps for sealing the box: additional steps of predisposing and applicating the film. Besides the economical disadvantages caused by the further packagings, these are not capable of providing evidence of a tampering of the pack; de facto, the distributor could easily remove the plastic film for altering or substituting the products in the container and proceed with the sale of this latter without the further safety wrapper by offering to the public only the pack (the unpackaged container).

Further, boxes made of paper or plastic material using, as "tamper-evident" systems, seals and/or labels configured for holding closed the box itself, are known. This last kind of safety system is certainly more efficient than the above described further wrappers because removing the seal would not enable to correctly reclose the box and consequently it would be possible to provide evidence of a tampering of the container to the customer. While these latter described boxes are an improvement with respect to the above described containers with a further wrapper, such boxes are however particularly expensive because they also require additional raw materials represented by the seals/labels and additional steps for predisposing and applicating such elements. For this reason, "tamper-evident" containers of paper material improved with respect to the above described ones, have been made.

A first example, described in the USA patent application US2011/0180537A1, refers to a box completely made of paper material, having a store provided with an opening delimited by a free edge; at such opening there are two opposite lateral tabs rotatingly moveable around the edge. The lateral tabs are configured for rotating inside the store and placing themselves in a partially overlapped condition. Each of said tabs is notched at the store free edge to define a kind of moveable door. Further, the container exhibits a cover engaged with the free edge of the store and interposed between the tabs; the cover is also rotatingly moveable around the free edge and is configured for being positioned above the tabs. Specifically, the cover carries a closure tab adapted to be overlapped on the lateral tabs to define a closed condition of the container; further the cover carries an engagement tab adapted to enter inside the container and to be locked to the lateral tabs for holding said closed condition. The closure tabs exhibit notches defining the doors, which are configured for cooperating with the lateral tab doors. The container provides, as a tamper-evident system, to forcedly fold inside the store the closure tab and lateral tabs doors: the opening of the container causes the breakage of the doors carried by the closure tab.

The container, described in the US application, is an improvement with respect to the above described packaging and sealing systems at least with reference to the product and process costs. De facto, the container described in such application, is entirely made of paper material: the tamper-evident system is formed by paper portions of the closure tab and of the lateral internal tabs. For this reason, the containers, described in the USA application, are more advantageous in terms of costs because they do not provide the use of additional materials (for example coverings of plastic film and/or further labels) and the additional process steps for predisposing and applicating such material. For example, the container, as described in the USA application, exhibits, with respect to the process of forming the standard (non tamper-evident) containers, the additional steps of notching the tabs and a further step of folding the doors inside the store. Naturally, the necessity of executing the additional process steps with respect to the simple implementation of the container (the box without the safety device), provides that also the plant for producing such boxes is provides with additional components destined to perform the required additional steps for predisposing the safety device: therefore the plant requires further toolings. It is evident that, besides the product and process costs, the paper boxes, described in the USA application, will entail further expenses for tooling the plant. It is further useful to detect that the complex structure of the container, besides requiring a particularly tooling of the production plant, requires suitable toolings of the packaging plants dedicated to insert products inside the container and the following closure of the same. De facto, the structural complexity of the above described container, burdens both on the production plant and on the container packaging one with a consequent substantial increase of the costs of the entire packaged product.

A further inconvenience of the described box of the prior USA application, is represented by the tamper-evident system structure, which is easily penetrable; de facto the safety device is positioned on the top of the container and at the box free edge: the safety device itself could be tampered and bypassed at the container opening in order to avoid breaking the doors and therefore without giving evidence of any tampering.

A second example, described in the European patent application EP0519389A1, relates to a box entirely made of paper material exhibiting substantially the same structure as the container described in the first example (USA application). Also such container exhibits a store provided with an opening delimited by a free edge; at such opening there are two lateral tabs opposite to each other and rotatingly moveable around the edge. The lateral tabs are configured for rotating inside the store and being placed in a partially overlapped condition. As opposed to the USA application, each tab exhibits, at the overlapping area with the other tab, a removable portion provided with an undercut. Further, the container exhibits a cover engaged with the store free edge and interposed between the tabs; the cover is also rotatingly moveable around the free edge and is configured for being placed above the tabs. Particularly, the cover carries a closure tab adapted to overlap with the lateral tabs to define a container closed condition; the cover further carries an engagement tab adapted to enter inside the container and to be locked to the lateral tabs for maintaining said closed condition. The closure tab exhibits a notch adapted to define a seat suitable for receiving the undercut of the tabs removable portions. The container provides, as a tamper-evident system, the joint of the removable portions inside the cover seat during the first container closure; the container opening causes the removal portions carried by the inner lateral tabs to be torn.

As per the USA application, the container, described in the European application, is an improvement with respect to the above described packaging and labeling systems at least with reference to the product and process costs. De facto, the container, described in such application, is also entirely made of paper material: the tamper-evident system is only formed by paper portions of the lateral internal tabs (it is not provided the use of an additional material and additional process steps for providing and applying said material). However it is observed that the container, described in the European patent, is an improvement with respect to the first example because the box/container "arming" is done at the first closure of the same, without requiring further steps of notching and folding the box. For this reason, the second example exhibits a manufacturing process faster and more cost-effective than the one described in the USA patent.

However, it is observed that, also the tamper-evident system, described in the second example, is easily bypassable because it is placed on the top of the container; also in this case, it is could be possible to bypass the safety device by tampering the container without causing the breakage of the removable portions (therefore without providing evidence of tampering).

Further, it is noted that all the above described tamper-evident systems are not configured for providing evidence of a container tampering to sight-impaired people; de facto, all the above described systems use, for giving evidence of a first container opening, only a visible device preventing the sight-impaired people to verify the container condition.

SUMMARY

Therefore it is an object of the present invention to substantially solve at least one of the disadvantages and/or limitations of the preceding solutions.

A first object of the invention consists of providing a container which can effectively ensure to give evidence of tampering at a first opening of the container itself, also to sight-impaired people. A further main object of the invention consists of providing a tamper-evident container which can ensure an easy and effective arming at a first opening of the container itself. A further main object of the invention consists of providing a container which is easy and fast to manufacture, which enables to reduce at the minimum the manufacturing and product costs. Another object of the invention consists of predisposing a container which is substantially capable of offering an optimal attractive appearance and, at the same time, of maintaining a simplification of the manufacturing and assembly processes. Then, it is a secondary object of the invention to predispose a tamper-evident container which can be used several times by an user and therefore can be disposed by recycling it, once exhausted its task, without particular problems due to the un-biodegradability of the material by which is made of.

One or more of the above described objects which will be better appear in the following description are substantially met by a tamper-evident container and by a respective manufacturing process according to one or more of the attached claims.

Aspects of the invention will be described in the following. In a 1st aspect, it is provided a tamper-evident container (1) comprising:

at least a store (2) made of sheet material defining an internal volume (3) and configured for housing products, said store (2) exhibiting a predetermined number of lateral walls (4) defining at least a passage opening (5) delimited by a free edge (6); said passage opening (5) being configured to place the internal volume (3) of the store (2) in communication with the external environment, at least a closure system (7), also made of sheet material, engaged at the free edge (6) and movable, particularly by rotation, with respect to the store (2), the closure system (7) being configured for defining at least a closed condition in which the system itself interdicts the communication between the internal volume (3) of the store (2) and the external environment, further the closure system (7) being configured for defining an open condition in which the system itself enables communication between the internal volume (3) and the external environment, the closure system (7) comprising at least a tab (8) which exhibits a closing portion (9) engaged to the free edge (6) of the store (2) and movable, particularly by rotation, with respect to the free edge (6), the tab (8) further exhibiting at least an inserting portion (10) configured to insert, in the closed condition of the closure system (7), inside the volume (3) of the store (2), the closure system (7) further comprising at least an abutting portion (11) engaged to the free edge (6) of the store (2) adjacently to the tab (8), the abutting portion (11), in the closed condition, being configured to be interposed between the internal volume (3) and the tab (8), at least a safety device (12) in sheet material exhibiting:

at least a first coupling portion (13) brought by the tab (8) and/or the abutting portion (11) of the closure system (7), at least a second coupling portion (14) engaged to the store (2) and configured such as to cooperate with said first coupling portion (13), the first and second coupling portions (13, 14) being configured to stably engage to one another during the first closure system (7) closed condition, the first and/or second coupling portions (13, 14) exhibiting at least a removable portion (15) configured to separate from the safety device (12) following a first open condition of the closure system (7) following said first closed condition so as to provide evidence of a tampering of the container (1), and wherein the second coupling portion (14) is arranged internally of the store (2) and lies substantially in a parallel plane to one of the lateral walls (4) of the store (2), in the closed condition of the system (7), the first coupling portion (13) being configured to insert at least partly in the internal volume (3) of store (2) to stably engage the second coupling portion (14).

In a 2nd aspect, it is provided a tamper-evident container (1) comprising:

at least a store (2) made of sheet material defining an internal volume (3) and configured for housing products, said store (2) exhibiting a predetermined number of lateral walls (4) defining at least a passage opening (5) delimited by a free edge (6), said passage opening (5) being configured to place the internal volume (3) of the store (2) in communication with the external environment, at least a closure system (7), also made of sheet material, engaged at the free edge (6) and movable, particularly by rotation, with respect to the store (2), the closure system (7) being configured for defining at least a closed condition in which the system itself interdicts the communication between the internal volume (3) of the store (2) and the external environment, the closure system (7) being further configured for defining an open condition in which the system itself enables communication between the internal volume (3) and the external environment, the closure system (7) comprising at least a tab (8), which exhibits a closing portion (9) engaged to the free edge (6) of the store (2) and movable, particularly by rotation, with respect to the free edge (6), the tab (8) further exhibiting at least an inserting portion (10) configured to insert, in the closed condition of the closure system (7), inside the store (2) volume (3), the closure system (7) further comprising at least an abutting portion (11) engaged to the free edge (6) of the store (2) adjacently to the tab (8), the abutting portion (11), in the closed condition, being configured to be interposed between the internal volume (3) and the tab (8), at least a safety device (12) made of sheet material stably engageable at least partially with the store (2) and at least partially with the closure system (7) following a first closed condition of this latter, the safety device (12) comprising at least a removable portion (15) configured for defining, following the first closed condition, a tactilely perceivable projection (25) emerging from the store (2) and/or the closure system (7), the removable portion (15), together with the projection (25), being configured to separate from the safety device (12) upon a first closure system (7) open condition following said first closed condition for providing evidence of a tampering of the container (1).

In a 3rd aspect according to the aspect 1, the safety device (12) is stably engageable at least partially with the store (2) and at least partially with the closure system (7) following a first closed condition of this latter, the safety device (12) comprising at least a removable portion (15) configured for defining, following the first closed condition, a tactilely perceivable projection (25) emerging from the store (2) and/or from the closure system (7), the removable portion (15), together with the projection (25), being configured to separate from the safety device (12) following a first open condition of the closure system (7) following said first closed condition for providing evidence of a tampering of the container (1); or according to the 2nd aspect wherein the safety device (12) comprises:

at least a first coupling portion (13) carried by the tab (8) and/or by the abutting portion (11) of the closure system (7), at least a second coupling portion (14) engaged with the store (2) and configured for cooperating with said first coupling portion (13), the first and second coupling portions (13, 14) being configured to stably engage with each other during a closed condition of the first closure system (7), the first and/or second coupling portions (13, 14) exhibiting at least a removable portion (15) configured to separate from the safety device (12) following a first open condition of the closure system (7) following said first closed condition for providing evidence of a tampering of the container (1), and wherein the second coupling portion (14) is arranged internally of the store (2) and substantially lies in a plane parallel to one of the store (2) lateral walls (4), in closed condition of the system (7), the first coupling portion (13) being configured to insert at least partially in the internal volume (3) of the store (2) to stably engage the second coupling portion (14).

In a 4th aspect according to the aspect 1 or 3, the safety device (12) comprises:

at least a first coupling portion (13) carried by the tab (8) and/or by the abutting portion (11) of the closure system (7), at least a second coupling portion (14) engaged with the store (2) and configured for cooperating with said first coupling portion (13), the first and second coupling portions (13, 14) being configured to stably engage to one another during the first closure system (7) closed condition, the first and/or second coupling portions (13, 14) exhibiting at least a removable portion (15), carrying said projection (25), configured to separate from the safety device (12) following the first open condition of the closure system (7) following the first closed condition for providing evidence of a tampering of the container (1).

In a 5th aspect according to the aspect 1 or 3 or 4, the second coupling portion (14) is arranged internally of the store (2) and substantially lies in a plane parallel to one of the lateral walls (4) of the store (2), in the closure system (7) closed condition, the first coupling portion (13) being configured to insert at least partially in the internal volume (3) of the store (2), particularly entirely inside the volume (3), for stably engaging to the second coupling portion (14).

In a 6th aspect according to the 1st aspect or to anyone of the aspects from 3 to 5, at least one between the first and second coupling portions (13, 14) exhibits the removable portion (15) which comprises at least an undercut portion (16), at least the other between said first and second coupling portions (13, 14) being configured for engaging said undercut portion (16) in the first closed condition of the container (1).

In a 7th aspect according to the preceding aspect, the undercut portion (16) of the removable portion (15) is delimited by a gripping edge (17) which, in the first closed condition of the container (1), is distinct and distanced from the free edge (6) of the store (2).

In an 8th aspect according to the preceding aspect, the gripping edge (17), in the first closed condition of the container (1), exhibits a minimum distance (D1) from the store (2) free edge (6) greater than 2 mm, particularly greater than 3 mm, still more particularly comprised between 3.5 and 12 mm.

In a 9th aspect according to anyone of the aspects from 2 to 8, the projection (25), following the first closed condition of the container (1) and before the step of opening for the first time the container itself, emerges from the store (2) free edge (6) and/or from the closure system (7) outside the internal volume (3).

In a 10th aspect according to anyone of the aspects from 7 to 9, the projection (25) is distanced from and is placed opposite to the gripping edge (17) with respect to the removable portion (15), particularly the projection (25) emerges from a part opposite to the gripping edge with respect to the removable portion (15).

In an 11th aspect according to anyone of the aspects from 6 to 10, the undercut portion (16) of the removable portion (15) comprises at least one hook (18).

In a 12th aspect according to the preceding aspect, the removable portion (15) hook (18) defines a seat (19), the concavity thereof faces, at least in the first closed condition of the device (12), at least one of the store (2) lateral walls (4). Particularly, the concavity faces at least one of the store (2) lateral walls (4).

In a 13th aspect according to the preceding aspect, the seat (19) exhibits a substantially "C" shape.

In a 14th aspect according to the aspect 1 or to anyone of the aspects from 3 to 13, at least one between the first and second coupling portions (13, 14), not exhibiting said removable portion (15), comprises at least one respective undercut portion (20) delimited by a respective gripping edge (21), said respective undercut portion (20), in the first closed condition of the container (1), is configured for engaging the removable portion (15).

In a 15th aspect according to the preceding aspect, the undercut portion (20), in the first closed condition of the container (1), is configured for engaging the undercut portion (16) of the removable portion (15).

In a 16th aspect according to the aspect 14 or 15, the gripping edge (17) of the removable portion (15), in the first closed condition of the container (1), is interposed between the store (2) free edge (6) and the respective gripping edge (21) of the coupling portion, not exhibiting said removable portion (15).

In a 17th aspect according to anyone of the aspects from 14 to 16, the respective undercut portion (20), not exhibiting said removable portion (15), comprises at least one hook (22).

In an 18th aspect according to the preceding aspect, the hook (22), of the respective portion (20) not bearing said removable portion (15), defines a seat (23) whose concavity faces, at least in the container closed condition, at least one of the store (2) lateral walls (4).

In a 19th aspect according to the preceding aspect, the seat (23) of the respective undercut portion (20) not exhibiting said removable portion (15), defines a substantially "C" shape.

In a 20th aspect according to the aspect 18 or 19, the concavity of the removable portion (15) seat (19), in the first closed condition of the container (1), faces the concavity of the seat (23) of the respective undercut portion (20) not bearing said removable portion (15).

In a 21st aspect according to anyone of the preceding aspects, the removable portion (15) comprises two undercut portions placed in opposition with each other with respect to the removable portion itself.

In a 22nd aspect according to the aspect 1 or anyone of the aspects from 3 to 21, at least one between said first and second coupling portions (13, 14), not exhibiting said removable portion (15), comprises two respective undercut portions which, in the first closed condition of the container (1), are configured for engaging the two undercut portions of the removable portion (15).

In a 23rd aspect according to anyone of the preceding aspects, the closure system (7) comprises a through opening (26) configured to place, in the system closed condition, at the free edge (6) above the removable portion (15).

In a 24th aspect according to anyone of the preceding aspects, the through opening (26), following the first closure of the system (7) and before the first open condition of the container (1), is able to enable the projection (25) to pass through and therefore to let the same exit the store (2).

In a 25th aspect according to the aspect 23 or 24, the through opening (26) is defined on the closing portion (9) and/or on the tab (8) inserting portion (10).

In a 26th aspect according to the aspect 23 or 24 or 25, the through opening (26) defines a perimetral outline exhibiting at least one selected in the group among the following shapes: rectangular, square, circular, elliptical, semicircular, triangular.

In a 27th aspect according to anyone of the aspects from 23 to 26, the through opening (26) is defined, without interruptions, at least partially on the closing portion (9) and at least partially on the inserting portion (10) of the tab (8).

In a 28th aspect according to anyone of the preceding aspects, the lateral wall (4) of the store (2) directly facing the removable portion (15), exhibits, at the free edge (6), a recess (27).

In a 29th aspect according to the preceding aspect, the recess (27) is able to substantially define a depression of the free edge (6) from which the projection (25) of the removable portion (15) emerges following the first closed condition and before the first open condition.

In a 30th aspect according to the aspect 28 or 29, the recess (27) defines an open perimetral outline exhibiting at least one selected in the group among the following shapes: a "C" shape, a "U" shape, a "V" shape.

In a 31st aspect according to anyone of the aspects from 28 to 30, the recess (27) is carried by the lateral wall (4) parallel to the second coupling portion (14) of the safety device (12).

In a 32nd aspect according to anyone of the aspects from 28 to 31, the through opening (26), in the closure system (7) closed condition, is placed at the recess (27) of the store (2) and particularly being faced with each other, the through opening (26) and recess (27), in the closure system (7) closed condition, being at least partially countershaped with each other and enabling both the visibility and tactile perception of the projection (25).

In a 33rd aspect according to anyone of the aspects from 22 to 32, the safety device (12) further comprises a control portion (28) of sheet material directly carried by the store (2) and/or by the closure system (7), the control portion (28) being configured for:

being placed, following the system (7) first closure and before the first open condition of the container (1), behind the inserting portion (10) so that the same is interposed between said control portion (28) and store (2) lateral wall (4) abutting on the inserting portion (10), in such condition, the control portion (28) being entirely contained in the store (2) and directly covered by the removable portion (15), being placed, following the first open condition of the container (1), behind the inserting portion (10) so that the same is interposed between said control portion (28) and store (2) lateral wall (4) abutting on the inserting portion (10), in such condition, the control portion (28) is entirely contained in the store and faces the through opening (26) of the closure system (7), the control portion (28) exhibiting at least one cavity (29) contactable from the outside through the through opening (26) and tactilely perceivable for confirming the absence of the removable portion and providing evidence of a tampering of the container (1).

In a 34th aspect according to the preceding aspect, the cavity (29) defines an open outline having the concavity facing the closing portion (9) of the tab (8).

In a 35th aspect according to the preceding aspect, the cavity (29) open outline of the control portion (29) defines an outline selected in the group among: "U", "V", "C" outlines.

In a 36th aspect according to anyone of the aspects from 33 to 35, the control portion (28) is directly carried by the store (2) and comprises a sheet lying parallelly to the second coupling portion (14).

In a 37th aspect according to the preceding aspect, the control portion (28) is integrally joined and parallel to the second coupling portion (14) of the safety device (12).

In a 38th aspect according to anyone of the preceding aspects, the store (2) comprises at least one control through-opening (24), said control opening (24) being brought by the lateral wall (4) parallel to the second coupling portion (14) of the safety device (12), said control opening (24) being arranges at the removable portion (15) of the safety device (12) and at the inserting portion (10) of the tab (8), and wherein the control opening (24) is configured to enable visualising the removable portion (15) previous to the condition of first opening of the container (1), said control through-opening (24) being further configured to enable visualizing the inserting portion (10) of the tab (8) following the condition of first opening of the container (1) to provide evidence of a tampering of the container (1).

In a 39th aspect according to the preceding aspect, at least one part of the removable portion (15), before the first open condition of the container (1), is interposed between the tab (8) inserting portion (10) and store (2) control opening (24).

In a 40th aspect according to anyone of the preceding aspects, the removable portion (15) is made of a sheet material and extends between a first and a second surfaces (15*a*, 15*b*) respectively facing a store (2) lateral wall (4) and the store (2) internal volume.

In a 41st aspect according to the preceding aspect, the first and second surfaces (15*a*, 15*b*) respectively face one lateral wall (4) of the store (2) carrying said control opening (24) and the store (2) internal volume, the control opening (24) being configured to enable visualising the first removable portion surface (15*a*) before the first open condition of the container (1).

In a 42nd aspect according to anyone of the preceding aspects, the inserting portion (10) is made of sheet material and extends between a first and second surfaces (10*a*, 10*b*) respectively facing one store (2) lateral wall (4) and store (2) internal volume.

In a 43rd aspect according to the preceding aspect, the first and second surfaces (10*a*, 10*b*) respectively face a store (2) lateral wall carrying the control volume (24) and the store (2) internal volume, the control opening (24) being configured to enable visualising the first inserting portion (10) surface (10*a*) after the first open condition of the container (1).

In a 44th aspect according to anyone of the aspects from 37 to 43, at least a part of the inserting portion (10) visible from the control opening (24) is different and distinguishable from at least a part of the removable portion (15) visible from the control opening (24), the difference between the visible parts of the inserting portion (10) and removable portion (15) being able to evidence from outside a tampering of the container (1).

In a 45th aspect according to the preceding aspect, at least a part of the first surface (10*a*) of inserting portion (10) visible from the control opening (24), has a color different from at least a part of the first surface (15*a*) of removable portion (15) visible from the control opening (24) for providing evidence of a tampering of the container (1).

In a 46th aspect according to anyone of the preceding aspects, at least a part of the removable portion (15), before the first open condition of the container (1), is interposed between the tab (8) inserting portion (10) and a store (2) lateral wall (4).

In a 47th aspect according to anyone of the preceding aspects, the container (1) comprises two through opening (5) delimited by a respective free edge (6) and opposite to each other with respect to the store itself.

In a 48th aspect according to the preceding aspect, the container (1) has, at each of said through opening (5), a closure system (7) and a safety device (12), each safety device (12) being configured for providing evidence of a tampering of the container (1) at the respective passage opening (5).

In a 49th aspect according to anyone of the preceding aspects, the first coupling portion (13) is directly brought by the tab (8).

In a 50th aspect according to the preceding aspect, the first coupling portion (13) is directly connected to the inserting portion (10) and emerges tangent from this latter, the inserting portion (10) being interposed between the first coupling portion (13) and the closing portion (9) of the tab (8).

In a 51st aspect according to anyone of the preceding aspects, the first coupling portion (13) is integrally joined to the tab (8), particularly is integrally joined to the tab (8) inserting portion (10).

In a 52nd aspect according to anyone of the preceding aspects, the second coupling portion (14) is directly brought by the store (2).

In a 53rd aspect according to anyone of the preceding aspects, the second coupling portion (14) is directly connected to at least one store (2) lateral wall (4) and develops parallelly to this latter.

In a 54th according to anyone of the preceding aspects, the second coupling portion (14) is integrally joined to the store (2), particularly is integrally joined to the store (2) lateral wall.

In a 55th aspect according to anyone of the preceding aspects, the removable portion (15) is directly connected to the second coupling portion (14), particularly is directly connected to the store (2).

In a 56th aspect according to anyone of the preceding aspects, the store (2) exhibits a prismatic shape, particularly a rectangular prismatic or square prismatic shape.

In a 57th aspect according to anyone of the preceding aspects, the store (2) defines an internal volume greater than 20,000 $mm^3$.

In a 58th aspect according to anyone of the preceding aspects, the store (2) is made of a paper sheet material.

In a 59th aspect according to the preceding aspect, the store (2) paper sheet material has a grammage comprised between 100 and 500 gr/m$^2$, particularly comprised between 200 and 300 gr/m$^2$.

In a 60th aspect according to anyone of the preceding aspects, the closure system (7) is made of a paper sheet material.

In a 61st aspect according to the preceding aspect, the closure system (7) paper sheet material has a grammage comprised between 100 and 500 gr/m$^2$, particularly comprised between 200 and 300 gr/m$^2$.

In a 62nd aspect according to anyone of the preceding aspects, the safety device (12) is made of a paper sheet material.

In a 63rd aspect according to the preceding aspect, the safety device (12) paper sheet material has a grammage comprised between 100 and 500 gr/m$^2$, particularly comprised between 200 and 300 gr/m$^2$.

In a 64th aspect according to anyone of the preceding aspects, the container is entirely made of paper material.

In a 65th aspect according to the preceding aspect, the container (1) paper sheet material has a grammage comprised between 100 and 500 gr/m$^2$, particularly comprised between 200 and 300 gr/m$^2$.

In a 66th aspect according to anyone of the preceding aspects, the container (1) is obtained by folding a single flat sheet.

In a 67th aspect according to the preceding aspect, the single flat sheet, from which the container (1) is obtained, is made of paper material, optionally exhibiting a grammage comprised between 100 and 500 gr/m$^2$, particularly comprised between 200 and 300 gr/m$^2$.

In a 68th aspect according to aspect 1, the safety device (12) comprises a tab made of sheet material engageable outside the container (1) following the first closed condition of this latter, this tab exhibiting:

at least a first constrain portion stably engaged with the tab (8) closing portion (9), at least a second constrain portion stably engaged with the lateral wall (4) which, in the closure system (7) closed condition, directly faces and abuts on the inserting portion (10), at least a removable portion (15) removably engaged, on one side, to the first constrain portion and, on the opposite side, to the second constrain portion of the tab, the tab outwardly engaging the container (1) defining a "L" outline and defining at least one tactilely perceivable projection (25) emerging from the store (2) and/or from the closure system (7), the removable portion (15), together with the projection (25), being configured to separate from the first and second constrain portions following a first open condition of the closure system (7) following said first closed condition for giving evidence of a tampering of the container (1).

In a 69th aspect according to the preceding aspect, the first and second constrain portions are stably glued outside the container (1), while the removable portion (15) is only engaged to said first and second constrain portions by weakening lines, particularly formed by pre-cut portions of the tab itself.

In a 70th aspect according to the aspect 68 or 69, the removable portion is not directly constrained to the container (1), but is directly engaged only with the first and second constrain portions.

In a 71st aspect according to anyone of the aspects from 68 to 70, wherein the tab removable portion (15), following the first closed condition and before the first open condition of the container (1), is placed and covers at least partially the inserting portion (10) of the closure system (7).

In a 72nd aspect according to anyone of the aspects from 68 to 71, the tab is made at least partially of paper and/or plastic material.

In a 73rd aspect, it is provided a process for making a container (1) according to anyone of the preceding aspects, the process comprising at least the following steps:

predisposing the store (2) made of sheet material, predisposing the closure system (7) made of sheet material, which is engaged at the free edge (6) of the store (2), the closure system being configured for defining the closed and open conditions of the container (1), predisposing the safety device (12) made of sheet material, such step providing to form the first and second coupling portions (13, 14), the step of predisposing the safety device (12) forming, on at least one of said coupling portions (13, 14), a removable portion (15) configured to separate from the safety device (12) following a first open condition of the container (1) following a condition of first closing thereof, the step of predisposing the safety device (12) forming a second coupling portion (14) which, in the closed condition of the container (1), is arranged internally of the store (2) and parallel to at least a lateral wall thereof, the step of predisposing the safety device (12) further forming a first coupling portion (13) configured to insert at least partially inside the store (2) to stably engage to the second coupling portion (14).

In a 74th aspect, it is provided a process for making a container (1) according to anyone of the preceding aspects, the process comprising at least the following steps:

predisposing the store (2) made of sheet material, predisposing the closure system (7) made of sheet material, which is engaged at the store (2) free edge (6), the closure system being configured for defining the container (1) closed and open conditions, predisposing the safety device (12) made of sheet material, such step providing to form at least one removable portion (15) configured for defining, following the first closed condition, a tactilely perceivable projection (25) emerging from the store (2) and/or from the closure system (7), the removable portion (15), together with the projection (25), being configured to separate from the safety device (12) following a first open condition of the closure system (7) following said first closed condition for giving evidence of a tampering of the container (1).

In a 75th aspect according to the aspect 73 or 74, the step of forming the safety device (12) provides to form the first and second coupling portions (13, 14), the step of predisposing the safety device (12) by forming, on at least one of said coupling portions (13, 14), a removable portion (15) configured to separate from the safety device (12) following a first open condition of the container (1) following a first closed condition of the same, the step of predisposing the safety device (12) by forming a second coupling portion (14) which, in the container (1) closed condition, is arranged internally of the store (2) and parallelly to at least one lateral wall of this latter, the step of predisposing the safety device (12) by further forming a first coupling portion (13) configured to insert at least partially inside the store (2) for stably engaging the second coupling portion (14).

In a 76th aspect according to the preceding aspect, the step of predisposing the store (2) comprises at least the following sub-steps:

predisposing a first sheet (51) comprising at least a first and a second portion (52, 54) interconnected by a central connecting portion (53), said first sheet (51) further comprising at least a first and a second lateral connecting portion (55, 56), said central connecting portion (53) being interposed between the first and second portions (52, 54), the first portion (52) being interposed between the first lateral connecting portion (55) and the central connecting portion (53), the second portion (54) being interposed between the second lateral connecting portion (56) and the central connecting portion (53), each of said portions (52, 53, 54, 55, 56) comprising at least two longitudinal opposite edges and two opposite end edges, said portions (52, 54), central connecting portion (53) and said lateral connecting portions (55, 56) being joined along the longitudinal edges and aligned along a single connecting direction, folding said first sheet (51), by joining said lateral connecting portions (55, 56), to form the store (2) exhibiting the passage opening (5) delimited by the free edge (6), predisposing at least a second sheet (57) integrally joined to an end edge of the first and/or second portions (52, 54) of the first sheet (51), said second sheet (57) comprising at least a first and a second portion (58, 59) integrally joined to each other, the first portion (58) of the second sheet being connected to the first sheet (51) so that said first portion (58) is interposed between the second portion (59) of the second sheet (58), and the first sheet (51), folding the first and second portions of the second sheet for respectively forming the closing portion (9) and the inserting portion (10) of the closure system (7), predisposing a third sheet (60) having at least one portion (61) connected to at least one central and/or lateral connecting portion of the first sheet (51) and emerging with respect to the first sheet (51) from the same side from which the second sheet (57) emerges, folding the portion (61) of the third sheet (60) to form the abutting portion (11) of the container (1), predisposing a fourth sheet (62) comprising at least a portion (63) integrally joined to the second portion (59) of the second sheet (57) and/or to the portion (61) of the third sheet (60), the portion (63) of the fourth sheet (62) longitudinally emerging from the second and/or third sheets (57, 60) on an opposite side from the first sheet (51), said fourth sheet (62) being configured for defining the first coupling portion (13) of the container (1), predisposing a fifth sheet (64) comprising at least a portion (65) integrally joined to the first sheet (51) and configured for defining the second coupling portion (14) of the container (1), folding the portion (65) of the fifth sheet (64) to form the second coupling portion (14) of the safety device (12) so that the second coupling portion is arranged internally of the volume (3) of the store (2), the step of predisposing the fourth and/or fifth sheet (62, 64) including a step of forming, on the respective portion (63, 65), at least a further portion (66) integrally joined to said portion (63, 65) by means of a weakening line (67), said further portion being configured for defining the removable portion (15) of the container (1).

In a 77th aspect according to the preceding aspect, the further portion is configured for defining the removable portion (15) of the container (1) which carries said projection (25).

In a 78th aspect according to the preceding aspect, wherein, at the end of the sheets folding steps before the first open condition of the container (1), the removable portion (15) is entirely contained in the internal volume (3) while the projection (25) is configured for emerging from the store (2) and/or from the closure system (7) outside the container (1).

In a 79th aspect according to anyone of the aspects from 74 to 78, the projection (25), following the container (1) first closed condition, emerges from the store (2) free edge (6) and/or from the closure system outside the internal volume (3).

In an 80th aspect according to anyone of the preceding aspects of process, the first sheet (51) is at least partially, particularly entirely, made of paper material.

In an 81st aspect according to anyone of the preceding aspects of process, the first sheet (51) exhibits a grammage comprised between 100 and 500 gr/m$^2$, particularly comprised between 300 and 400 gr/m$^2$.

In an 82nd aspect according to anyone of the preceding aspects of process, the second sheet (57) is at least partially, particularly entirely, made of paper material.

In an 83rd aspect according to anyone of the preceding aspects of process, the second sheet (57) exhibits a grammage comprised between 100 and 500 gr/m$^2$, particularly comprised between 300 and 400 gr/m$^2$.

In an 84th aspect according to anyone of the preceding aspects of process, the third sheet (60) is at least partially, particularly entirely, made of paper material.

In an 85th aspect according to the preceding aspect, the third sheet (60) has a grammage comprised between 100 and 500 gr/m$^2$, particularly comprised between 300 and 400 gr/m$^2$.

In an 86th aspect according to anyone of the preceding aspects of process, the fourth sheet (62) is at least partially, particularly entirely, made of paper material.

In an 87th aspect according to the preceding aspect, the fourth sheet (62) exhibits a grammage comprised between 100 and 500 gr/m$^2$, particularly comprised between 300 and 400 gr/m$^2$.

In an 88th aspect according to anyone of the preceding aspects of process, the fifth sheet (64) is at least partially, particularly entirely, made of paper material.

In an 89th aspect according to the preceding aspect, the fifth sheet (64) exhibits a grammage comprised between 100 and 500 gr/m$^2$, particularly comprised between 300 and 400 gr/m$^2$.

In a 90th aspect according to anyone of the preceding aspects of process, the first, second, third, fourth and fifth sheets (51, 57, 60, 62, 64) are integrally joined to form a single blank (50).

In a 91st aspect according to the preceding aspect, the blank (50) is at least partially, particularly entirely made of paper material.

In a 92nd aspect according to the preceding aspect, the blank (50) exhibits a grammage comprised between 100 and 500 gr/m$^2$, particularly comprised between 300 and 400 gr/m$^2$.

In a 93rd aspect according to anyone of the preceding aspects of process, the first sheet (51) comprises only the following portions: a first portion (52), a second portion (54), a central connecting portion (53), first and second lateral connecting portions (55, 56), each of said comprising a flat sheet having a substantially rectangular shape, and wherein the process provides the steps of folding said portions along the respective longitudinal edges in order to form a store (2) having a substantially rectangular or square prismatic shape.

In a 94th aspect according to anyone of the preceding aspects of process, the step of predisposing the further portion (66) of the fourth and/or fifth sheets (62, 64) provides to form at least an undercut (70) which is able to define the undercut portion (16) of the removable portion (15), at least one from between said first and said second coupling portions (13, 14) being configured, in the container (1) first closed condition, for engaging said undercut portion (16).

In a 95th aspect according to the preceding aspect, the undercut portion (16) of the removable portion (15) is delimited by a gripping edge (17) which, in the container (1) first closed condition, is distinct and distanced from the store (2) free edge (6).

In a 96th aspect according to the preceding aspect, the gripping edge (17), in the container (1) first closed condition, has a minimum distance (D1) from the store free edge (6) greater than 2 mm, particularly greater than 3 mm, still more particularly comprised between 3.5 and 12 mm.

In a 97th aspect according to anyone of the aspects from 94 to 96, the step of predisposing the further portion (66) of the fourth and/or fifth sheets (62, 64) provides to form at least one bulge (73) emerging from the further portion (66) of the fourth and/or fifth sheets (62, 64) and placed oppositely with respect to the undercut (70) of the further portion itself, said bulge (73) being able to define the projection (25) of the removable portion (15), the projection (25) of the removable portion (15), following the container (1) first closed condition, emerging from the free edge (6) of the store (2) and/or from the closure system (7) outside the internal volume (3).

In a 98th aspect according to anyone of the preceding aspects of process, the projection (25) is distanced from and is opposite to the gripping edge (17) with respect to the removable portion (15), particularly the projection (25) emerges oppositely to the gripping edge (17) with respect to the removable portion (15).

In a 99th aspect according to anyone of the preceding aspects of process, the undercut portion (16) of the removable portion (15) comprises at least one hook (18) defining a seat (19) whose concavity faces, at least during the safety device (12) first closed condition, at least one of the store (2) lateral walls (4).

In a 100th aspect according to the preceding aspect, the seat (19) exhibits a substantially "C" shape, the gripping edge (17) delimiting the portion of the seat (19) facing the store (2) free edge (6).

In a 101st aspect according to anyone of the preceding aspects of process, the step of forming at least one of the portions (63, 65), respectively of the fourth and fifth sheets (62, 64) and not bearing the further portion (66) able to define the removable portion (15), provides at least to form an undercut (71) able to define the respective undercut portion (20) of the container (1) which is delimited by a respective gripping edge (21), said respective undercut portion (20), at least in the container (1) first closed condition, being configured for engaging with the undercut portion (16) of the removable portion (15).

In a 102nd aspect according to the preceding aspect, the gripping edge (17) of the removable portion (15), at least in the first closed condition of the container (1), is interposed between the free edge (6) of the store (2) and the respective gripping edge (21) of the coupling portion not exhibiting the removable portion (15).

In a 103rd aspect according to the aspect 101 or 102, the respective undercut portion (20), not exhibiting said removable portion (15), comprises at least one hook (22) defining a seat (23) whose concavity faces, at least during the first closed condition of the safety device (12), at least one of the store (2) lateral walls (4).

In a 104th aspect according to the preceding aspect, the seat (23) of the respective undercut portion (20), not exhibiting said removable portion (15), defines a substantially "C" shape.

In a 105th aspect according to the preceding aspect, the concavity of the seat (19) of the removable portion (15), in the first closed condition of the container (1), faces the concavity of the seat (23) of the respective undercut portion (20) not bearing said removable portion (15).

In a 106th aspect according to anyone of the preceding aspects of process, the removable portion (15) comprises two undercut portions (16) oppositely placed to each other at the removable portion itself.

In a 107th aspect according to the preceding aspect, at least one between said first and second coupling portions (13, 14), not exhibiting said removable portion (15), comprises two respective undercut portions (20) which, in the first closed condition of the container (1), are configured for engaging the two undercut portions (16) of the removable portion (15).

In a 108th aspect according to anyone of the preceding aspects of process, the step of forming the portion (63) of the fourth sheet (62), provides at least the following sub-steps:

- forming, as a prolongation to the second portion (59) of second sheet (57), a flat sheet substantially parallel to the second sheet (57), the prolonging sheet emerging from the second portion (59) oppositely to the first portion (58) of the second sheet (57),
- forming an undercut (71) able to define the coupling portion (13) of the fifth container (1); and wherein the step of forming the portion (65) of the fifth sheet (64) provides at least the following sub-steps:
- forming, as a prolongation of the first sheet (51), a flat sheet substantially parallel to the second sheet (57),
- forming, on the sheet, at least one undercut (70) able to define the container (1) second coupling portion (14),
- forming, on the sheet, at least one weakening line (67) able to form the further portion (66) carrying the undercut (70),
- forming, on the further portion (66), a bulge placed oppositely to the undercut (70), said bulge (73) is configured for defining the removable portion (15) projection (25), the removable portion (15), together with the projection (25), being defined by the steps of forming the fifth sheet (64).

In a 109th aspect according to anyone of the preceding aspects of process, the step of predisposing the second sheet (57) provides at least a step of forming, on the same, a through notch (74) which is able to define the through opening (26) of the closure system (7).

In a 110th aspect according to the preceding aspect, the through notch (74) is defined on the first and/or second portions (58, 59) of the second sheet (57).

In a 111th aspect according to the aspects 109 or 110, the through notch (74) is partially defined on the first and partially on the second portions (58, 59) of the second sheet (57) without interruptions to define a single closed outline notch.

In a 112th aspect according to anyone of the aspects from 109 to 111, the through notch (74) defines a closed perimetral outline exhibiting at least one shape selected in the group of the following shapes: square, rectangular, diamond, circular, elliptical, semicircular, triangular.

In a 113th aspect according to anyone of the preceding aspects of process, the closure system (7) comprises a through opening (26) configured to place, in the system closed condition, at the free edge (6) above the removable portion (15), said through opening (26), following the first closure of the system (7) and before the first open condition of the container (1), being able to enable the projection (25) to pass and therefore to let the same exit the store (2).

In a 114th aspect according to the preceding aspect, the through opening (26) is defined on the closing portion (9) and/or on the tab (8) inserting portion (10).

In a 115th aspect according to the aspect 113 or 114, the through opening (26) defines a perimetral outline exhibiting at least one selected in the group among the following shapes: rectangular, square, circular, elliptical, semicircular, triangular.

In a 116th aspect according to anyone of the aspects from 113 to 115, the through opening (26) is defined, without interruptions at least partially on the closing portion (9) and at least partially on the tab (8) inserting portion (10).

In a 117th aspect according to anyone of the preceding aspects of process, the step of forming the first sheet (51) provides at least a step of forming on the same a through groove (75) on the first or second portions (52, 54) of the first sheet not bearing the second sheet (57), the through groove (75) being able to define the recess (27) of the store (2).

In a 118th aspect according to the preceding aspect, the through groove (75) is defined on at least one transversal edge of the first or second portions (52, 54) of the first sheet (51) not bearing the second sheet (57), said through groove (75) defining an open outline having a substantially "C", or "U", or "V" shape.

In a 119th aspect according to anyone of the preceding aspects of process, the recess (27) is defined on the store (2) lateral wall (4) directly facing the removable portion (15) and at the free edge (6), the recess (27) is able to substantially define a depression of the free edge (6) from which the removable portion (15) projection (25) emerges following the first closed condition and before the first open condition.

In a 120th aspect according to the preceding aspect, the recess (27) defines a perimetral open outline exhibiting at least one shape selected in the group among the following shapes: a "C" shape, a "U" shape, a "V" shape.

In a 121st aspect according to the preceding aspect, the recess (27) is carried by the lateral wall (4) parallel to the second safety device (12) coupling portion (14).

In a 122nd aspect according to anyone of the aspects from 119 to 121, the through opening (26), in the closure system (7) closed condition, is placed at the store (2) recess (27) and particularly facing each other, the through opening (26) and recess (27), in the closure system (7) closed condition, being at least partially countershaped to each other.

In a 123rd aspect according to anyone of the preceding aspects of process, forming, on the fourth and/or fifth sheets carrying the further portion (66), an additional portion (76) made of sheet material foldable above the further portion (66) for defining the control portion (28).

In a 124th aspect according to the preceding aspect, the control portion (28) of the safety device is directly carried by the store (2) and/or closure system (7), the control portion (28) being configured for:

being placed, following the system (7) first closure, and before the first open condition of the container (1), behind the inserting portion (10) so that the same is interposed between said control portion (28) and store (2) lateral wall (4) abutting on the inserting portion (10), in such condition, the control portion (28) being entirely contained in the store (2) and directly covered by the removable portion (15), being placed, following the first open condition of the container (1), behind the inserting portion (10) so that the same is interposed between said control portion (28) and the store (2) lateral wall (4) abutting on the inserting portion (10), in such condition, the control portion (28) is entirely contained in the store and facing the through opening (26) of the closure system (7), the control portion (28) exhibiting at least one cavity (29) contactable from the outside via the through opening (26) and tactilely perceivable for confirming the absence of the removable portion and providing in this way evidence of a tampering of the container (1).

In a 125th according to the preceding aspect, the cavity (29) defines an open outline exhibiting a concavity facing the tab (8) closing portion (9).

In a 126th aspect according to the preceding aspect, the cavity (29) open outline of the control portion (28) defines a outline selected in the group among: a "U", a "V", a "C" outline.

In a 127th aspect according to anyone of the aspects from 124 to 126, the control portion (28) is directly carried by the store (2) and comprises a sheet parallelly adjacent to the second coupling portion (14).

In a 128th aspect according to the preceding aspect, the control portion (28) is integrally joined and parallel to the second coupling portion (14) of the safety device (12).

In a 129th aspect according to anyone of the preceding aspects of process, the step of predisposing the first sheet (51) further provides at least one step of forming on the same (51) at least on through notch (69), one of said first and second portions (52, 54) of the first sheet (51) carrying said second sheet (57), the other of said first and second portions (54, 52) of the first sheet (51) carrying the notch (69) which is able to define the container (18) opening (24).

In a 130th aspect according to anyone of the preceding aspects of process, the store (2) comprises at least one control through-opening (24), said control opening (24) being brought by the lateral wall (4) parallel to the second coupling portion (14) of the safety device (12), said control opening (24) being placed at the removable portion (15) of the safety portion (12) and at the tab (8) inserting portion (10), and wherein the control opening (24) is configured to enable visualising the removable portion (15) before the first open condition of the container (1), said control opening (24) being further configured to enable visualising the tab (8) inserting portion (10) following the first open condition of the container (1) for providing evidence of a tampering of the container (1).

In a 131st aspect according to the preceding aspect, at least a part of the removable portion (15), before the first open condition of the container (1), is interposed between the tab (8) inserting portion (10) and the store control opening (24).

In a 132nd aspect according to anyone of the preceding aspects of process, the removable portion (15) is made of sheet material and extends between a first and second surfaces (15*a*, 15*b*) respectively facing a store (2) lateral wall (4) and store (2) internal volume.

In a 133rd aspect according to the preceding aspect, the first and second surfaces (15*a*, 15*b*) respectively face a store (2) lateral wall (4) carrying the control opening (24), and the store (2) internal volume, the control opening (24) being configured to enable visualising the first surface (15*a*) of the removable portion before the first open condition of the container (1).

In a 134th aspect according to anyone of the preceding aspects of process, the inserting portion (10) is made of sheet material and extends between a first and a second surfaces (10*a*, 10*b*) respectively facing a store (2) lateral wall (4) and the store (2) internal volume.

In a 135th aspect according to the preceding aspect, the first and second surfaces (10*a*, 10*b*) respectively face a store (2) lateral wall (4) carrying the control opening (24), and the store (2) internal volume, the control opening (24) being configured to enable visualising the inserting portion (10) first surface (10*a*) following the first open condition of the container (1).

In a 136th aspect according to anyone of the aspects from 128 to 135, at least a part of the inserting portion (10) visible from the control opening (24) is different from at least one part of the removable portion (15) visible from the control opening (24), the difference between the visible parts of the inserting portion (10) and removable portion (15) is able to provide evidence of a tampering of the container (1).

In a 137th aspect according to the preceding aspect, at least a part of the first surface (10*a*) of the inserting portion (10) visible from the control opening (24) exhibits a color different from at least a part of the first surface (15*a*) of the removable portion (15) visible from the control opening (24) for providing evidence of a tampering of the container (1).

In a 138th aspect according to anyone of the aspects from 73 to 137, the process comprises the following steps:

predisposing the store (2), predisposing the portions of the second and third sheets (57) able to define the closure system (7), predisposing the portions of the fourth and fifth sheets (62, 64) able to define the safety device (12), optionally, closing a passage opening (5) of the store (2) by leaving open at least one opening (5) for inserting the products, inserting the products in the store (2) internal volume (3), folding the portions of the second and third sheets (57, 60) for defining the first closed condition of the container (1), during said folding steps the fourth and fifth sheets (62, 64) portions, respectively defining the first and second coupling portions (13, 14) of the container, engage with each other to define a container (1) arming condition.

In a 139th aspect according to anyone of the preceding aspects, the projection (25) of the removable portion (15), in the first closed condition of the closure system (7), lies on a plane parallel to the inserting portion (10) and projects from the store (2) free edge (6), particularly transversally to the closing portion (9).

In a 140th aspect according to anyone of the preceding aspects, the projection (25) extends besides the free edge (6) by a value greater than 1 mm, particularly between 1 and 10 mm, still more particularly between 1 and 7 mm.

In a 141st aspect according to anyone of the preceding aspects, the projection (25), in the first closed condition of the closure system (7) and before the first open condition of the container (1), is configured for remaining substantially flush with the tab (8) closing portion (9) or is configured for transversally emerging from said closing portion (9), the projection (25) in both the configurations, is configured for being tactilely perceivable.

In a 142nd aspect according to anyone of the preceding aspects, the projection (25) exhibits, according to a front view normal to the lying plane of the same projection (25), a shape selected in the group comprised between: triangular, square, rectangular, trapezoidal, semicircular, elliptical shapes.

In a 143rd aspect according to anyone of the preceding aspects, the projection (25) exhibits, according to a front view normal to the lying plane of the same projection (25), a tapered shape, particularly triangular one, extending from the store (2) free edge (6), the projection (25) tapered shape being configured for aiding the tactile perception of the same during the first closed condition of the closure system (7) and before the first open condition of the container (1).

BRIEF DESCRIPTION OF THE DRAWINGS

Some embodiments and some aspects of the invention will be described in the following illustratively and therefore in a non limiting way with reference to the attached drawings, wherein.

DETAILED DESCRIPTION

Tamper-Evident Container

Figure 1:
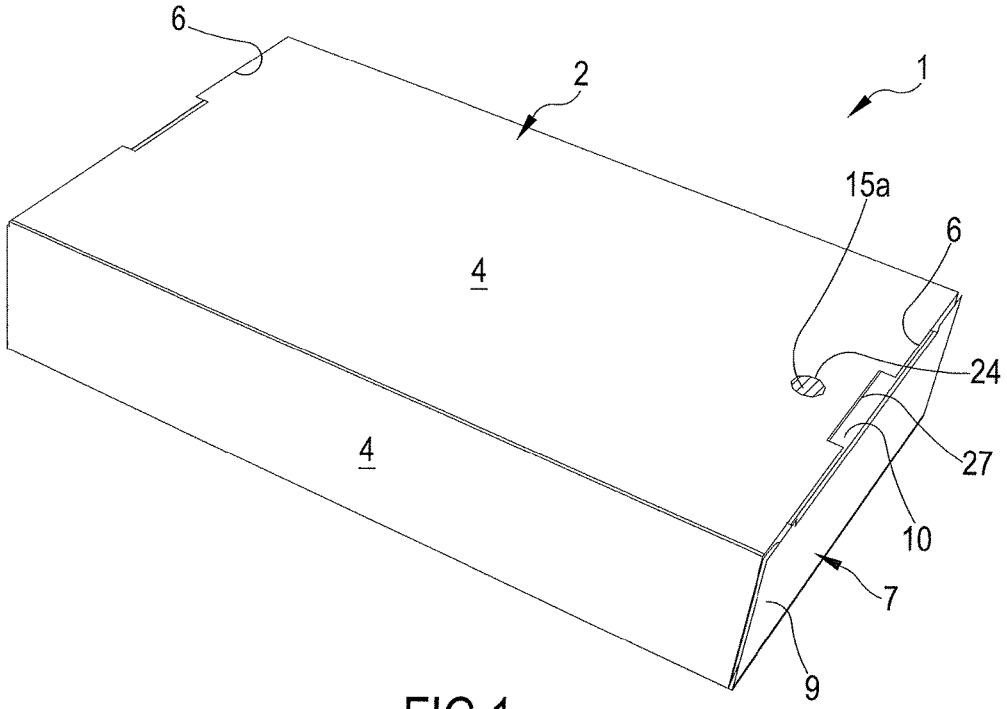
FIG. 1 is a perspective view of a container according to the present invention arranged in a closed condition and before a first open condition.

1 generally shows a tamper-evident container for containing and supporting products. In the present description, we will not go into detail on the type of useable products because such container 1 can find an application, generally, in all the fields providing the packaging of products in order to ensure the closure of the container itself and providing a safety enabling to give evidence of a possible tampering of this latter. Particularly, the container object of the present invention can find an advantageous application in the pharmaceutical and cosmetics field, for example, for defining dispensers able to receive tablets or pills; de facto, in such fields it is particularly interesting to provide intact products and in anyway altered and consequently it is of interest the use of containers capable of giving evidence of a possible tampering or first opening.

As it is for example visible in FIGS. 1-4 and 27-31, the container 1 comprises at least one store 2 defining an internal volume 3, configured for housing products, for example tablets, pills or blisters (the products are not shown); the store 2 substantially represents the compartment able to house and support the products. More specifically, the store 2 comprises a predetermined number of lateral walls 4 defining at least one passage opening 5 delimited by a free edge 6: the passage opening 5 is configured for communicating the store 2 internal volume 3 with the external environment. The attached figures illustrate, in a non limiting way, a configuration of the store 2 exhibiting two through opening 5 opposite to each other with respect to the store 2 itself so that this latter could define substantially a conduit or tube laterally delimited by said walls 4 and opened at the longitudinal ends. However, it is not excluded the possibility of forming, for example, a store 2 exhibiting only one passage opening 5 or even a number of openings 5 greater than two (these conditions are not illustrated in the attached figures).

The attached figures illustrate a preferred but non limiting configuration of the store 2 exhibiting a rectangular prismatic shape (the flat lateral walls 4 having a rectangular shape). However, it is not excluded the possibility of forming a store 2 having a different shape, for example a square, trapezoidal or cylindrical one. As it is visible, the store 2 extends, in a non limiting way, substantially along a prevalent development direction and exhibits a thickness smaller with respect to the length and width of the same. The store 2 is configured for exhibiting a minimum size, in this case the thickness, greater than a maximum transversal size of each product; the minimum size of the store 2 is, in a non limiting way, greater than 7 mm (the thickness can vary and be suitable sized based on the product and quantity to be contained/supported). The invention provides small sized containers 1 whose store 2 defines an internal volume substantially greater than 20,000 $mm^3$, particularly comprised between 40,000 and 200,000 $mm^3$. However, the container 1, object of the present invention, can be used for packaging medium sized products; under such condition, the store 2 can exhibit an internal volume 3 greater than 500,000 $mm^3$, particularly comprised between 800,000 and 1,400,000 $mm^3$. However, it is not excluded the possibility of using the container 1, object of the present invention, for packaging large sized products; under such condition, the store 2 has an internal volume 3 greater than the above specified volumes, for example greater than 10,000 $cm^3$.

Figure 8:
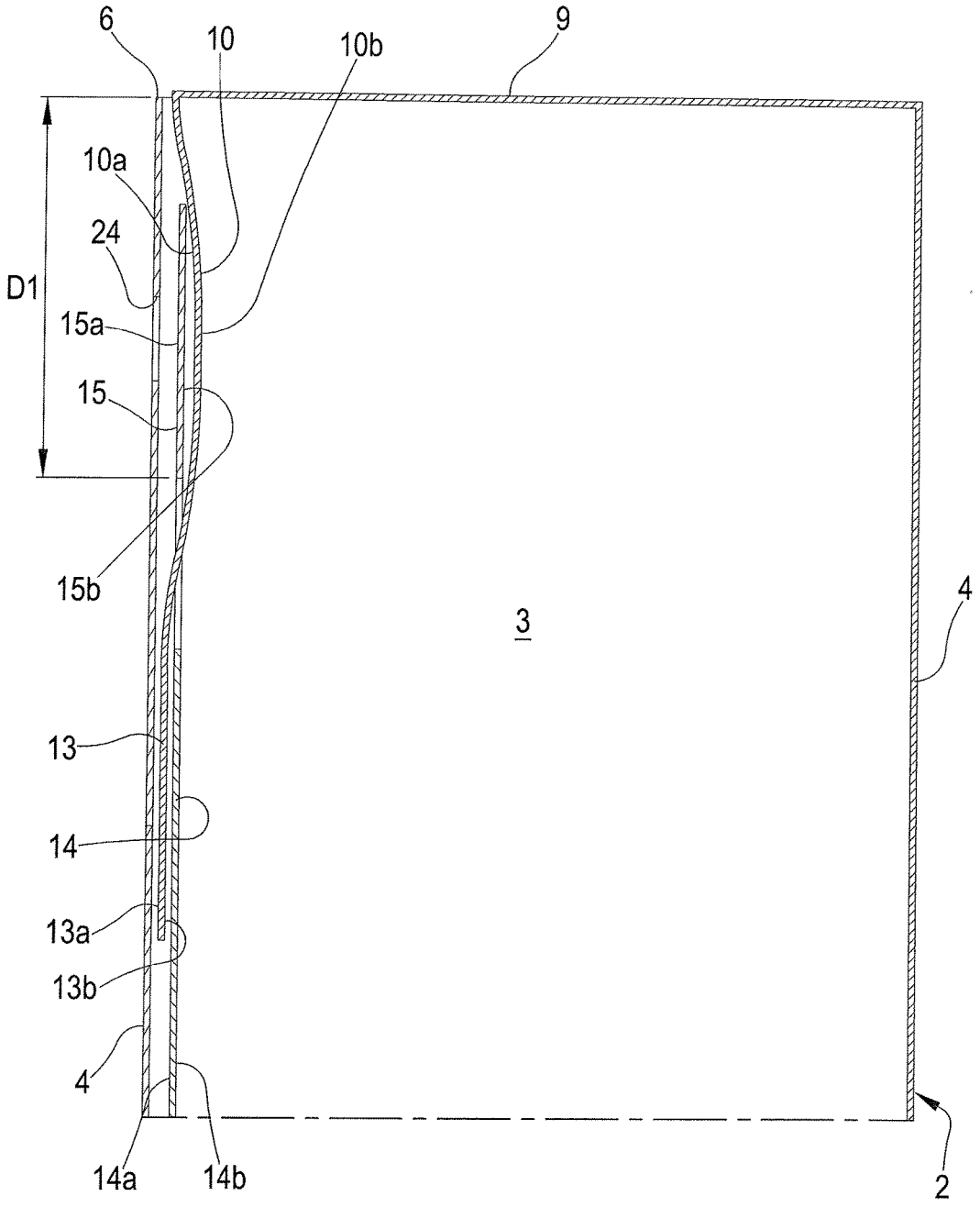
FIG. 8 is a cross-section, made along the VIII-VIII line, of the container in FIG. 7, FIG. 9 schematically shows a cut-away of a container according to the present invention during a first open condition of the same.
Figure 31:
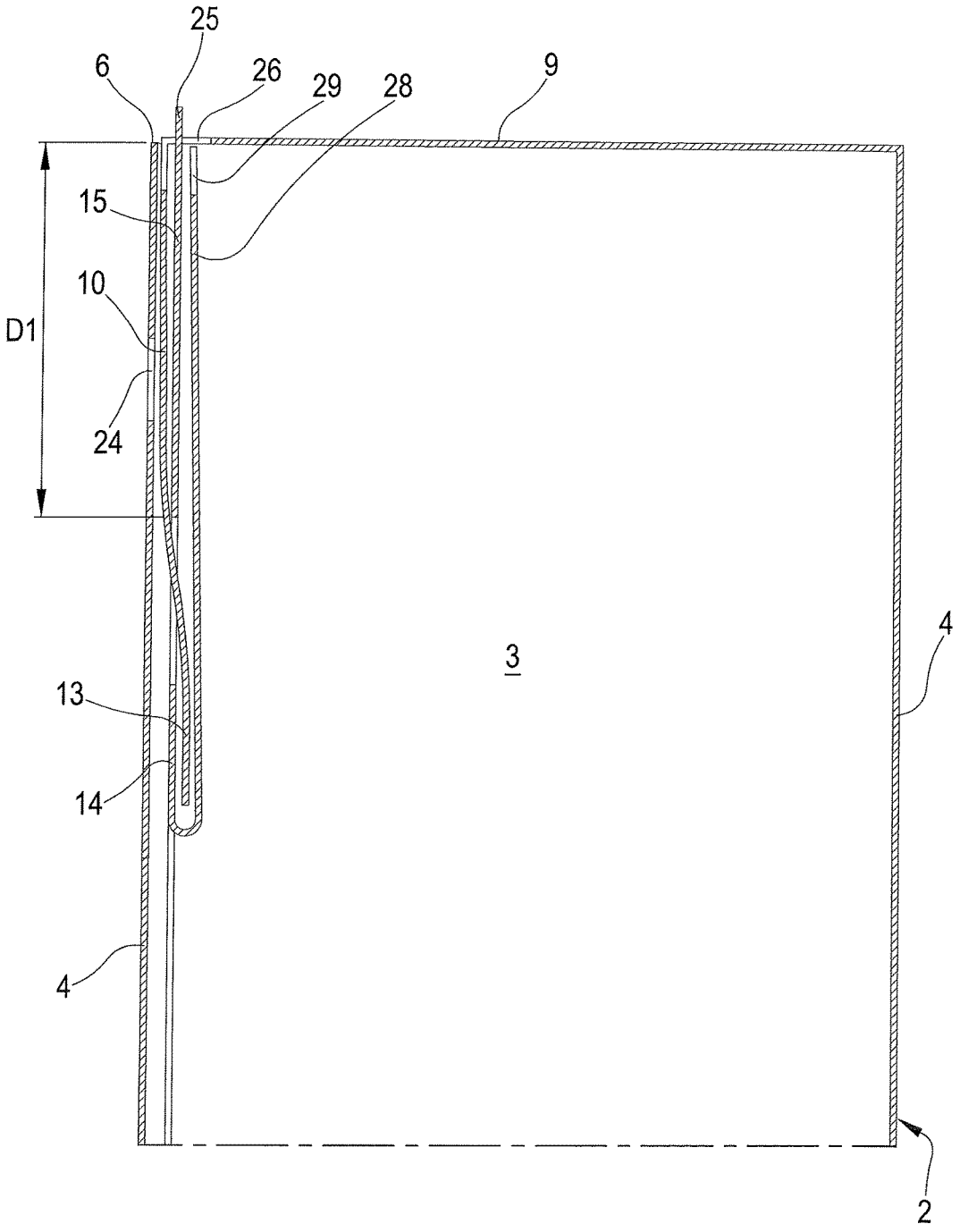
FIG. 31 is a cross-section, made along line XXXI-XXXI, of the container in FIG. 30, FIG. 32 schematically shows a cut-away of a container according to the present invention during a first open condition of the same.
Figure 32:
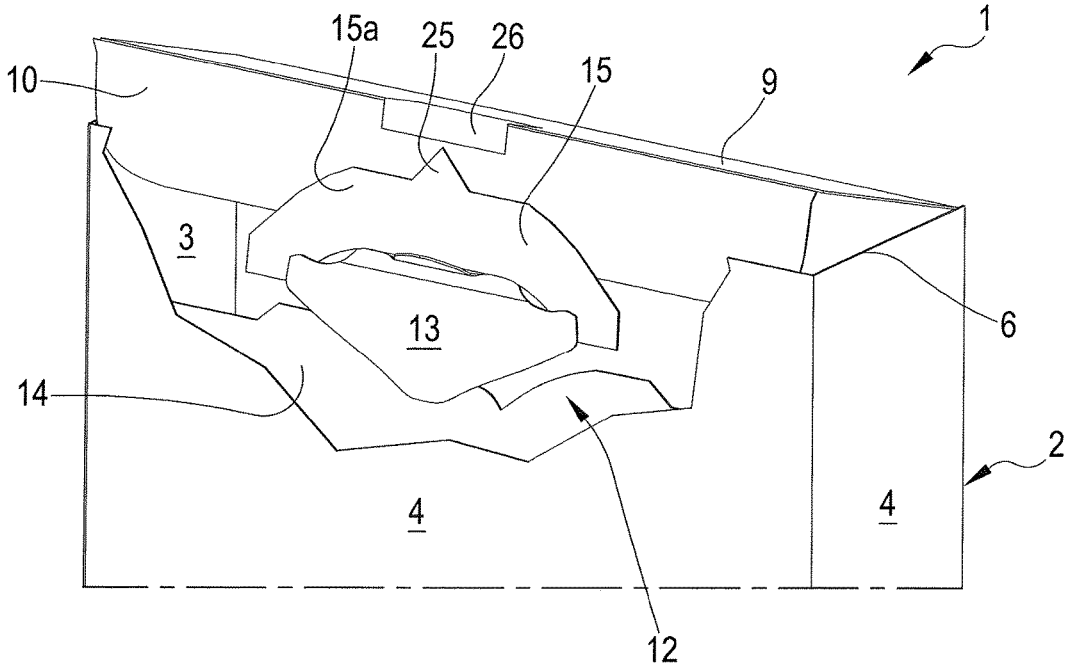

As it is for example visible in FIGS. 1, 8 and 31, the store 2 can comprise at least one control through opening 24 substantially placed at the free edge 6 of the passage opening 5. FIGS. 1, 8 and 31 illustrate a configuration of the opening 24 which defines a closed perimetral edge and distanced from the store free edge 6; the opening 24 exhibits, in a non limiting way, a cylindrical (FIG. 1), rectangular (FIG. 21), elliptical or square shape. Alternatively, the opening 24 can exhibit an open perimetral edge defining at least partially the free edge 6 (see FIG. 22, for example): in such configuration, the opening 24 substantially comprises a through recess. The attached figures illustrate a non limiting configuration of the container 1 wherein the opening 24 exhibits a substantially "V" shape whose concavity faces oppositely the store 2 internal volume 3. The particular function of the opening 24 will be better described hereinafter.

As it is visible for example in FIGS. 1, 5, 33 and 35, the store 2 can further comprise, at the free edge 6, a recess 27; as it is visible in the attached figures, the recess 27 is in contact with the free edge 6 for defining on this latter a kind of depression. Advantageously, the recess 27 is defined on the store 2 lateral wall 4 on which it is further present the opening 24 and particularly on the lateral wall 4 able to abut directly on a closure device 7 of the container 1 which will be better described hereinafter. The recess 27 exhibits an open perimetral outline which exhibits a substantially "C" or "V" or "U" shape, whose concavity faces oppositely the store 2 internal volume 3. At a dimensional level, the recess 27 defines a depression of the free edge 6 having a maximum depth greater than 1 mm, particularly comprised between 2 and 10 mm; the maximum depth is represented by the maximum distance between the free edge and the bottom edge of the recess 27.

The store 2 is made of sheet material and is obtained for example by folding. In a preferred but non limiting embodiment of the invention, the store 2 is made of paper sheet material (paper or paperboard); particularly, the used sheet material exhibit a grammage comprised between 100 and 500 gr/m$^2$, particularly comprised between 200 and 400 gr/m$^2$. As hereinbefore described, the container 1, particularly the store 2, can further be used for housing products of the pharmaceutical, cosmetic and food fields. Therefore, it can be advantageous to cover an internal surface of the store 2 by a plastic material coating, for example a film. The coating has the object to define a barrier interposed between the store 2 and the plurality of products; the coating can be further used for defining a water and/or humidity barrier useful for avoiding the weakening and the loss of structurality of the store with following warping of the paper material forming this latter component. Advantageously, the coating could comprise an extrusion coating on one (the store 2 internal side) or on both the sides (the store 2 internal and external surfaces) of the paper material defining the store 2 with values which can for example vary between 10 and 50 gr/m$^2$ of the coating material (in other words, polyethylene). The coating plastic material can comprise for example one selected among the following materials: LDPE, HDPE, PP, PE.

As it is visible in the attached figures, the container 1 further comprises at least one closure system 7, also made of sheet material, engaged at the free edge 6 and movable, particularly by rotation, with respect to the store 2. Specifically, the closure system 7 is configured for defining at least one closed condition (see for example FIG. 1) in which the system 7 itself interdicts the communication between the internal volume 3 of store 2 and the external environment; further, the closure system 7 is configured for defining at least one open condition (see FIGS. 2, 21 and 22, for example), wherein the system 7 itself enables the communication between the internal volume 3 and external environment. De facto, the system 7 substantially represents a cover able to cooperate with the store 2 in order to manage the access to the internal volume 3. Advantageously, the container 1 comprises a closure system 7 for each passage opening 5 of the store 2. In the attached figures, it is illustrated, in a non limiting way, a container 1 configuration exhibiting two through openings 5; under such condition, the container 1 exhibits two closure systems 7 engaged with the respective free edge 6 of the store 2: the systems 7 are placed opposite to each other with respect to the store itself. Advantageously, the closure system 7 is, in a non limiting way, integrally joined to the store 2, particularly with the free edge 6, and is rotatingly movable around this latter between at least the closed and open conditions.

More specifically, the closure system 7 comprises at least one tab 7 exhibiting a closing portion 9 directly engaged with and integrally joined to the store 2 free edge 6: the closing portion 9 represents the component of the tab 8 configured for interdicting the passage through the opening 5 under the closed condition of the system 7 itself. As it is visible in the attached figures, the closing portion 9 substantially comprises a flat body of sheet material countershaped to the opening 5 free edge 6. The attached figures schematically show a preferred configuration of the closing portion 9 exhibiting a rectangular shape entirely countershaped to the free edge 6.

Further, the tab 8 exhibits at least one inserting portion 10 configured to insert, under the system closed condition, inside the store 2 volume 3. The inserting portion 10 is integrally joined to the closing portion 9 and emerges from this latter from the opposite side of the store 2: the inserting portion 10 substantially represents an extension of the closing portion 9 able to be inserted, under the system 7 closed condition, inside the store 2. As it is visible in the attached figures, also the inserting portion 10 comprises substantially a flat body made of sheet material having, in a non limiting way, a rectangular shape. As it is visible, for example, in the cross-section view in FIG. 8, the inserting portion 10 extends between a first and second prevalent development surfaces 10*a*, 10*b* respectively outwardly facing (directly facing a store 2 lateral wall 4) and towards the store 2 internal volume 3. Under the closed condition of the system 7, at least one portion of the first development surface 10*a* of the inserting portion 10 faces, particularly contacts, directly a part of a store 2 lateral wall 4: the surface 10*a* extends at least partially parallelly to the store 2 wall 4, particularly parallel to a store 2 front wall opposite to the wall directly connected to the system 7 (definable also as the store 2 back lateral wall).

The closing portion 9 and the inserting portion 10 exhibit a reciprocal connection edge opposite to the store 2 free edge 6 with respect to the closing portion 9 itself: the inserting portion 10 is rotatingly movable with respect to the closing portion 9 around said reciprocal connection edge. As it is visible for example in FIG. 8, the inserting portion 10, under the system 7 closed condition, is configured for defining, according to a cross-section and in cooperation with the closing portion 9, a substantially "L" shape: under such condition, the inserting portion 10 substantially extends parallel to one store 2 lateral wall 4. As it is visible for example in FIGS. 2-5, 21-25, 27 and 34, the closure system 7 further comprises at least one abutting portion 11 engaged with the store 2 free edge 6 adjacent to the tab 8: the abutting portion 11, under the closed condition, is configured for being interposed between the internal volume 3 and tab 8 in order to cooperate with this latter for holding stably it in said closed condition. The abutting portion 11 substantially comprises a flat tab made of sheet material integrally joined to the store 2 free edge 6 adjacent to the closing portion 9. The abutting portion 11 exhibits, in a non limiting way, a rectangular or trapezoidal shape. Also the abutting portion 11 is configured for rotating around the free edge 6 for facing, at least under the container 1 closed condition, the store 2 inside.

More particularly, the abutting portion 11 is constrained to the free edge 6 in order to be capable of engaging, under the container 1 closed condition, at least a part of the inserting portion 10 and/or of the closing portion 9 for stably holding the tab 8 in said condition.

Advantageously, the container 1 comprises two abutting portions 11 opposite to each other with respect to the tab 8: this latter is interposed between the two abutting portions 11. In such configuration (illustrated for example in FIGS. 2-5 and 21-25), the two portions 11 symmetrically operate on the tab 8 for stably holding it in the closed condition.

As hereinbefore described, the store 2 comprises a control through-opening 24; as it is visible for example in FIG. 8, the control opening 24 is placed on the lateral wall 4 configured for directly facing the inserting portion 10, particularly the first surface 10*a* of said portion 10. The control opening 24 is therefore placed in proximity with the first surface 10*a* and is configured to enable visualising this latter in determined operative conditions of the container 1, which will be better described herein below. The opening 24 can—in addition or alternatively—be configured to enable visualising the inserting portion 10 and the correct insertion of the same inside the store 2 as it will be better described herein below. Further, as hereinbefore described, the store 2 comprises a recess 27; as it is visible for example in FIGS. 5 and 29, the recess 27 is placed on the lateral wall 4 configured for directly facing the inserting portion 10, particularly the first surface 10*a* of said portion 10. The recess 27 is therefore placed in proximity with the first surface 10*a* and is configured to enable visualising this latter in determined operative conditions of the container 1, which will be better described herein below.

As it is visible in the attached figures, the closure system 7 can comprise, in a non limiting way, a through opening 26 configured to place, under a closed condition of the system itself, at the free edge 6, particularly at the recess 27. De facto, the through opening 26, under the closure system 7 closed condition, is placed at the store 2 recess 27 (FIG. 33): particularly, under such condition, the opening 26 and recess 27 are reciprocally facing and at least partially counter-shaped with each other.

Figure 30:
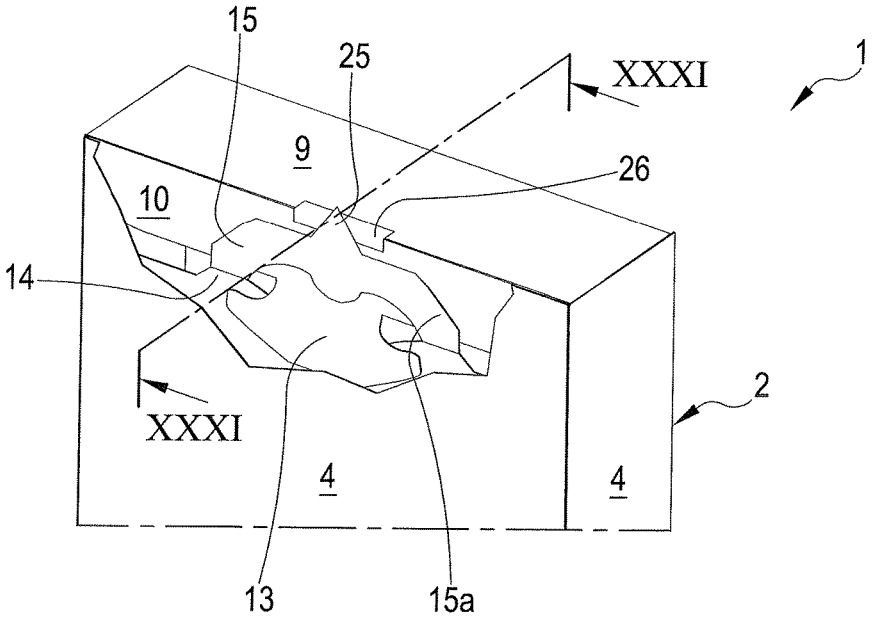

As it is visible in the attached figures, the trough opening 26 defines a closed perimetral outline, particularly exhibiting at least one shape selected in the group among the following shapes: rectangular, square, circular, elliptical, semicircular, triangular. The through opening 26 is defined on the closing portion 9 and/or on the inserting portion 10 of the tab 8. In a preferred, but non limiting embodiment of the invention, the through opening 26 is defined, without interruption, at least partially on the closing portion 9 and at least partially on the inserting portion 10 of the tab 8: the opening 26 is substantially defined on the folding lines of the portions 9 and 10 of tab 8 (FIG. 30).

In a preferred but non limiting embodiment of the invention, the system 7 is made, at least partially, particularly entirely, of paper sheet (paper or paperboard); the used sheet material exhibits a grammage comprised between 100 and 500 gr/m$^2$, particularly comprised between 200 and 400 gr/m$^2$. Optionally, the paper sheet material used for the embodiment of the system 7, is as the sheet material used for the embodiment of the store 2, particularly they are both obtained from only one paper material sheet. As hereinbefore described, the container 1 can also be used for housing products of the pharmaceutical, cosmetic and food fields. Under such condition, it could be advantageous to cover an internal surface of the system 7 by a plastic material coating, for example a film. The coating has the object of defining a barrier interposed between the system 7 and the products; further, the coating is able to define a water and/or humidity barrier useful for avoiding the weakening and the loss of structurality of the system with a consequent warping of the paper material forming this latter component. Further, it is noted that a structurality loss or a simple warping of the closure system could compromise the functionality of the system 7 and therefore prevent a correct closure of the store 2. Advantageously, the coating could be an extrusion coating on one (internal side of the system 7) or on both the sides (the system 7 internal and external surfaces) of the paper material defining the system 7 with values which can for example vary from 10 to 50 gr/m$^2$ of the coating material (in other words, polyethylene). The coating plastic material can be for example selected among the following materials: LDPE, HDPE, PP, PE.

As it is visible for example in FIGS. 2-5 and 27-29, the container 1 further comprises at least one safety device 12, made of sheet material, stably engageable at least partially with the store 2 and at least partially with the closure system 7 following a first closed condition of this latter. De facto, the safety device 12 comprises at least one removable portion 15 configured for defining, following the first closed condition, a tactilely perceivable projection 25 (FIGS. 27-29) emerging from the store 2 and/or from the closure system 7: the removable portion 15, together with the projection 25, is configured to separate from the safety device 12 following a closure system 7 first open condition following the first closed condition for providing evidence of a container 1 tampering.

More particularly, the removable portion 15 projection 25, under the closure system 7 first closed condition and before the container 1 first open condition, lies on a plane parallel to the inserting portion 10 and projects from the store 2 free edge 6, particularly transversally to the closing portion 9. Still more particularly, the projection 25, under the closure system 7 first closed condition and before the container 1 first open condition, is configured to place at the recess 27 and emerging besides this latter and/or besides the store 2 free edge 6.

De facto, the projection 25, under the closure system 7 first closed condition and before the container 1 first open condition, is configured for substantially remaining flush with the tab 8 closing portion 9 or is configured for emerging transversally from said closing portion 9; anyway, the projection 25, in both the configurations, is able to be tactilely perceivable so that the same can be distinguishable from the closed portion 9, the free edge 6 and from the recess 27.

From the geometrical point of view, the projection 25 exhibits, according to a front view normal to the lying plane of the projection 25 itself, a shape selected in the group comprised among: triangular, square, rectangular, trapezoidal, semicircular, elliptical shape. In a preferred but non limiting embodiment of the container 1, the projection 25 exhibits, according to front view normal to the lying plane of the projection 25 itself, a tapered, particularly triangular, shape extending from the store 2 free edge 6: the projection 25 tapered shape is configured for assisting the tactile perception of the same during the closure system 7 first closed condition and before the container 1 first open condition. From the quantitative point of view, the projection 25 extends besides the free edge 6 to an extent greater than 1 mm, particularly between 1 and 10 mm, still more particularly between 1 and 7 mm. The tapered shape and the height of the projection with respect to at least the store 2 free edge 6 enable an easy and fast tactile perception of the same projection for example by passing a finger on the tab 8 closing portion 9.

The attached figures illustrate a preferred but non limiting embodiment of the safety device 12 exhibiting at least one first coupling portion 13 carried by the tab 8 and/or by the abutting portion 11, and at least one second coupling portion 14 engaged with the store 2. The first and second coupling portions 13, 14 are configured to stably engage with each other during a closure system 7 first closed condition in other words during a system 7 first absolute closure wherein there is the first insertion of the inserting portion 10 inside the store 2. As it is visible in the attached figures, the second coupling portion 14 is arranged internally of the store 2 and substantially lies in a plane parallel to one of the lateral walls 4: under the system 7 closed condition, the first coupling portion 13 is configured to insert at least partially in the store 2 internal volume 3 for stably engaging the second coupling portion 14. The first and/or second coupling portions 13, 14 comprise at least one removable portion 15 carrying the projection 25, configured to separate from the safety device 12 following a closure system 7 first closed condition, following said first closed condition, for providing evidence of a container 1 tampering. The attached figures illustrate, in a non limiting way, a container 1 configuration wherein the first coupling portion 13 is engaged with, particularly directly carried by, the closure system 7 tab 8 (alternatively, it could be further carried by at least one abutting portion 11). Advantageously, the first coupling portion 13 is carried only, but not in a limiting way, by the inserting portion 10 of the tab 8: the two portions 10 and 13 are advantageously integrally joined to each other to form only one body. De facto, the first coupling portion 13 comprises a flat sheet body emerging, particularly without interruption, from the inserting portion 10 oppositely to the closing portion 9: the inserting portion 10 therefore is interposed between the closing portion 9 and the coupling portion 13. The first coupling portion 13, under the system 7 closed condition, and therefore during the insertion of the inserting portion 10 in the store 2, is configured to also insert in the internal volume 3.

The sheet material body of the first coupling portion 13 extends between a first and second prevalent development surfaces 13*a*, 13*b* (FIG. 8) respectively facing in the same direction of the first and second surfaces 10*a*, 10*b* of the inserting portion 10: the first surfaces 10*a*, 13*a* are a continuation of each other and directly face a same lateral wall 4 of the store 2 opposite to the lateral wall 4 directly connected to the system 7. The second surfaces 10*b*, 13*b* are also a continuation of each other and face the store 2 internal volume 3.

More specifically, the first coupling portion 13 comprises at least one undercut portion 20 delimited by a gripping edge 21: the undercut portion 20, under the container 1 first closed condition, is configured for engaging the second coupling portion 14 arranged internally of the store 2 (particularly, the second coupling portion is completely contained in the store 2).

Figure 5:
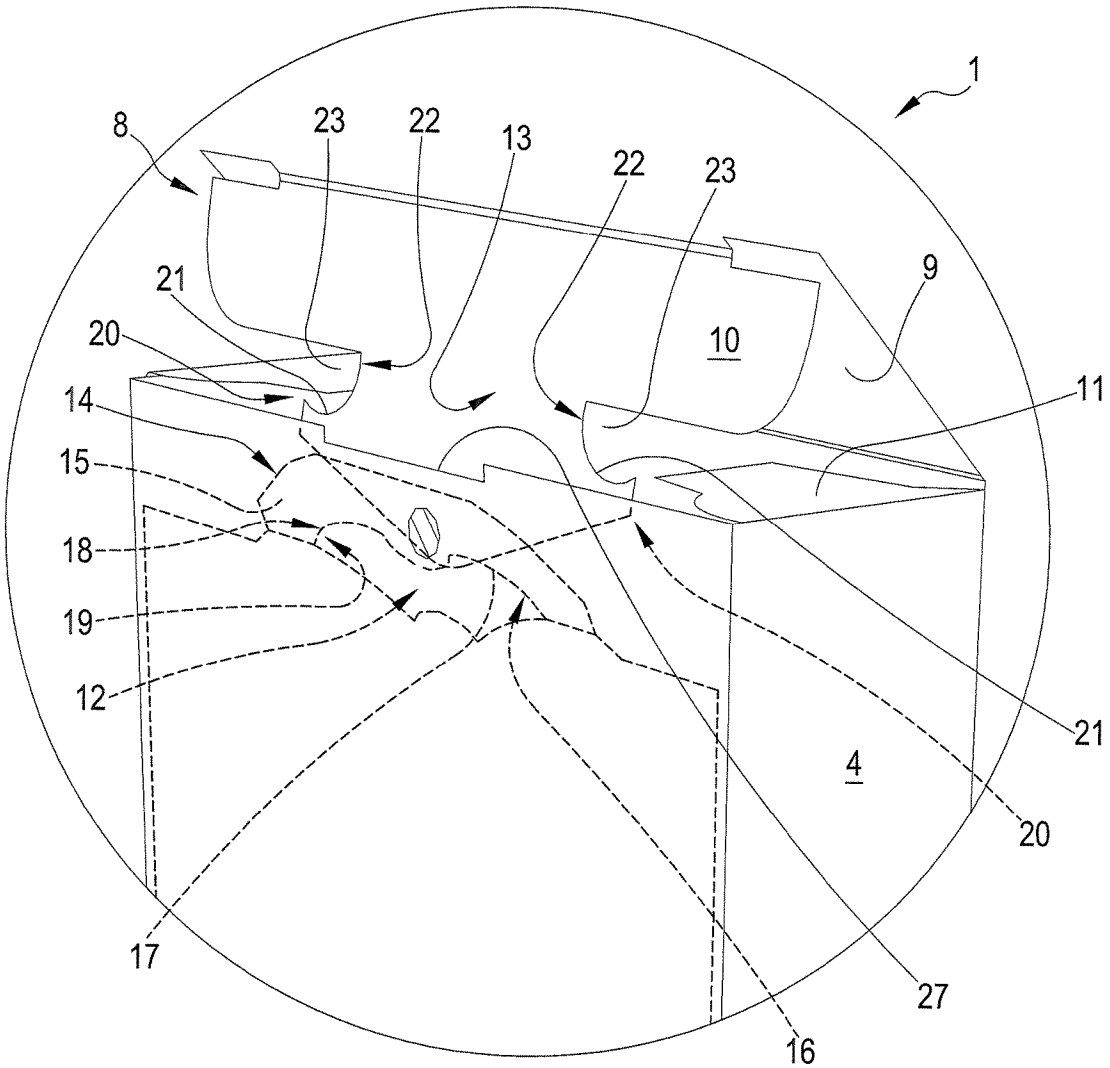
FIG. 5 is a view of a detail of the container in FIG. 4, FIG. 6 schematically shows a cut-away of a container according to the present invention during a first closed condition of the same, FIG. 7 schematically shows a cut-away of a container according to the present invention under a first closed condition of the same.
Figure 6:
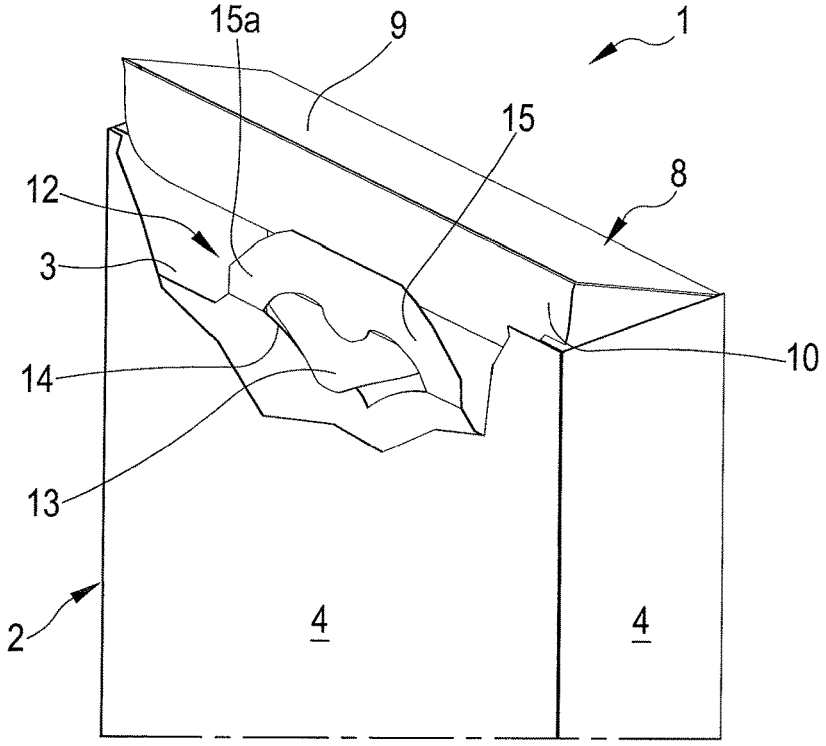
Figure 7:
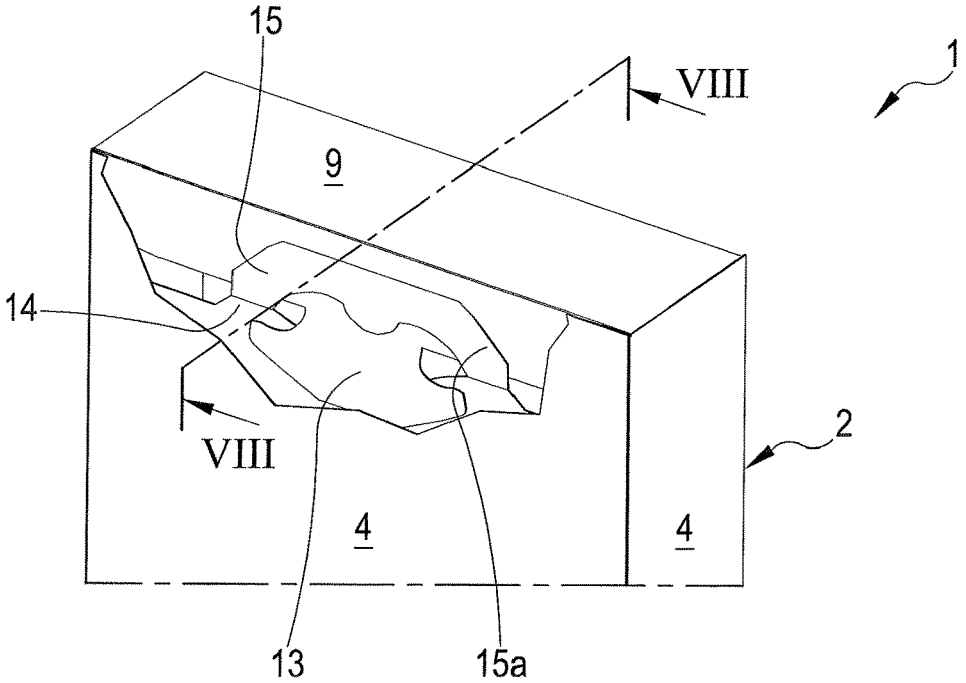
Figure 21:
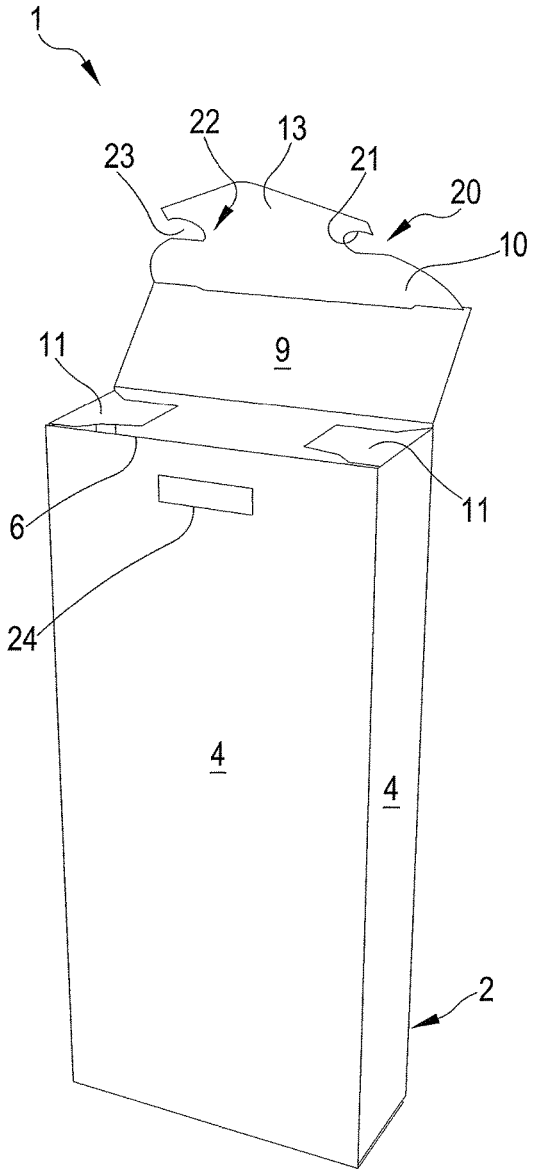
FIGS. 21 and 22 are perspective views of respective embodiment variants of a container according to the present invention.
Figure 22:
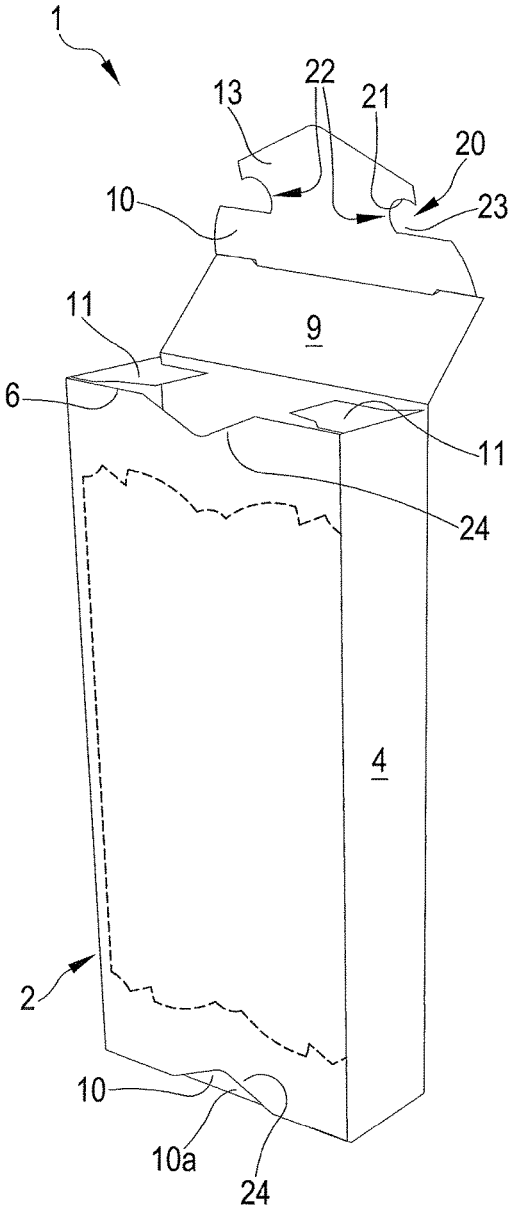

As it is visible for example in FIGS. 5, 21 and 22, the undercut 20 comprises at least one hook 22 defining a seat 23 whose concavity faces, at least during the device 12 first closed condition, at least one of the store 2 lateral walls 4, particularly faces the abutting portion 11 of the closure system 7. The undercut portion 20 seat 23 defines a substantially "C" shape: the respective gripping edge 21 delimits a portion of said seat 23 which, under the system 7 first closed condition, faces the store 2 free edge 6.

The attached figures show a preferred but non limiting configuration of the first coupling portion 13 substantially comprising two hooks 22 opposite to each other with respect to the first portion 13 itself. Under such condition, therefore the first portion 13 comprises two respective undercut portions 20 which, at least under the container 1 first closed condition, are configured for both engaging with the second coupling portion 14. The two undercut portions 20 comprise respective seats 23 whose concavities face away from each other: the concavities of the seats face the respective store 2 abutting portions 11. The presence of the two undercuts 20 substantially defines a double symmetrical grip on the second coupling portion 14 which makes more effective and stable the coupling between said first and said second coupling portions 13, 14.

As previously described, the second coupling portion 14 of the device 12 is directly engaged inside the store 2. Particularly, the second coupling portion 14 is directly connected to at least one store 2 lateral wall and extends parallelly to this latter: the coupling portion 14 develops parallelly to the lateral wall configured for directly facing the inserting portion 10 at least during the system 7 closed condition. De facto, the coupling portion 14 extends parallelly to the lateral wall 4 opposite to the wall directly connected (integrally joined to) to the closure system 7.

As it is visible for example in FIGS. 2, 4, 24-26, the second coupling portion 14 is integrally joined to store 2, particularly is integrally joined to at least one store 2 lateral wall. As for the first coupling portion 13, also the second portion 14 comprises a flat sheet material body emerging, particularly without interruption, from a store 2 lateral wall 4: the second portion 14 substantially defines a sheet engaged, particularly integrally joined to, inside one or more store 2 lateral walls 4. The sheet material body of the second coupling portion 14 extends between a first and second prevalent development surfaces 14*a*, 14*b* (FIG. 8) respectively facing the outside and inside of the store 2: the portion 14 first surface 14*a*, at least under the system 7 closed condition, is parallel to and faces as the first surfaces 10*a*, 13*a* (the first surfaces 10*a*, 13*a*, 14*d* directly facing a store 2 lateral wall 4 opposite to the lateral wall 4 directly connected to the system 7).

In the configuration illustrated in the attached figures, the second coupling portion 14 comprises, in a non limiting way, the removable portion 15, carried by the projection 25, made of sheet material which extends between a first and second surfaces 15*a*, 15*b* (FIG. 8) respectively facing a store 2 lateral wall 4: the surfaces 15*a*, 15*b* of the removable portion 15 substantially represent a prolongation of the surfaces 14*a*, 14*b* of the second coupling portion 14, while the projection represents a respective prolongation of the removable portion placed oppositely to the portion 14.

The removable portion 15 comprises at least one undercut portion 16 which is configured for engaging, under the safety device 12 first closed condition, the respective undercut portion 20 of the first coupling portion 13. The undercut portion 16 of the removable portion 15 is delimited by a gripping edge 17 which, under the container 1 first closed condition, is distinct and distanced from the store 2 free edge 6: the undercut portion 16 is inside the store 2 (completely inside the store) and distanced from the passage opening 5 (distanced from the free edge 6) so that the removable portion 15 can engage, under the first closed condition, the respective undercut 20 of the first coupling portion 13. Particularly, the gripping edge 17, under the container 1 first closed condition, exhibits a minimum distance D1 (FIG. 8) from the store free edge 6 greater than 2 mm, particularly greater than 3 mm, still more particularly comprised between 3.5 and 12 mm.

Figure 24:
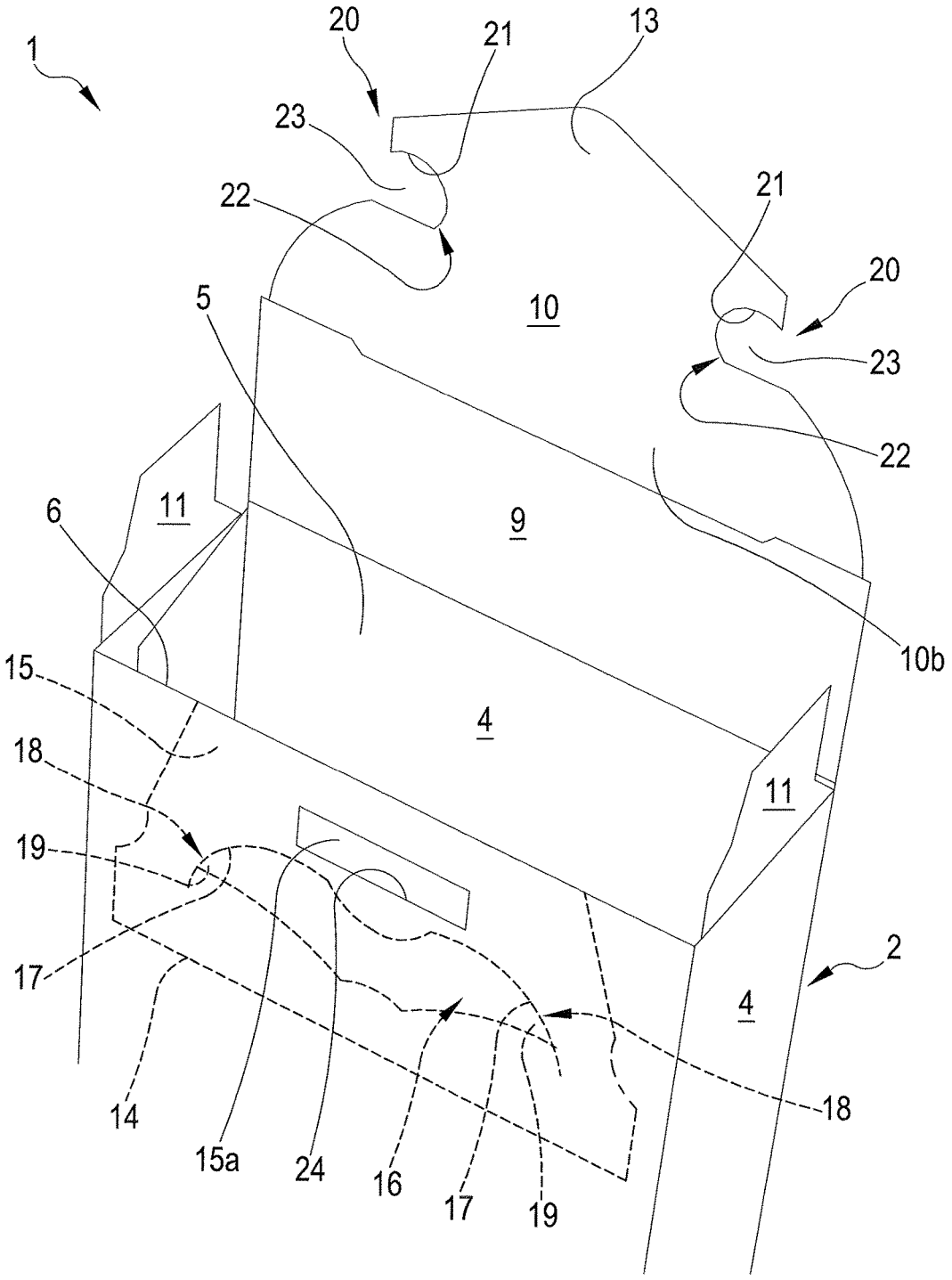
FIG. 24 is a partial perspective view of a container according to the present invention arranged in an open condition, before a first closed condition.
Figure 26:
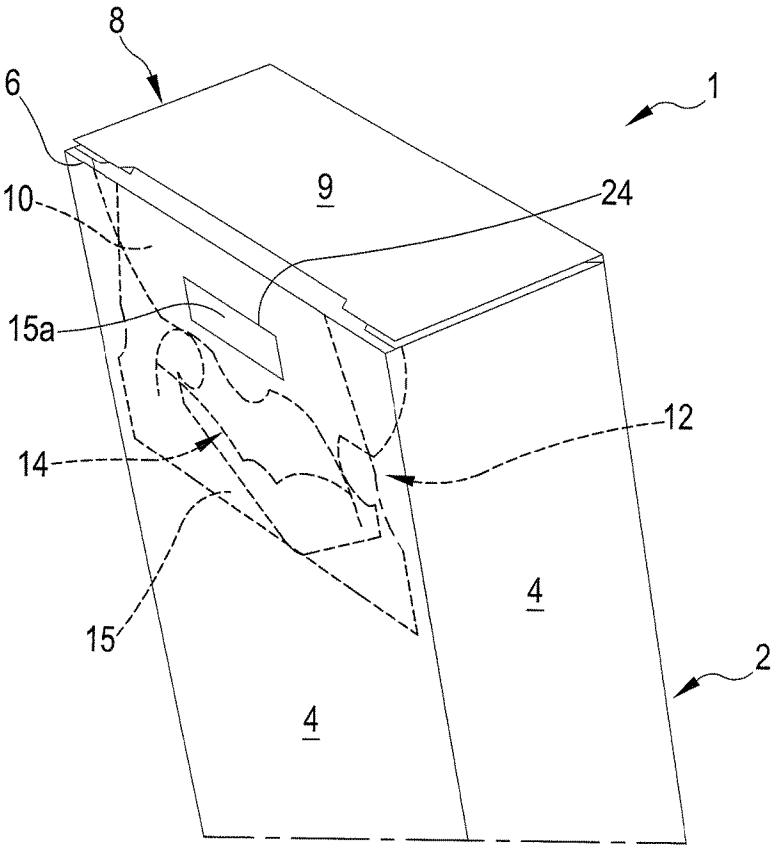
FIG. 26 is a partial perspective view of a container according to the present invention in a closed condition, before a first open condition.
Figure 25:
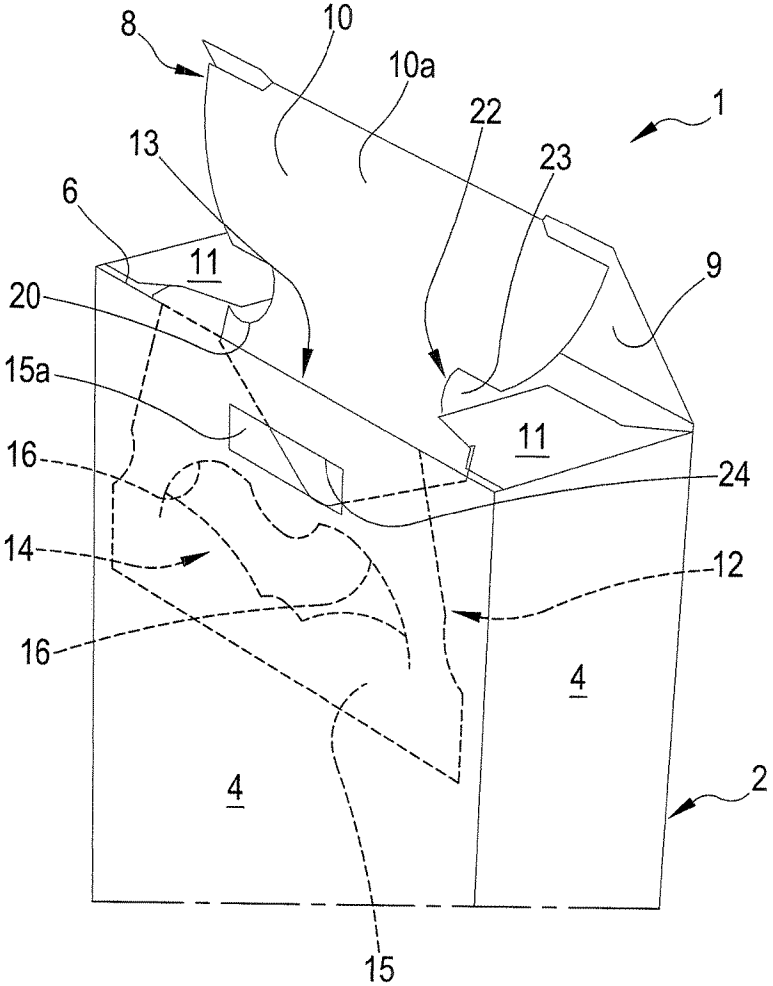
FIG. 25 is a partial perspective view of a container according to the present invention during the first closed condition of the same.
Figure 27:
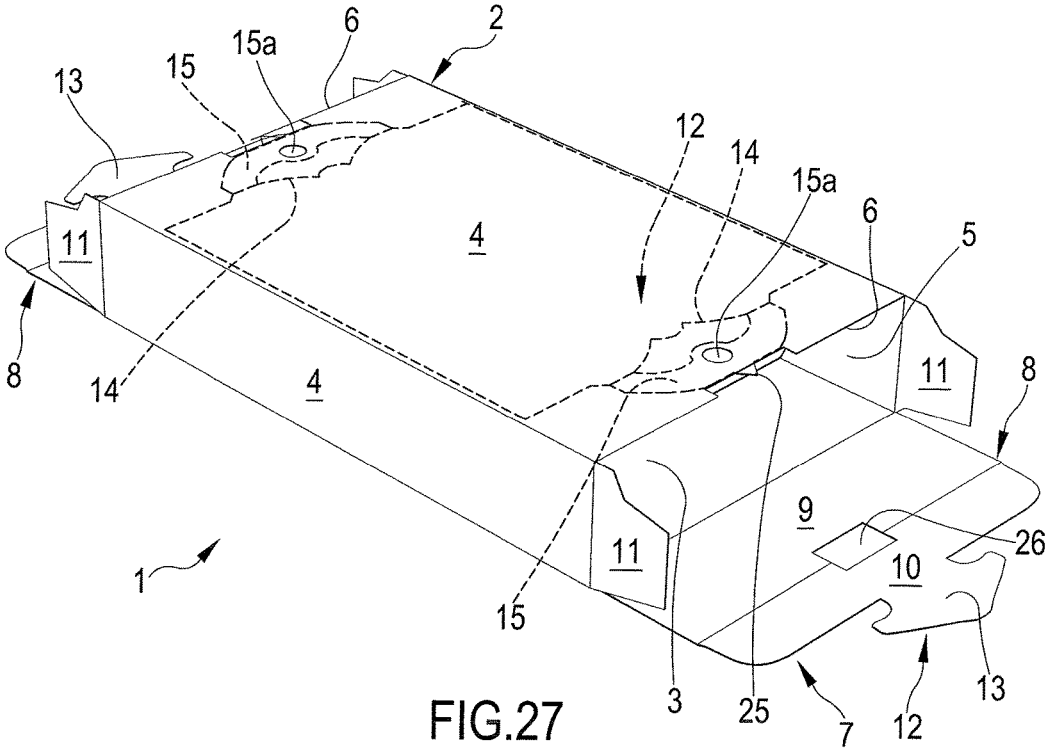
FIGS. 27 and 28 are respective perspective views of a container according to the present invention before a first open condition, FIG. 29 schematically shows a container according to the present invention during a first closed condition of the same, FIG. 30 schematically shows a cut-away of a container according to the present invention under a first closed condition of the same.
Figure 28:
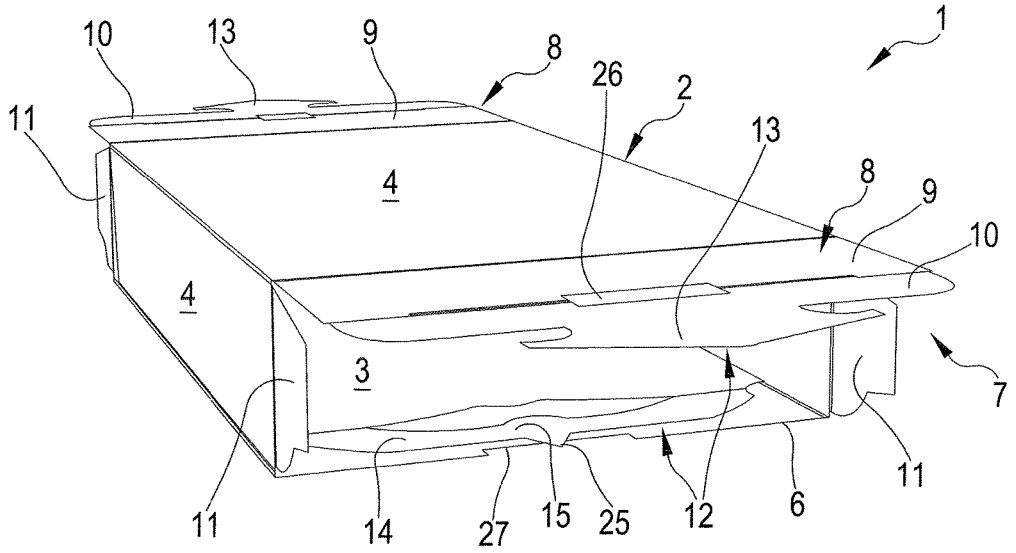
Figure 29:
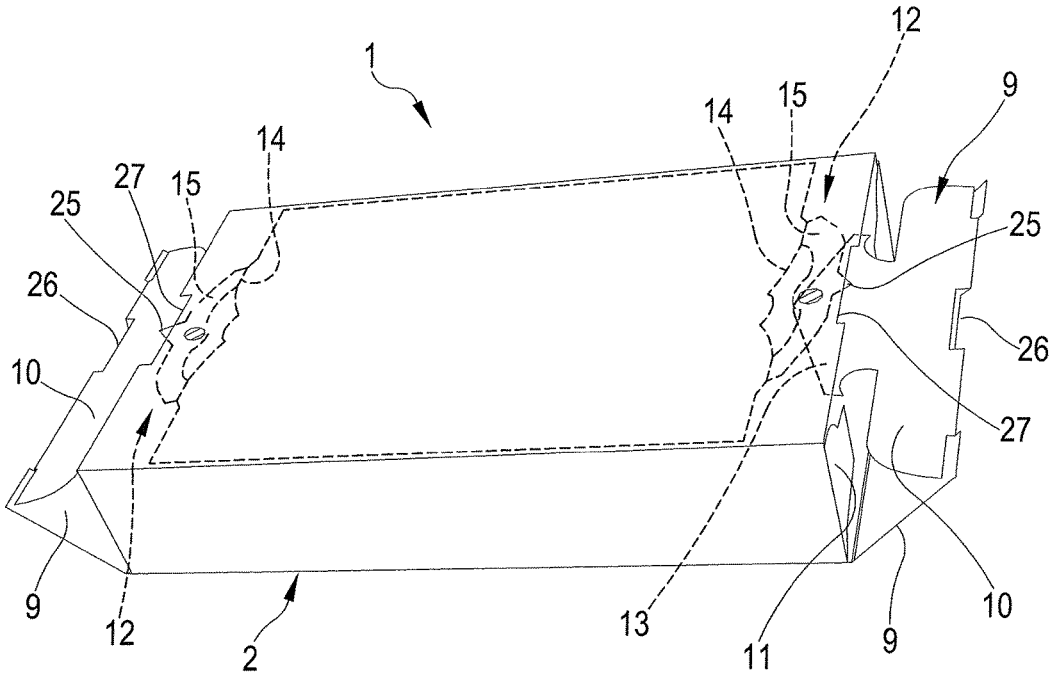

As it is visible for example in FIGS. 5 and 24, the undercut portion 16 of the removable portion 15 comprises at least one hook 18 defining a seat 19 whose concavity faces at least one of the store 2 lateral walls 4. Particularly, the seat 19 exhibits a substantially "C" shape: the gripping edge 17 delimits the portion of the seat 19 facing the store 2 free edge 6. More particularly, it is possible to observe that the gripping edge 17 of the removable portion 15, under the container 1 first closed condition, is interposed between the store 2 free edge 6 and the respective gripping edge 21 of the first coupling portion 13.

The attached figures represent, in a non limiting way, a configuration of the removable portion 15 which exhibits two undercuts 16 placed opposite to each other with respect to the removable portion 15 itself: the concavities of the respective seats 19 are opposite to each other and face respective abutting portions 11 of the store 2. With reference to the first coupling portion 13, it is instead possible to observe that the concavity of the seat 19 of the removable portion 15, under the container 1 first closed condition, faces the concavity of the seat 23 of the respective undercut portion 20 of the first portion 13.

Figure 2:
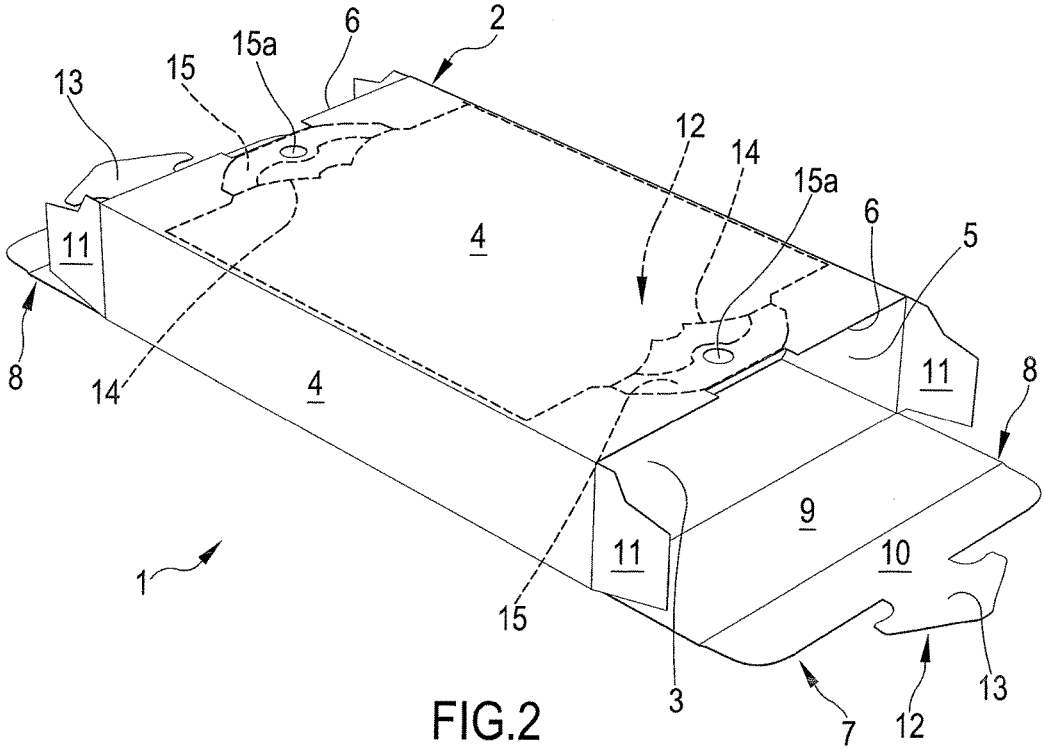
FIGS. 2 and 3 are respective perspective views of a container according to the present invention before a first open condition, FIG. 4 schematically shows a container according to the present invention during a first closed condition of the same.
Figure 3:
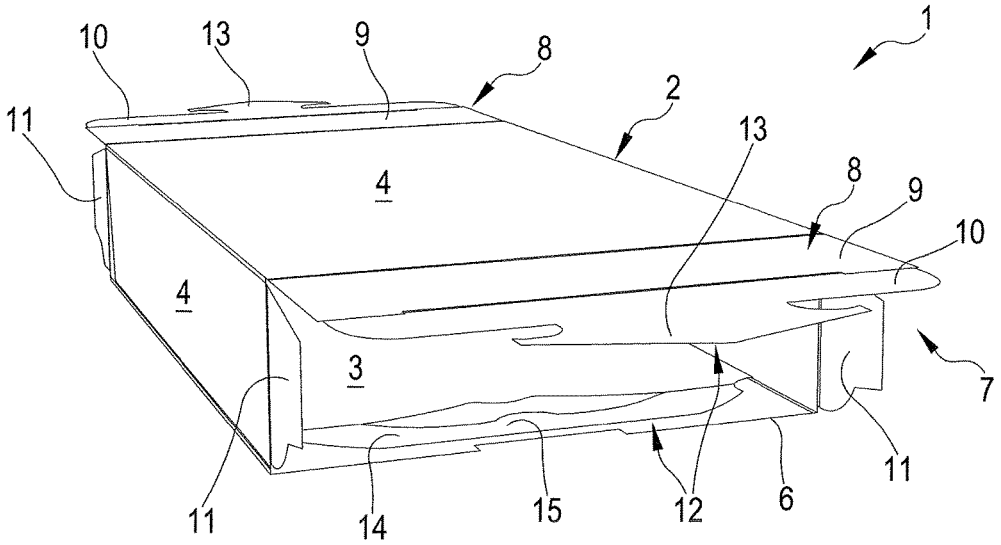
Figure 4:
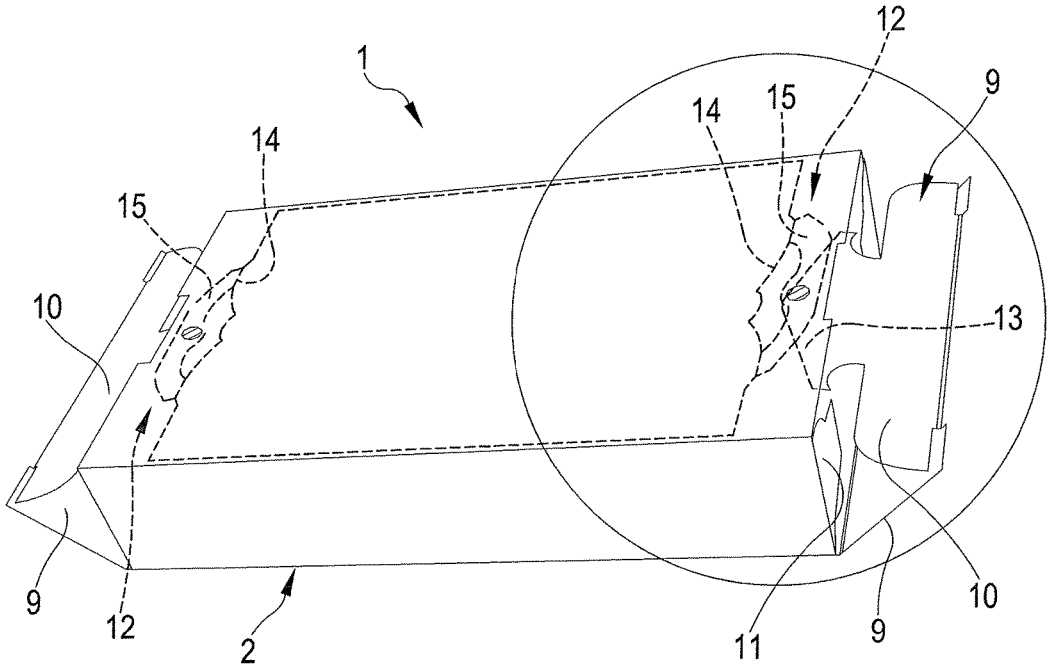

As described hereinbefore, the first and second coupling portions 13, 14 of the safety device 12 are configured for defining a first closed condition substantially defined by the first engagement/coupling between said portions. Before the first closed condition, the first coupling portion 13 is placed outside the internal volume 3, while the second coupling portion 14 lies inside the store 2 (this condition is illustrated in FIGS. 2, 3, 24). After, the closure system 7 is guided for the first time inside the store 2 as illustrated, for example, in FIGS. 4, 5, 6 and 25: during such step, the system 12 is configured for defining the container 1 closed condition and at the same time there is a first engagement between the first and second coupling portions 13, 14. De facto, during the container 1 first closed condition, the removable portion 15 hook 18 engages the first portion 13 hook 22: the first closed condition is illustrated in FIGS. 1, 7, 8 and 26. More particularly, also during the first closed condition, the sheet material body of the first coupling portion 13 is configured for sliding, initially rearwardly the removable portion (the removable portion 15 is interposed between the first coupling portion 13 and the store 2 lateral wall 4) for then passing through the seat 19 and being interposed between the store 2 lateral wall 4 and the second coupling portion 14. As an alternative, the coupling portion can initially slide forwardly the removable portion 15 for then passing through the seat 19: under such condition, the second portion 14 is interposed between the store 2 lateral wall 4 and the first coupling portion 13.

The container 1 first closed condition is schematically illustrated in FIGS. 1, 7, 8, 26 and 30. Under such condition, the removable portion 15 hook 18 abuts on and is stably engaged with the first portion 13 hook 22: under such condition, the first portion 13 is completely inserted inside the removable portion 15 seat 17 and the respective undercuts 16 and 20 define a stably engagement condition between the portion 13 and 14.

The projection 25 carried by the removable portion 15, under the device 7 first closed condition and before the container 1 first open condition, is distanced from and placed opposite to the gripping edge 17 with respect to the removable portion 15; particularly the projection 25 emerges oppositely to the gripping edges with respect to the removable portion 15 and, as hereinbefore described, emerges from the store 2 free edge 6. De facto, the second portion 14, under the device first closed condition and before the container 1 first open condition, remains completely inside the volume 3 together with the removable portion 15: only the removable portion 15 projection 25 emerges at least partially from the volume 3 and particularly besides the store 2 free edge 6.

It is useful to note that the removable portion 15, based on the mode of inserting the portion 13, can be interposed between the store 2 lateral wall 4 and the tab inserting portion 10 (condition illustrated in FIG. 8) or can be arranged internally of the volume 3 behind the tab 8 inserting portion 10.

In case the removable portion 15 is located between the store 2 lateral wall 4 and the tab 8 inserting portion 10, the projection 25, under the device 7 first closed condition and before the container 1 first open condition, emerges from the free edge 6 between the tab 8 and the store lateral wall 4 directly facing the inserting portion 10. Viceversa, in case the removable portion 15 should remain behind the inserting portion 10, the projection 25 is configured for being arranged internally of the tab 8 through opening 26; preferably, under such condition, the projection 25 passes through at least partially the through opening 26 and then emerges from the store 2 free edge 6 and possibly also from the tab 8 closing portion 9 (FIG. 31).

As hereinbefore described, the store 2 can further comprise a recess 27—preferably carried by the lateral 4 parallel to the second coupling portion 14 of the safety device 12 and directly facing the inserting portion 10—able to substantially define a free edge 6 depression; the recess 27 enables to aid the projection 25 to emerge from the free edge 6 following the first closed condition and before the open condition. De facto, the recess 27 is able to enable both to visualize and give a tactile perception of the projection 25.

With reference instead to the control opening 24, it is useful to note—see FIGS. 1 and 2, for example—that the same is carried by the lateral wall 4 parallel to the safety device 12 second coupling portion 14; the control opening 24 is advantageously placed at the safety device 12 removable portion 15 and at the tab 8 inserting portion 10. More particularly, the control opening 24 is placed on the same lateral wall 4 carrying the recess 27: the control opening 24 is distinct and distanced from the recess 27 and particularly is placed below said opening 24. The control opening 24 is configured to enable visualising the removable portion 15, particularly the first surface 15*a*, before the container 1 first open condition (during the container 1 first closed condition); the control opening 24 is further configured to enable visualising the inserting portion 10, particularly the first surface 10*a*, following the container 1 first open condition for giving a visual evidence of a container 1 tampering. In a preferred but non limiting embodiment of the invention, the control opening 24 is configured to enable visualising, from the outside, the removable portion 15 and/or to enable visualising the correct engagement (arming) of the safety device 12 and particularly the correct insertion/engagement of the first portion 13 with the second portion 14 and therefore the correct arming of the device 12.

Figure 9:
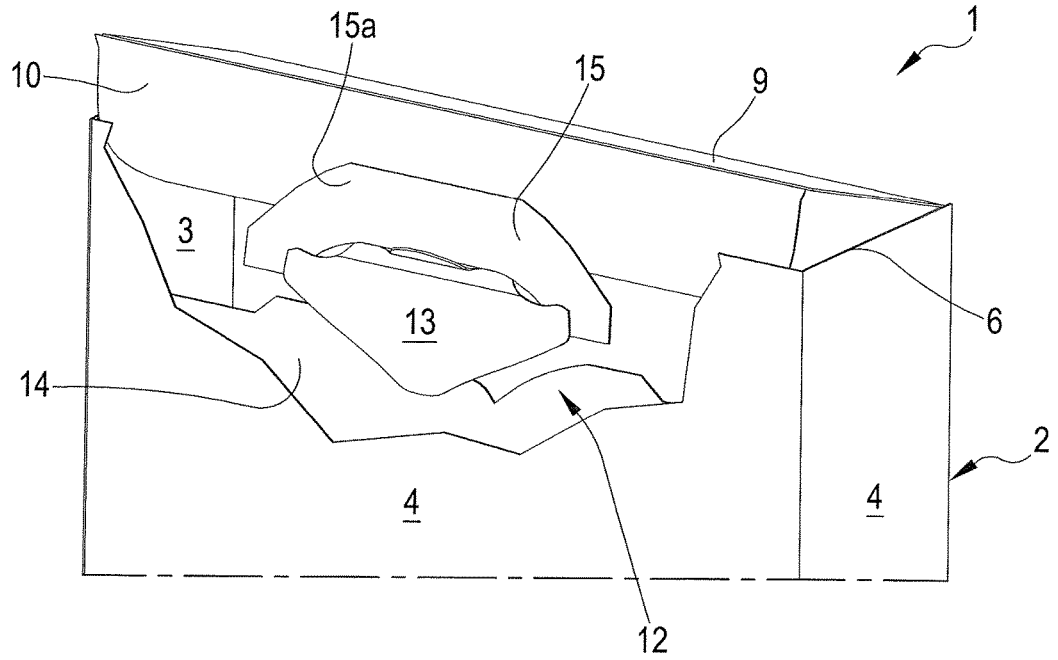

As hereinbefore described, the safety device 12 is further configured for giving evidence of a tampering; particularly, engaging the removable portion 15 with the first coupling portion 13 defines a stable engagement between the store 2 and closure system 7 which resists the container 1 opening—the user, at the first opening, notices a substantial resistance to the container opening—for giving a proof that this latter has not been already opened. The safety device 12, during the first open condition, is configured for enabling to separate the first removable portion 15 and therefore the projection 25, from the second coupling portion 14. The first open condition is for example illustrated in FIG. 9: during the system 7 first open condition, the first coupling portion 13 grips the removable portion 15 (a grip between the hooks 18 and 22) and tears it from the second portion 14.

Figure 10:
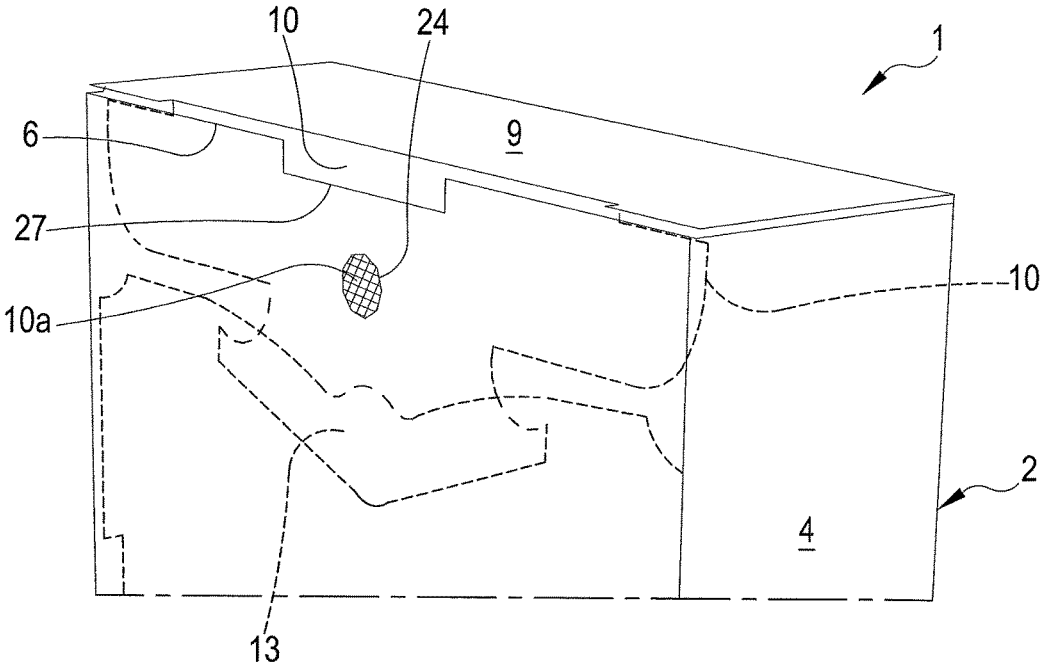
FIG. 10 is a perspective view of a container according to the present invention arranged in a closed condition following a first open condition.

Following the first open condition, the device 12 is capable of providing evidence of a tampering because the system 7 opening is easier: the user does not perceive, during the opening, a resistance on the inserting portion 10 (see FIGS. 10 and 22, wherein it is evident the absence of the removable portion 15). Further, following the first open condition, the control opening 24 enables visualizing the inserting portion 10 instead of the removable portion 15 (alternatively, it enables visualizing the store 2 internal volume): under such condition, the user can easily realize that the container 1 has been tampered without providing to open the same. Advantageously, it is possible to differentiate the surfaces 15*a* and 10*a* respectively of the removable portion 15 and inserting portion 10 in order to make easier to acknowledge said surface and intensify the evidence of a tampering. For example, it is possible to provide two different colors of the surfaces 15*a* and 10*a*: in such way the user can detect the container 1 tampering just by recognizing the color of the inserting portion 10 rather than on the removable portion 15. Besides the possibility of visually checking the container 1 tampering, the same can give a proof of a first opening by means of a missed tactile perception of the projection 25: in this way also sight-impaired people can check that has been performed a tampering.

As hereinbefore described, the projection 25 is configured for emerging from the store 2 free edge 6 (or also just from the recess 27 and/or through opening 26). Under the container 1 first closed condition and before the first open step, the projection 25 is carried by the removable portion 15 which is also arranged internally of the store: under such condition, the projection emerges from the free edge 6 and is easily tactilely perceivable.

Figure 33:
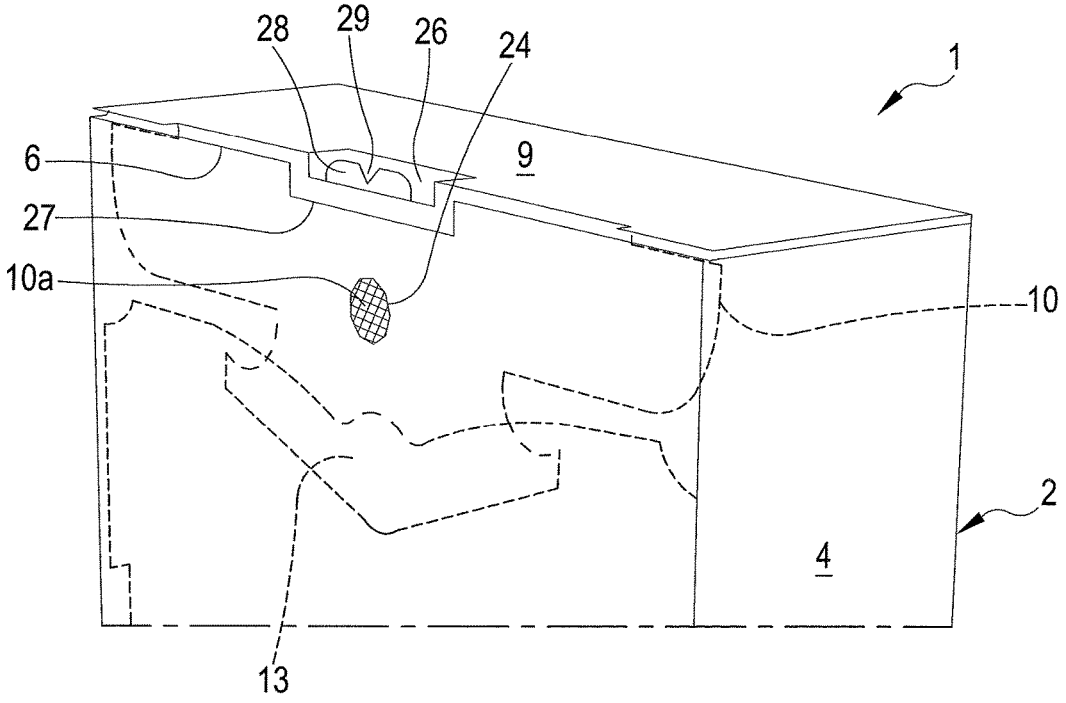
FIG. 33 is a perspective view of a container according to the present invention arranged in a closed condition after a first open condition.
Figure 35:
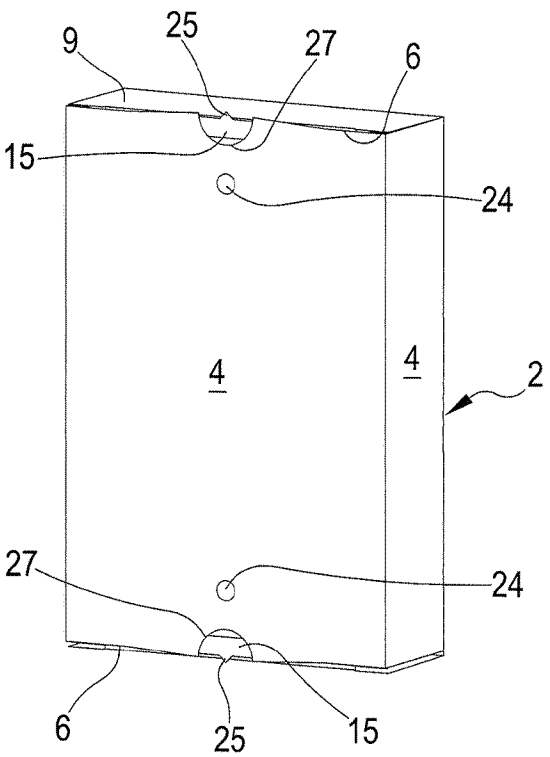
FIG. 35 is a further perspective view of a container according to the present invention arranged in a first closed condition, before a first open condition.
Figure 34:
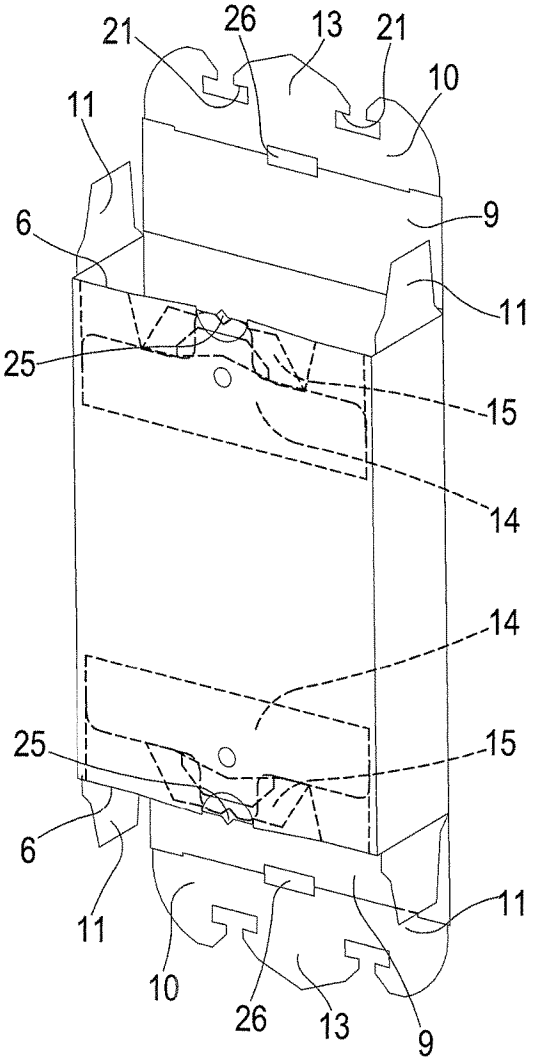
FIG. 34 is a further perspective view of a container according to the present invention, before a first closed condition.

Following the first opening of the container 1, the removable portion 15 separates from the store 2 (more generally from the container 1) and with it also the projection 25 which is no more tactilely perceivable. The absence of the projection 25 can immediately give a proof that the container has been tampered also without a visual proof. FIGS. 31 and 33 illustrate a further embodiment of the safety device 12, which comprises a control portion 28 of sheet material directly carried by the store 2 and/or closure system 7; the control portion 28 is configured to place, following the system 7 first closure and before the container 1 first open condition, behind the inserting portion 10 so that the same is interposed between said control portion 28 and the store 2 lateral wall 4 directly abutting on the inserting portion 10. Under such condition, the control portion 28 is entirely contained in the store 2 and directly covered by the removable portion 15. Specifically, the control portion 28 is configured to place immediately behind the projection 25 and immediately behind the projection portion emerging from the free edge 6. De facto, the control portion 28 top is configured for remaining inside the volume 3 at the store free edge 6. On the top of the control portion 28, the same has a cavity 29 contactable from the outside via the though opening 26. More specifically, the cavity 29 defines an open outline exhibiting a concavity facing the tab closing portion 9, in other words oppositely the internal volume 3. Still more particularly, the open outline of the control portion 28 cavity 29 defines an outline selected in the group among: a "U, a "V", a "C"" outline.

The control portion 28 is configured to place, following the container 1 first open condition, behind the inserting portion 10 so that the same is interposed between said control portion 28 and the store 2 lateral wall 4 abutting on the inserting portion 10; under such condition, the control portion 28 is entirely contained in the store and faces the through opening 26 of the closure system 7: without the projection 25, the control portion 28 cavity is contactable from the outside via the through opening 26 and is tactilely perceivable for confirming the absence of the removable portion 15 and for giving therefore evidence of the container 1 tampering. De facto, the tactile perception of the cavity 29 through the opening 26 can confirm the absence of the projection 25 and particularly of the removable portion 15 and can therefore give evidence of the container 1 tampering.

In the embodiment illustrated in the attached figures, the control portion 28 is carried, in a non limiting way, directly by the store 2 and comprises a sheet lying parallelly to the second coupling portion 14; particularly, the control portion 28 is, in a non limiting way, integrally joined and parallel to the second coupling portion 14 of the safety device 12.

In a preferred, but non limiting way, embodiment of the invention, the device 12 (portions 13, 14 and 15) is at least partially, particularly completely, made of paper sheet material (paper or paperboard); the used sheet material exhibits a grammage comprised between 100 and 500 gr/m$^2$, particularly comprised between 200 and 400 gr/m$^2$. Optionally, the paper sheet material used for making the device 12 is as the sheet material used for making the store 2 and the closure system 7, particularly they are all obtained from only one paper material sheet. As hereinbefore described, the container 1 can also be used for housing pharmaceutical, cosmetic and food products. Under such condition, it can be advantageous covering an internal surface of the device 12 by a plastic material coating, for example a film. The coating has the object of defining a barrier interposed between the device 1 and products; the coating is further able to define a water and/or humidity barrier useful for avoiding the weakening and the structurality loss with a consequent warping of the paper material forming the device 12. Advantageously, the coating could be an extrusion coating on one side (the device 12 internal side) or on both sides (the device 12 internal and external surfaces) of the paper material defining the safety device having values which can for example vary between 10 and 50 gr/m$^2$ of the coating material (in other words the polyethylene). The coating plastic material can be for example selected among the following materials: LDPE, HDPE, PP, PE.

It is useful to specify that, since the above described solution represents a preferred but non limiting configuration of the container 1. Indeed, the removable portion 15 could equally form at least part of the first and/or second coupling portions 13, 14. For example, the removable portion 15 could define the respective undercut 20 and therefore the hook 22 of the first coupling portion 13; in such case, during the first container opening, the removable portion 15 would be configured for separating from the first portion 13. As hereinbefore described, it is not excluded the possibility of defining at least one removable portion 15 on the first coupling portion 13 and at least one removable portion on the second coupling portion 14.

In a further embodiment non illustrated in the attached figures, the safety device 12 comprises a sheet material tab at least partially made of paper and/of plastic material: the tab is outwardly engageable with the container 1 following the first closed condition of this latter and particularly of the system 7. Still referring to the container 1 first closed condition and before the first open condition of the same, the tab comprises at least one first constrain portion stably engaged with the tab 8 closing portion 9, at least a second constrain portion stably engaged with the store lateral wall and particularly with the wall which, under the system 7 closed condition, directly faces and abuts on the inserting portion 10. Advantageously, the first and second constrain portions are stably glued outside the container 1.

Further, the tab comprises at least one removable portion 15 removably engaged, on one side, with the first constrain portion and, on the opposite side, with the tab second constrain portion. The tab outwardly engaging the container 1, defines a "L" outline and at least one tactilely perceivable projection 25 emerging from the store 2 and/or from the closure system 7. The projection 25 can for example emerge transversally, particularly normal, from the closing portion 9 and exhibit one of the hereinbefore described shapes (for example, triangular, square, rectangular, semicircular). The tab removable portion 15, following the first closed condition and before the container 1 first open condition, is placed and covers at least part of the closure system 7 inserting portion 10.

The removable portion 15, together with the projection 25, is only engaged with said first and second constrain portions by weakening lines which form the tab weakened pre-notched portions. In other words, the removable portion 15 (together with the projection) is not directly constrained to the container 1 but is directly engaged only with the first and second constrain portions.

The removable portion 15, together with the projection 25, is configured for separating from the first and second constrain portions following a closure system 7 first open condition after said first closed condition for providing evidence of a container 1 tampering.

More particularly, during the first open condition of the container 1 and therefore of the system 7, the constrain portions are configured for remaining engaged (glued) with the store 2 and closing portion 9; the removable portion 15 is not directly constrained to the store 2 and system 7: the weakening lines present on the tab around the removable portion 15 cause the breakage of the tab and the separation of said removable portion 15 from the respective constrain portions. As hereinbefore described, the removable portion 15 carries the projection 25 which, separating from the tab, is no more tactilely perceivable. Following the container first opening, the tab can therefore give evidence of a tampering by the absence of the removable portion 25 and therefore of the projection 25.

Process for Making a Tamper-Evident Container

Further, it is an object of the present invention a process for making a tamper-evident container 1. First of all, the process provides to predispose the store 2 which, as hereinbefore described, is made of sheet material, optionally paper. Particularly, such step provides to predispose at least one first sheet 51 comprising at least one first and one second portions 52, 54 interconnected by a central connecting portion 53. The first sheet 51 further comprises at least one first and one second lateral connecting portions 55, 56. As it is visible for example in FIGS. 11, 12, 16, 18, 36-38, the central connecting portion 53 is interposed between the first and the second portions 52, 54, the first portion 52 is interposed between the first lateral connecting portion 55 and the central connecting portion 53 while the second portion 54 is interposed between the second lateral connecting portion 56 and the central connecting portion 53. Each of said portions 52, 53, 54, 55, 56 comprises at least two longitudinal opposite edges and two end opposite edges: the portions 52, 54, the central connecting portion 53 and said lateral connecting portions 55, 56 are joined along the longitudinal edges and aligned along only one connecting direction.

In a preferred but non limiting configuration of the invention, the first portion 52 of the first sheet 51 exhibits a rectangular shape perimetrally delimited by a lower edge 52*a*, a first and second lateral edges 52*b*, 52*c* and an upper edge 52*d*. Analogously, the second portion 54 of the first sheet 51 has a rectangular shape perimetrally delimited by a lower edge 54*a*, a first and second lateral edges 54*b*, 54*c* and an upper edge 54*d*. Advantageously, the first and second portions 52, 54 comprise a sheet having substantially the same shape and size. The central portion 53 and lateral connecting portions 55, 56 exhibit also rectangular shapes; such portions substantially exhibit the same shape and/or size and are integrally joined to the portions 52 and 54 of the first sheet at the lateral edges.

The step of predisposing the store 2 provides a step of folding the first sheet 51 at the lateral edges of the portions 52 and 54. The steps of forming the store 2 are schematically illustrated in FIGS. 12-15, 39, 40 and initially provide to fold a lateral connecting portion, for example the portion 55, with respect to the first portion 52 and on approach to the second portion 54 (FIGS. 12 and 40): for example, it is possible to provide to fold the longitudinal connecting portion 55 so that this latter can define, in cooperation with the portion 52, a substantially "L" shape. Then, the process provides, for example, to fold the central portion 53 with respect to the first portion 52 and on approach to the portion 55 that was already folded (see FIG. 13, for example): for example it is possible to provide to fold the central portion 53 so that this latter can define, in cooperation with the portion 52, a substantially "L" shape. Successively, it is for example possible to provide to fold the second portion 54 with respect to the central portion 53 and on approach to the first portion 52 (see FIG. 14, for example): for example, it is possible to provide to fold the second central portion 54 so that this latter can define, in cooperation with the central portion 53, a substantially "L" shape. For completely forming the store 2, the process provides to fold the remaining longitudinal connecting portion, for example, the portion 56, with respect to the second portion 54 so that it is possible to join said lateral connecting portions 55, 56. For holding the store 2 in the folded three-dimensional shape, the process can provide, in a non limiting way, to apply a predetermined quantity of glue 72 (FIG. 15) only the longitudinal connecting portions 55, 56 able to abut on each other: joining said portions enables to lock the store 2 in the folded configuration.

It is useful to specify that the step of predisposing the first sheet 51 can provide a packing step which enables to define, on the same sheet, folding lines coinciding with the longitudinal lateral edges of the portions of said first sheet 5. De facto, the steps of folding the first sheet portions are performed just along the longitudinal lateral edges of said portions which are packed in order to make easier the movement (folding) thereof.

The step of predisposing the first sheet 51 further provides at least a step of forming on the same 51 at least one through notch 69 placed on the first and/or second portions 52, 54 and which is configured for defining said control opening 24. The notch 69 is substantially executed at the lower and/or upper edges of at least one of said portions 52, 54. Further, the step of predisposing the first sheet 51 provides at least one step of forming on the same 51 at least a through groove 75 (see FIGS. 36-38, for example), placed on the first and/or second portions 52, 54 which is configured for defining the recess 27. The groove 75 is substantially obtained at the lower and/or upper edges of at least of said portions 52, 54. Advantageously but in a non limiting way, the groove 75 is obtained on the same sheet portion on which the notch 69 is defined and particularly above this latter. Specifically, the through groove 75 is defined at least on a transversal edge of the first or second portion 52, 54 of the first sheet 51; in FIGS. 36-38 the groove 75 is defined at the transversal edges of the second portion 54. The through groove 75 defines an open outline having a substantially "C" shape (FIG. 37), or a "U" shape (FIG. 36), or a "V" shape. Advantageously, the first sheet 51 is entirely made of paper material, exhibiting a grammage comprised between 100 and 500 gr/m$^2$, particularly comprised between 300 and 400 gr/m$^2$.

Figure 23:
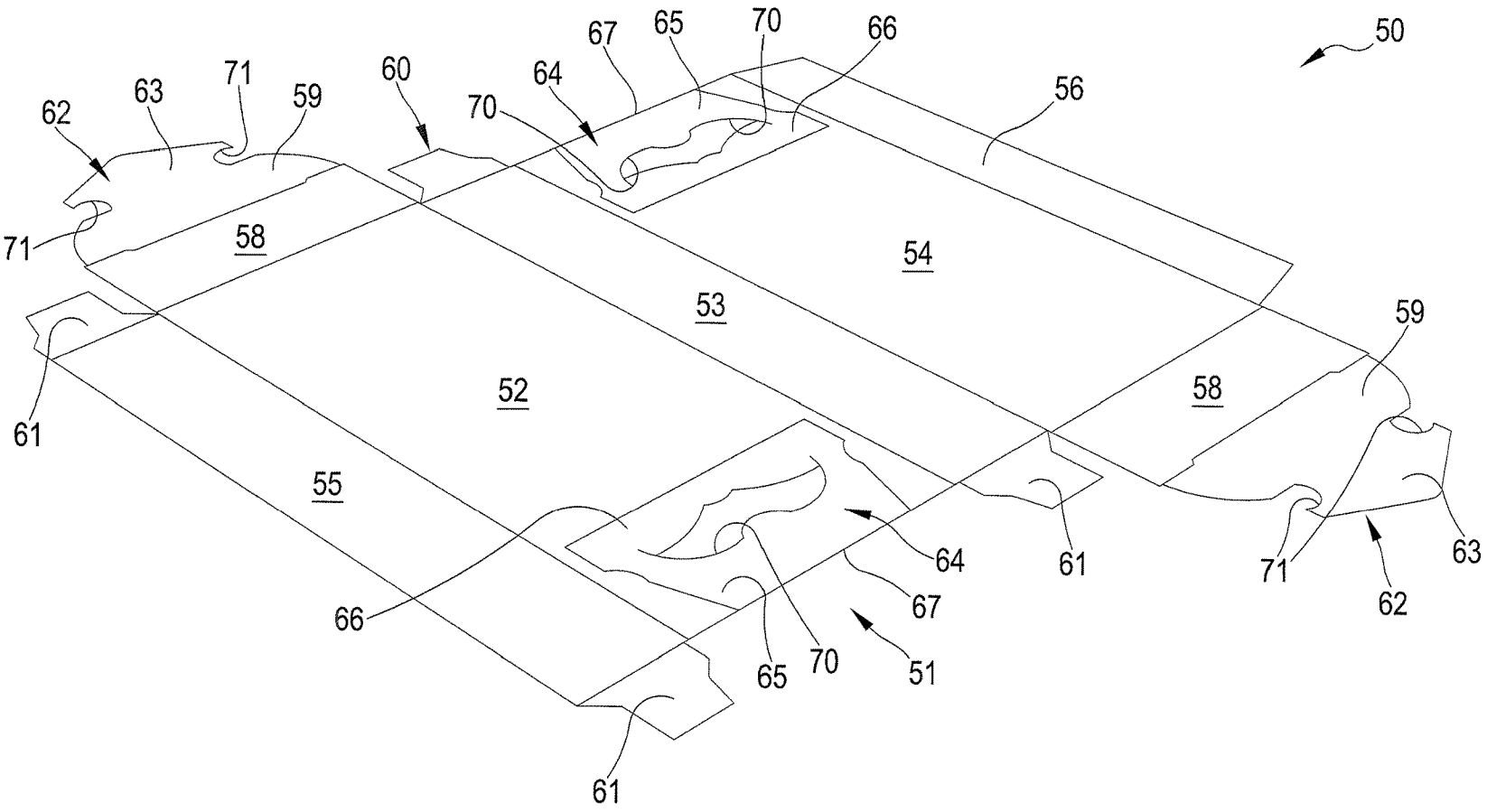
FIG. 23 is a top view of a fourth embodiment of a blank for making a container according to the present invention.
Figure 36:
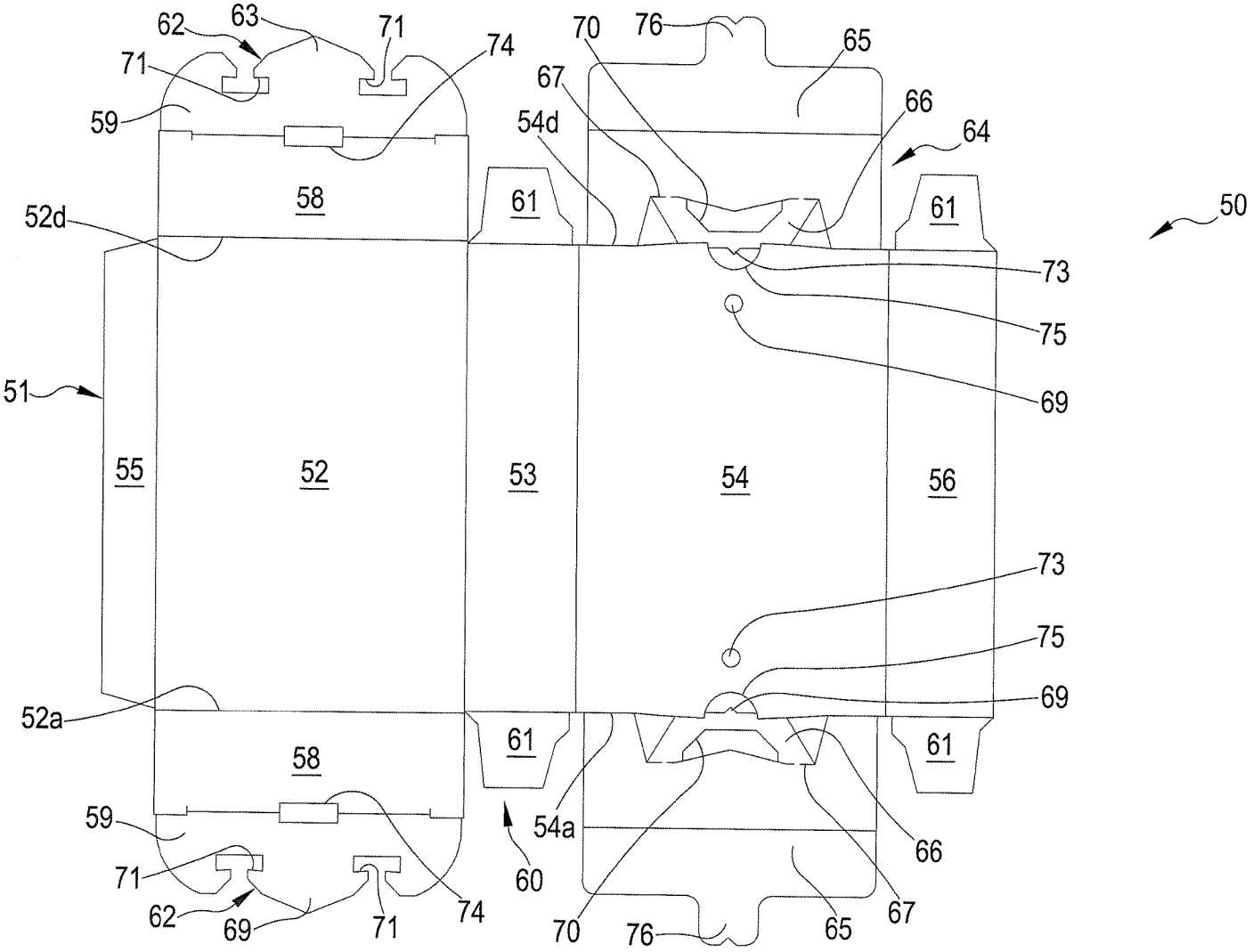
FIGS. 36 to 38 represent respectively a fifth, sixth and seventh embodiments of a blank for making a container according to the present invention.
Figure 37:
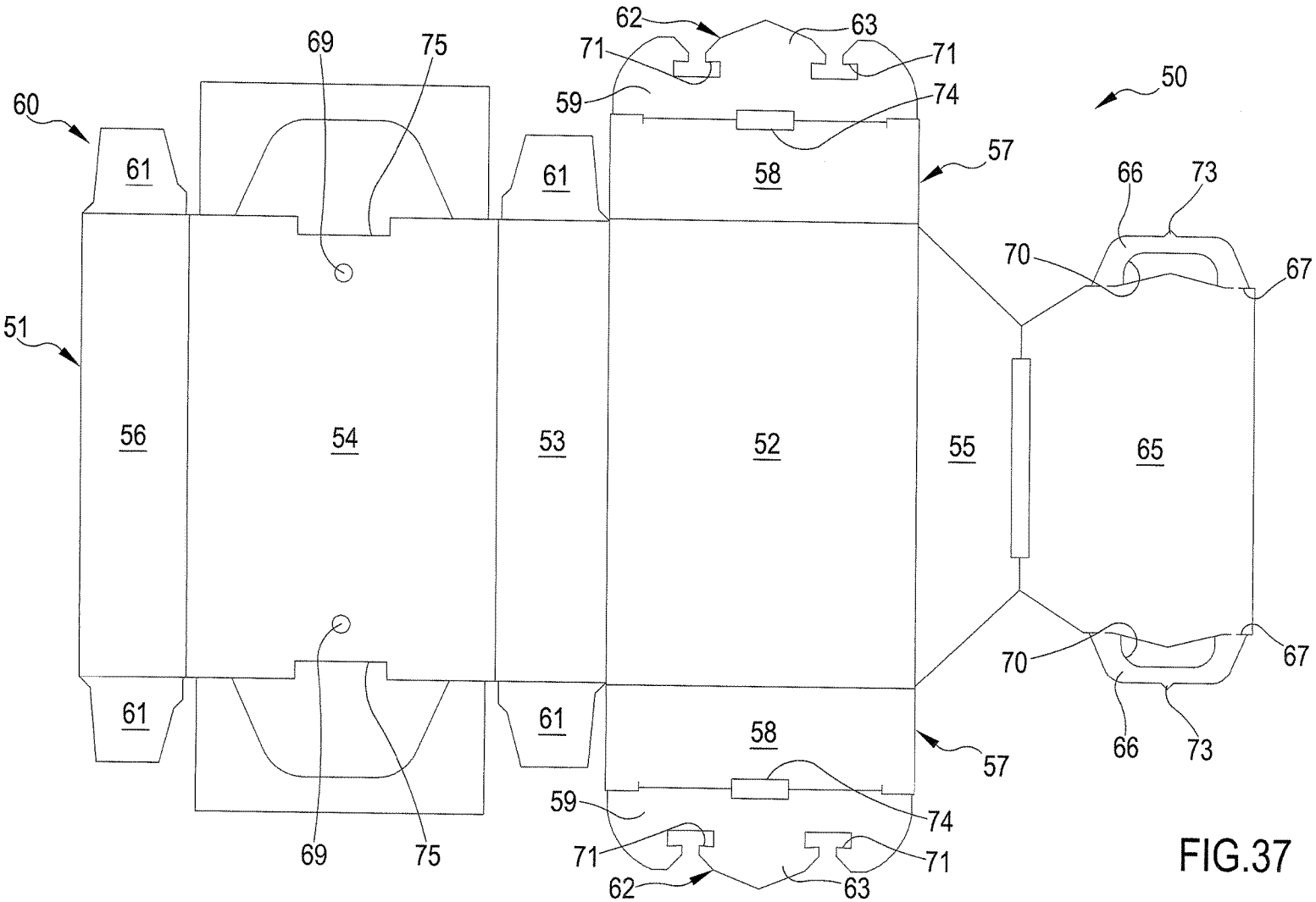
Figure 38:
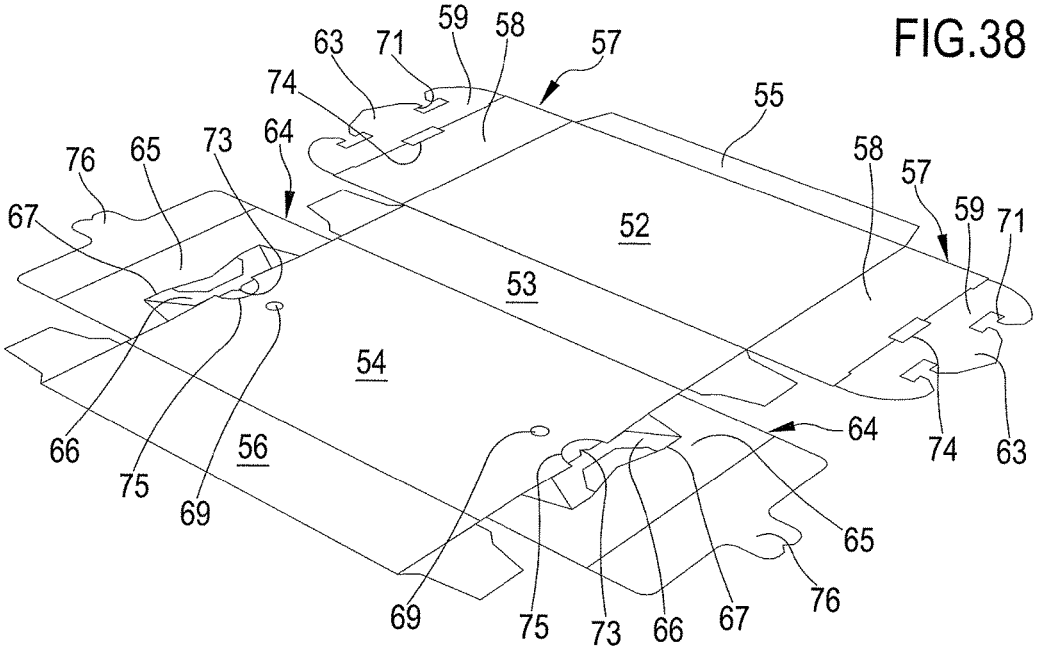
Figure 39:
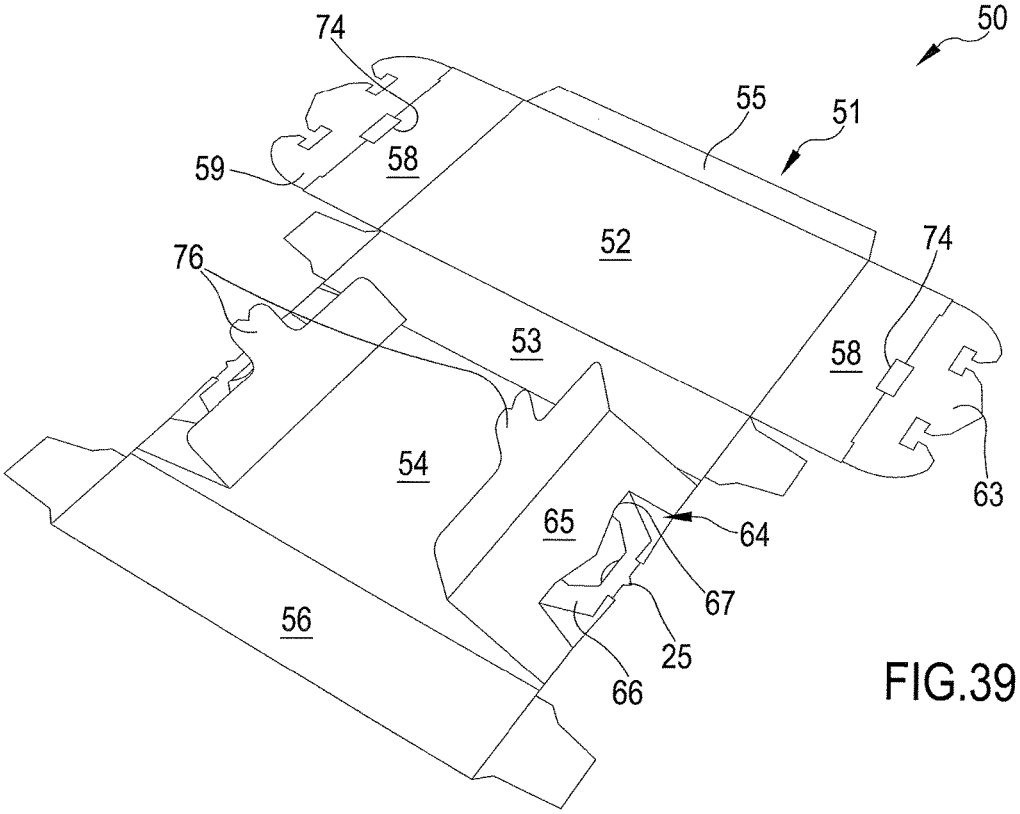
FIGS. 39 and 40 are schemes regarding possible steps of folding the blank of FIG. 38 for making a container according to the present invention.
Figure 40:
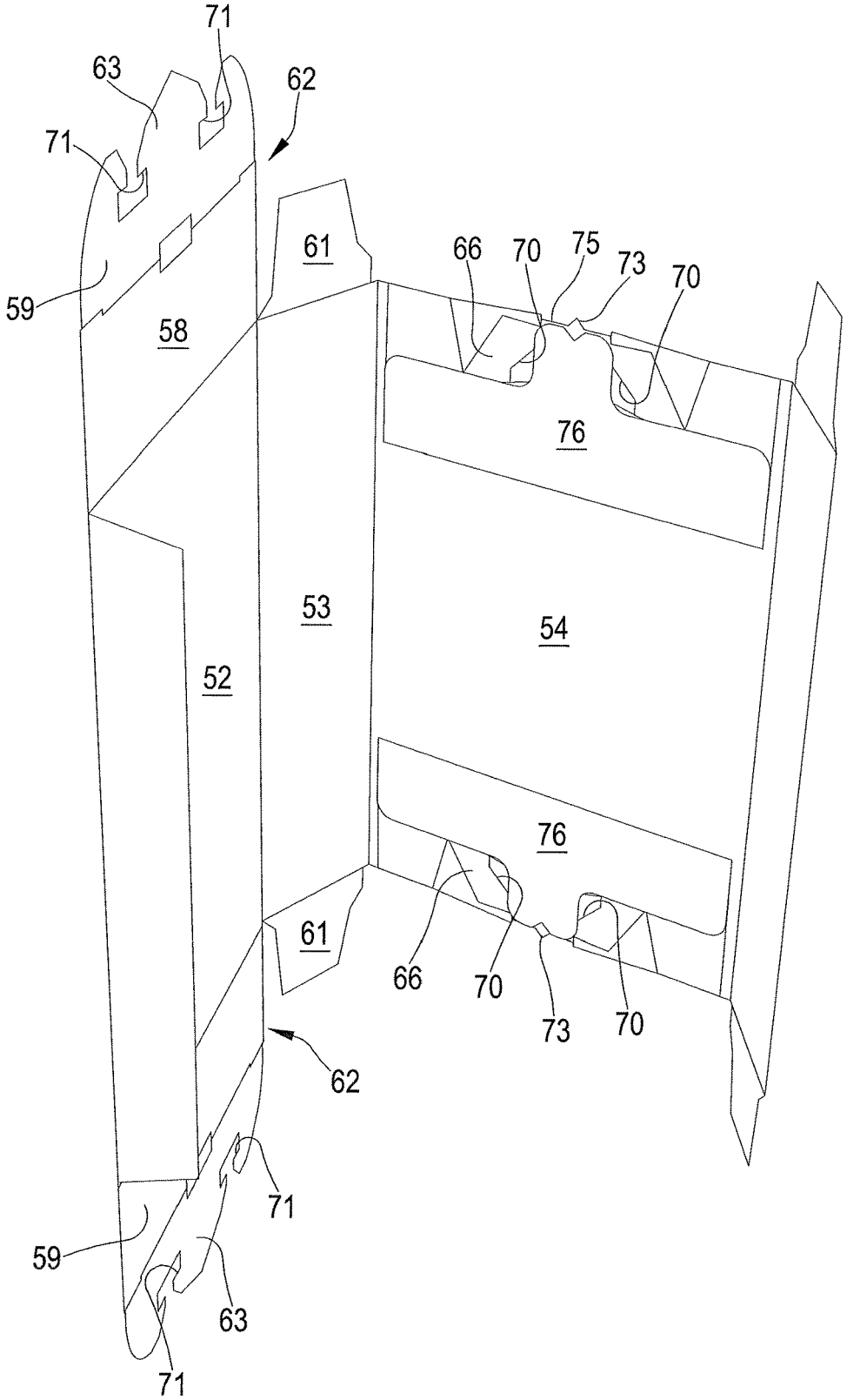

Further, the process provides to predispose the closure system 7. Such step provides to predispose at least one second sheet 57, advantageously, integrally joined to the first sheet 51, particularly at an end edge of the first and/or second portions 52, 54 of the first sheet 51 (FIGS. 11, 36-38). The second sheet 57 comprises at least one first and one second portions 58, 59 integrally joined to each other: the first portion 58 of the second sheet 57 is connected to the first sheet 51 so that said first portion 58 is interposed between the second portion 59 of the second sheet 57 and the first sheet 51. The attached figures illustrate a preferred but non limiting configuration of the invention wherein it is provided to predispose two second sheets 57 engaged with the first sheet 51 and placed opposite to this latter. The second sheet 57 is for example directly connected to the upper edge 52*d* and/or lower edge 52*a* of the portion 52 of the first sheet 51. FIGS. 11, 16, 18 and 36 illustrate, in a non limiting way, an embodiment wherein it is provided to form the two sheets 57 respectively on the lower 52*a* and upper edges 52*d* of the portion 52. FIGS. 23 and 36 illustrate an alternative embodiment wherein a second sheet 57 is directly connected to the upper edge 52*d* of the portion 52 while a second sheet 57 is directly connected to the lower edge 54*a* of the second portion 54. Advantageously, the second sheet 57 is integrally joined to the first sheet to define only one sheet; particularly, also the second sheet 57 is made of paper material, particularly of a paper material sheet having substantially the same characteristics as the first sheet 51.

The step of predisposing the second sheet 57 can further provide at least one step of forming on the same a through notch 74 (FIGS. 36-38) which is able to define the through opening 26 of the closure system 7. The through notch 74 can be defined on the first and/or second portions 58, 59 of the second sheet 57; in a preferred but non limiting embodiment of the invention, the notch 74 is partially defined on the first and partially on the second portions 58, 59 of the second sheet 57 without interruptions to define a single closed outline notch. Still more specifically, the through notch 74 defines a closed perimetral outline exhibiting at least one shape selected in the group of the following shapes: square, rectangular, diamond, circular, elliptical, semicircular, triangular. The attached figures illustrate a non limiting embodiment of the invention wherein the notch exhibits a rectangular shape. Advantageously, the second sheet 57 exhibits a grammage between 100 and 500 gr/m$^2$, particularly comprised between 300 and 400 gr/m$^2$.

Further, the process provides the steps of folding the first and second portions 58, 59 of the second sheet 57 for forming respectively the closing portion 9 and inserting portion 10 of the closure system 7. The step of predisposing the closure system 7 further provides a sub-step of predisposing at least one third sheet 60 exhibiting at least one portion 61 connected at least to one central and/or lateral connecting portions of the first sheet 51 and emerging from this latter from the same side from which the second sheet 57 emerges. Advantageously, the third sheet provides four portions 61 integrally joined to the first sheet 51. Two portions 61 are connected to the central portion 53 and emerge from this latter opposite to each other along respective end edges (emerging from the first sheet 51 from the same side from which the second sheet 57 emerges).

Figure 11:
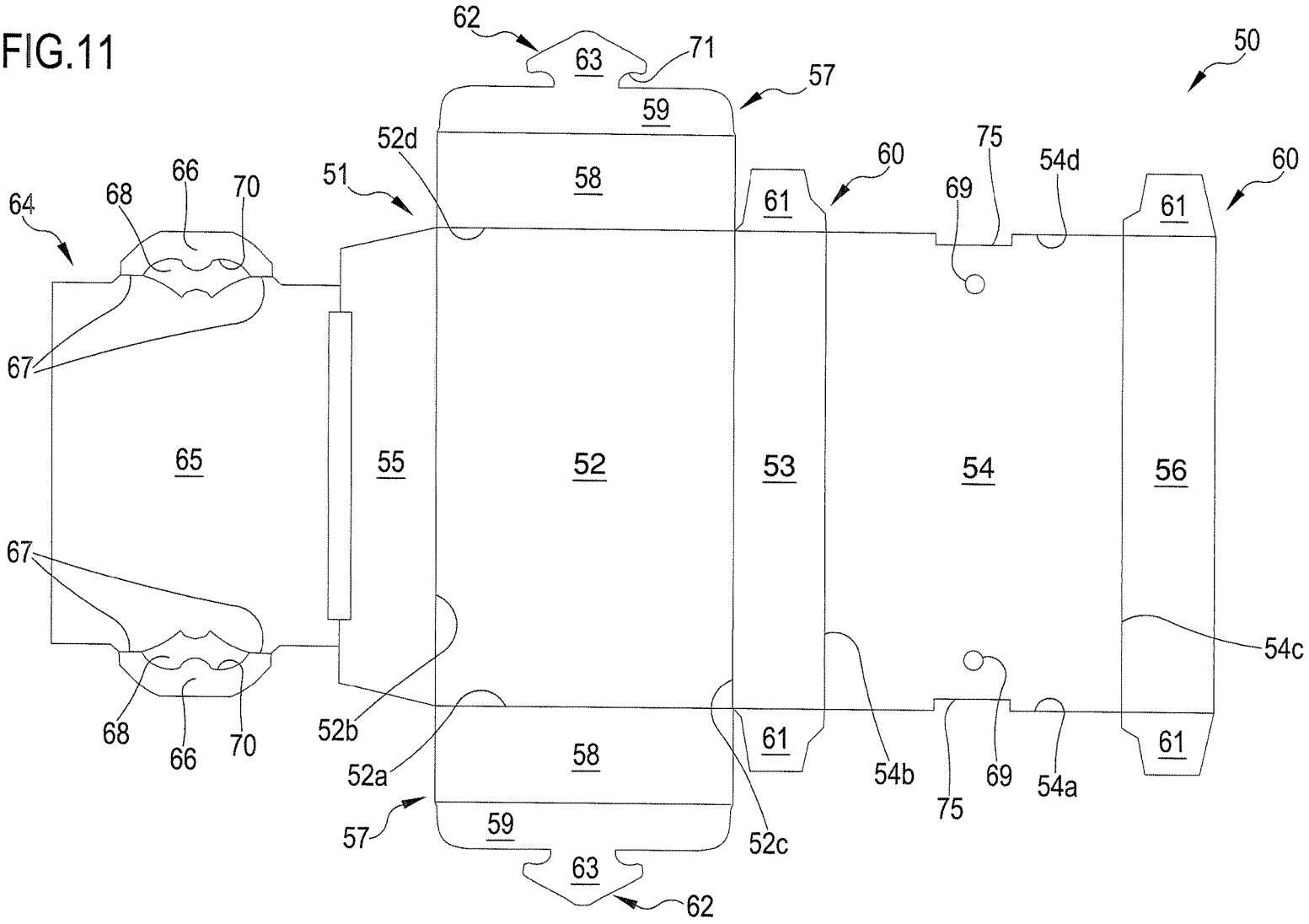
FIG. 11 is a top view of a first embodiment of a blank for making a container according to the present invention, FIGS. 12 to 15 schematically illustrate the steps of folding the blank of FIG. 11 for making a container according to the present invention.
Figure 12:
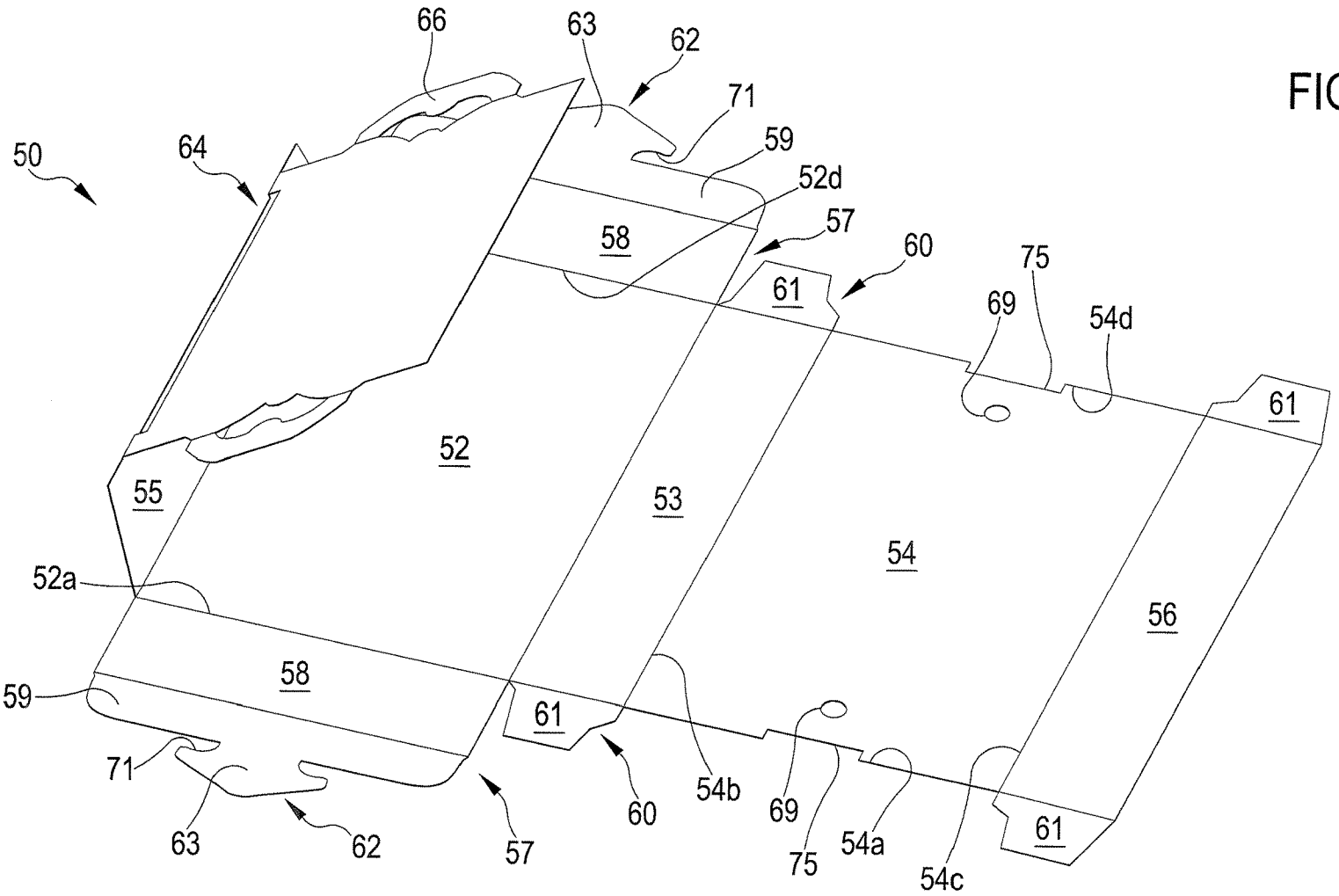
Figure 15:
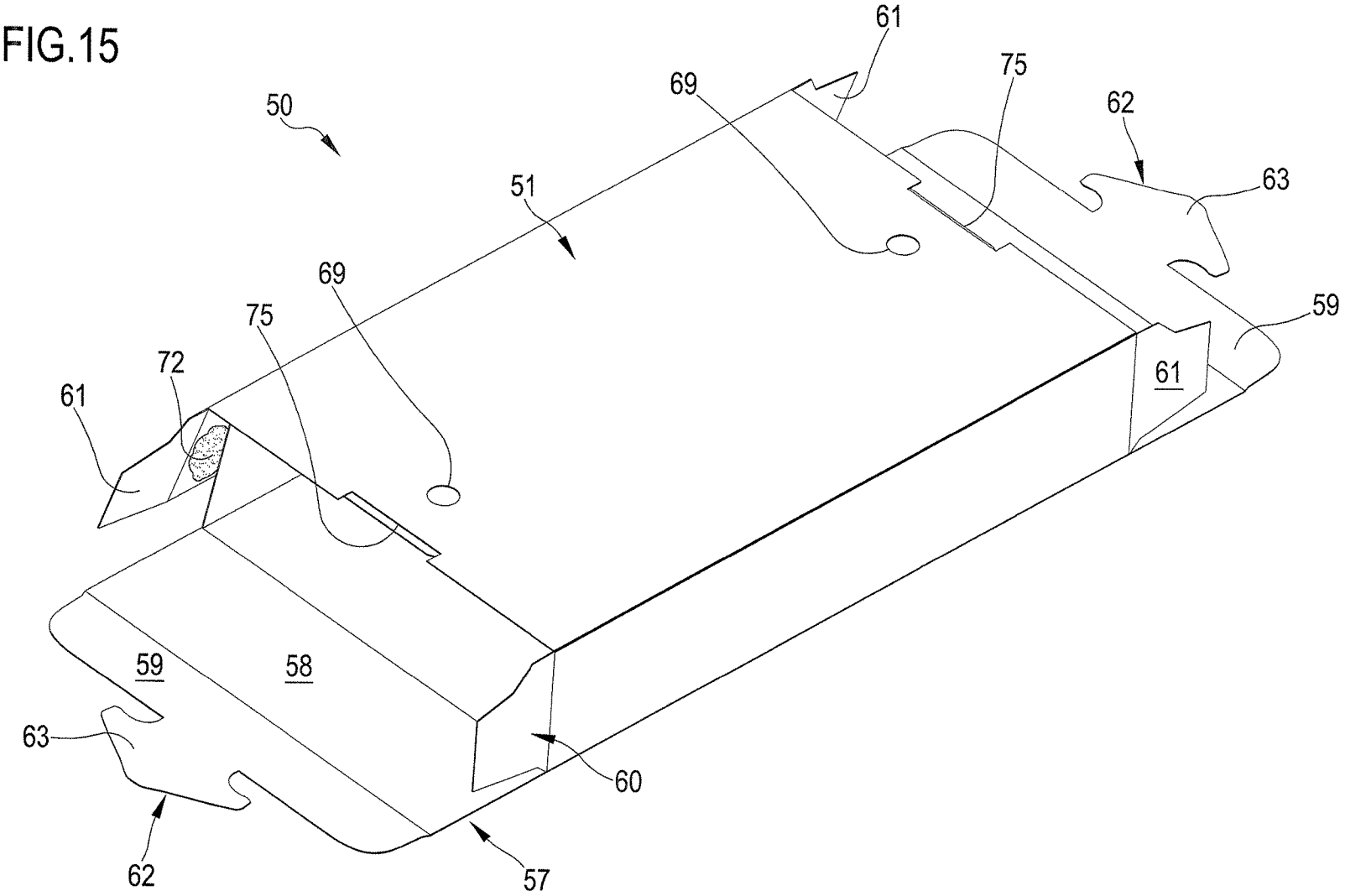

Two further portions 61 are connected to the longitudinal connecting portion 55 or 56 (FIG. 11 illustrates, in a non limiting way, a configuration where the further two portions 61 are carried by the portion 56) and emerging from this latter opposite to each other along respective end edges (emerging from the first sheet 51 from the same side from which the second sheet 57 emerges). Each portion 61 is made of a flat sheet material, particularly a paper sheet material, and exhibits a substantially square or trapezoidal shape. Advantageously, also the third sheet 60 is made of paper material, particularly a paper material sheet, having substantially the same characteristics as the first and second sheets 51, 57. Advantageously, the third sheet 60 exhibits a grammage between 100 and 500 gr/m$^2$, particularly comprised between 300 and 400 gr/m$^2$. Further, the process comprises the step of folding the third sheet 60 portion 61 towards the store internal volume to form the container 1 abutting portion 11.

Advantageously, first of all the process provides to fold the first sheet 51 to define the store 2; then the third sheet 60 is folded to define the abutting portion 11. Following or simultaneously with the third sheet 60 folding, the second sheet 57 is folded to define said closure 9 and inserting portions 10.

Further, the process provides to predispose the safety device 12 which provides at least the sub-step of predisposing a fourth sheet 62 comprising at least one portion 63 integrally joined to the second portion 59 of the second sheet 57 and/or to the portion 61 of the third sheet 60. The fourth sheet 62 portion 63 is also made of sheet material, particularly of paper sheet material, and longitudinally emerges from the second and/or third sheets 57, 60 opposite to the first sheet 51: the fourth sheet 62 portion 63 is configured for defining the container 1 first coupling portion 13. The attached figures illustrate, in a non limiting way, a configuration of the fourth sheet 62 which is directly connected (emerging away from) to the second portion 59 of the second sheet 57. However, it is not excluded the possibility of forming a fourth sheet 62 emerging from the third sheet 60 away from the first sheet 51 (this configuration is not illustrated in the attached figures).

More specifically, the step of forming the portion 63 of the fourth sheet 62 provides at least the following sub-steps:

- forming, as a prolongation to the second portion 59 of the second sheet 57, a flat sheet substantially parallel to the second sheet 57, the prolonging sheet emerges from the second portion 59 opposite to the first portion 59 of the second sheet 57;
- forming at least one undercut 71 able to define the first coupling portion 13 of the container 1.

The undercut 71 substantially defines on the fourth sheet, a seat configured for defining the undercut 20 of the first coupling portion 13. Advantageously, the step of forming the prolongation provides to form at least two undercuts 71 opposite to each other with respect to the fourth sheet 62 itself and which are configured for defining the respective undercuts 20 of the first coupling portion 13. As described hereinbefore, also the fourth sheet 62 is made of paper material, particularly of a paper material sheet, having substantially the same characteristics as the first, second and third sheets 51, 57, 60. Advantageously, the fourth sheet 62 exhibits a grammage comprised between 100 and 500 gr/m$^2$, particularly comprised between 300 and 400 gr/m$^2$.

The step of predisposing the safety device 12 further provides at least the sub-step of predisposing a fifth sheet 64 comprising at least a portion 65 integrally joined to the first sheet 51. In a non limiting configuration of the invention, illustrated in FIGS. 11, 18 and 37, the fifth sheet 64 emerges laterally from the first sheet 51 beside the portion 55: this latter portion is interposed between the fifth sheet 64 and the first sheet 51 portion 52. In such a configuration, the process, during the step of forming the store 2, provides to fold the portion 65 of the fifth sheet 64, to define said second coupling portion 14, immediately after the longitudinal portion 55 folding: in such way, after having folded the portions 53, 54 and 56, the fifth sheet 64 is positioned inside the store 2. A further configuration is for example illustrated in FIG. 23, in which the fifth sheet 64 is connected to and emerges away from the first portion 52 of the first sheet 51 and/or from the second portion 54 of the first sheet 51. In such configuration, the step of folding the portion 65 of the fifth sheet 64, to define said second coupling portion 14, can be performed before, during or after the step of forming the store 2. In both the configurations of the fifth sheet 64, following the step of folding the portion 65, this latter is configured to place in the store internal volume 3 to define said coupling portion 14.

The fifth sheet 64 portion 65 is also made of sheet material, particularly paper sheet material. More particularly, the step of forming the fifth sheet 64 portion 65 provides at least the following sub-steps:

forming, as a prolongation to the first sheet 51, a flat sheet substantially parallel to the second sheet 57;

forming on said sheet at least one undercut 70 adapted to define the second coupling portion 14 of the container 1.

Figure 16:
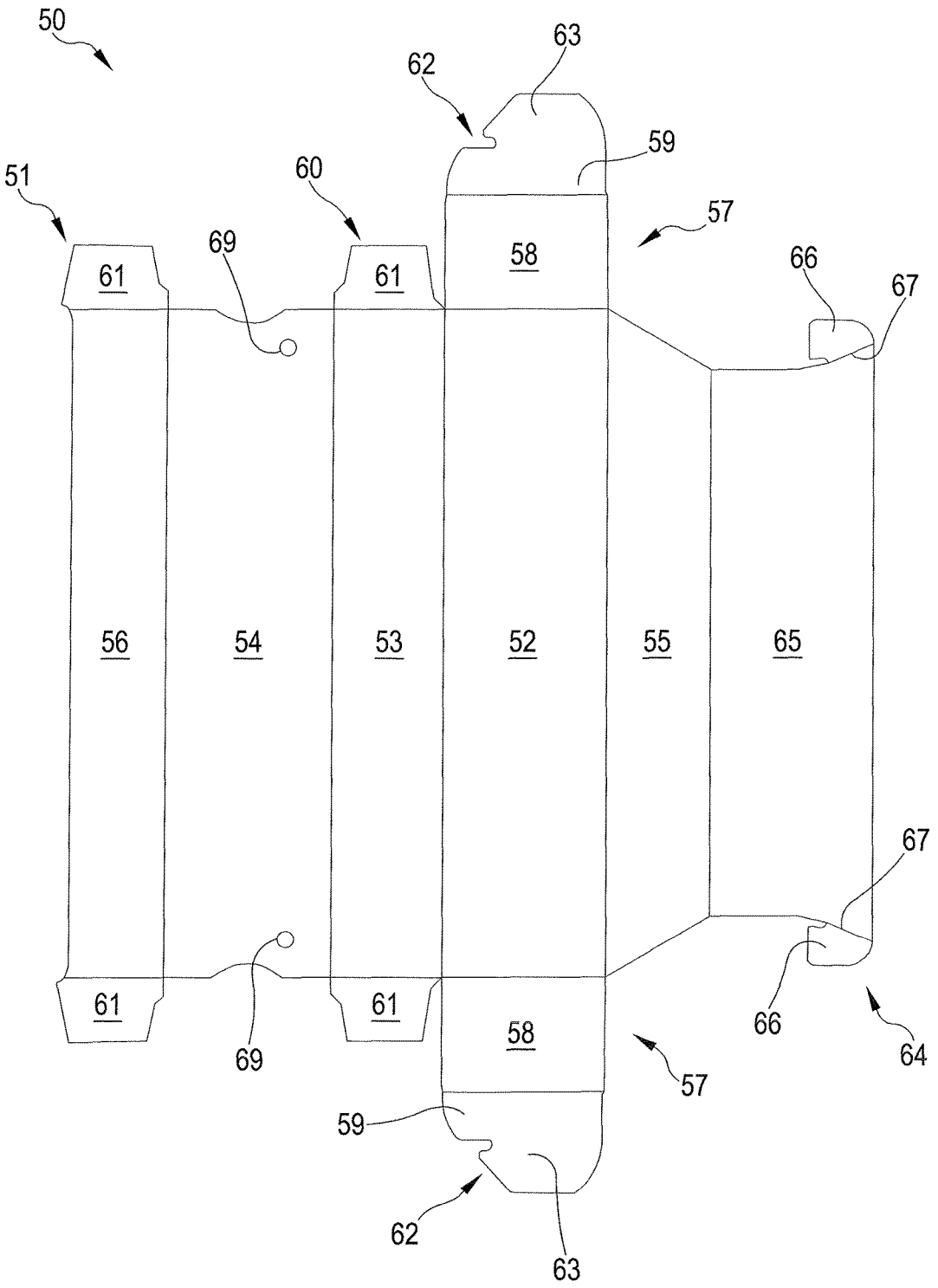
FIG. 16 is a top view of a second embodiment of a blank for making a container according to the present invention.

The undercut 70 substantially defines a seat (see for example FIG. 11) able to receive the undercut 71 of the fourth sheet 62; the undercut 70 is de facto configured for defining the undercut 16 of the second coupling portion 14. Advantageously, the step of forming the prolongation provides to form at least two undercuts 70 opposite to each other and which are configured for defining the respective undercuts 16 of the second coupling portion 14. As hereinbefore described, also the fifth sheet 64 is made of paper material, particularly a paper material sheet, having at least the same characteristics as the fourth sheet 62. Advantageously, the fifth sheet 64 exhibits a grammage comprised between 100 and 500 gr/m$^2$, particularly comprised between 300 and 400 gr/m$^2$. In a preferred but non limiting embodiment of the invention, the first, second, third, fourth and fifth sheets 51, 57, 60, 62, 64 are integrally joined to form a single blank sheet 50 (this condition is illustrated in FIGS. 11, 16, 23); the blank sheet 50 is at least partially, particularly entirely, made of paper sheet, optionally the blank sheet 50 exhibits a grammage comprised between 100 and 500 gr/m$^2$, particularly comprised between 300 and 400 gr/m$^2$.

The process further provides a step of forming, on the portions 63 and/or 65, respectively of the fourth and fifth sheets 62, 64, at least a further portion 66 integrally joined to said portion 63, 65 by a weakening line 67: the further portion 66 defines the undercut 70 and/or 71 and is configured for defining the container 1 removable portion 15. This step of forming the further portion 66 substantially provides a sub-step of packing and/or notching the fourth and/or fifth sheets 62, 64 for forming on this latter a weakening line 67 (see FIG. 11, for example) which is able to define a portion of the sheet separable (tearable) from the main body of the sheet. The attached figures illustrate a non limiting configuration of the invention, in which the further portion 66 is carried by the fourth sheet 62 so that, at the end of the packing and/or notching steps and the following sheets folding step, the removable portion 15 is carried by the second coupling portion 14 as illustrated in the attached figures showing the container 1. However, as hereinbefore described, the removable portion 15 can be carried by the first coupling portion 13 or by both the portions 13, 14. For defining the removable portion 15 on the coupling portion 13, the process should provide a step of packing and/or notching the fourth sheet 62 so that the further portion 66 could be defined (integrally joined to) on the portion 63 (this condition is not illustrated in the attached figures). The process provides to form the further portions 66 as many as the present second sheets 57 and therefore as many as the closure systems 7 provided on the container 1. FIGS. 11, 16, 23, 36-38 illustrate a preferred but non limiting configuration of the invention, in which there are two fourth sheets 62 respectively integrally joined to the two second sheets 57, in order to form first coupling portions 13; therefore there are at least two further portions 66 carried by a single fifth sheet 64 (FIGS. 11 and 16) or by two fifth distinct sheets 64 (FIG. 23): the portions 66 are configured for defining two removable portions 15 which are able to cooperate with the two respective first coupling portions 13 of the fourth sheet 62.

The step of predisposing the safety device 12 further provides a step of forming on the removable portion the tactilely perceivable projection 25 emerging from the store 2 and/or from the closure system 7: the removable portion 15, together with the projection 25, is configured for separating from the safety device 12 following a first open condition of the closure system 7 following said first closed condition for providing evidence of a container 1 tampering. More specifically, the step of predisposing the further portion 66 provides to form at least one bulge 73 emerging from the further portion 66—of the fourth and/or fifth sheets 62, 64—and placed oppositely with respect to the undercut 70 of the further portion itself. The bulge 73 is able to define the removable portion 15 projection 25: the removable portion projection 25, following the container 1 first closed condition, emerges from the store 2 free edge 6 and/or from the closure system 7 outside the internal volume 3. De facto, the bulge 73 is distanced from and opposite to the undercut 70 so that following the step of folding the fifth sheet inside the store 2, the undercut is completely housed in the volume 3 while the projection emerges at least partially from the free edge 6 and/or recess 27. De facto, as hereinbefore described, the projection 25 is distanced from and placed oppositely to the gripping edge 17 with respect to the removable portion 15: the projection 25 emerges oppositely to the gripping edge 17 with respect to the removable portion 15.

Further, the process can comprise to form, on the fourth and/or fifth sheets carrying the further portion 66, an additional portion 76 of sheet material foldable above the further portion 66 for defining the control portion 28. De facto, the additional portion 76 represents a prolongation of the portion 66 and which defines a substantially end portion of the portion 66. As it is visible for example in FIG. 36, the portion 66 is interposed between the additional portion 76 and the second portion 54 of the first sheet 51; the additional portion 76 is foldable above the portion 54 together with the portion 66: then, the additional portion 76 is again folded above the portion 66 so that the cavity 29 of the control portion 28, in the three-dimensional configuration of the container 1, can be located immediately behind the projection as for example illustrated in FIG. 40.

Advantageously, the sheets are obtained from a single flat sheet, particularly of paper material, which is die cut for defining the blank 50 comprising the above described sheets 51, 57, 60, 62 and 64. The die cutting step, besides defining the contour of the blank, is configured for packing the sheet for perimetrally delimiting the single sheets, for example by defining the end connection edges of the sheet and along which the folds should be executed in the following. Further, the die cutting step enables to notch the portions 52 and 54 for defining at least one of the following elements: the control opening 24, bulge 73, notch 74, groove 75, undercuts 70 and/or 71. During the die cutting step there is simultaneously the packing and/or notching of the fourth and/or fifth sheets for defining the weakening line 67 (or the plurality of weakening lines 67) for forming the further portion 66. Substantially, by a single die cutting step it is possible to define the flat blank 50 complete of all the above described sheets 51, 57, 60, 62, 64.

Figure 17:
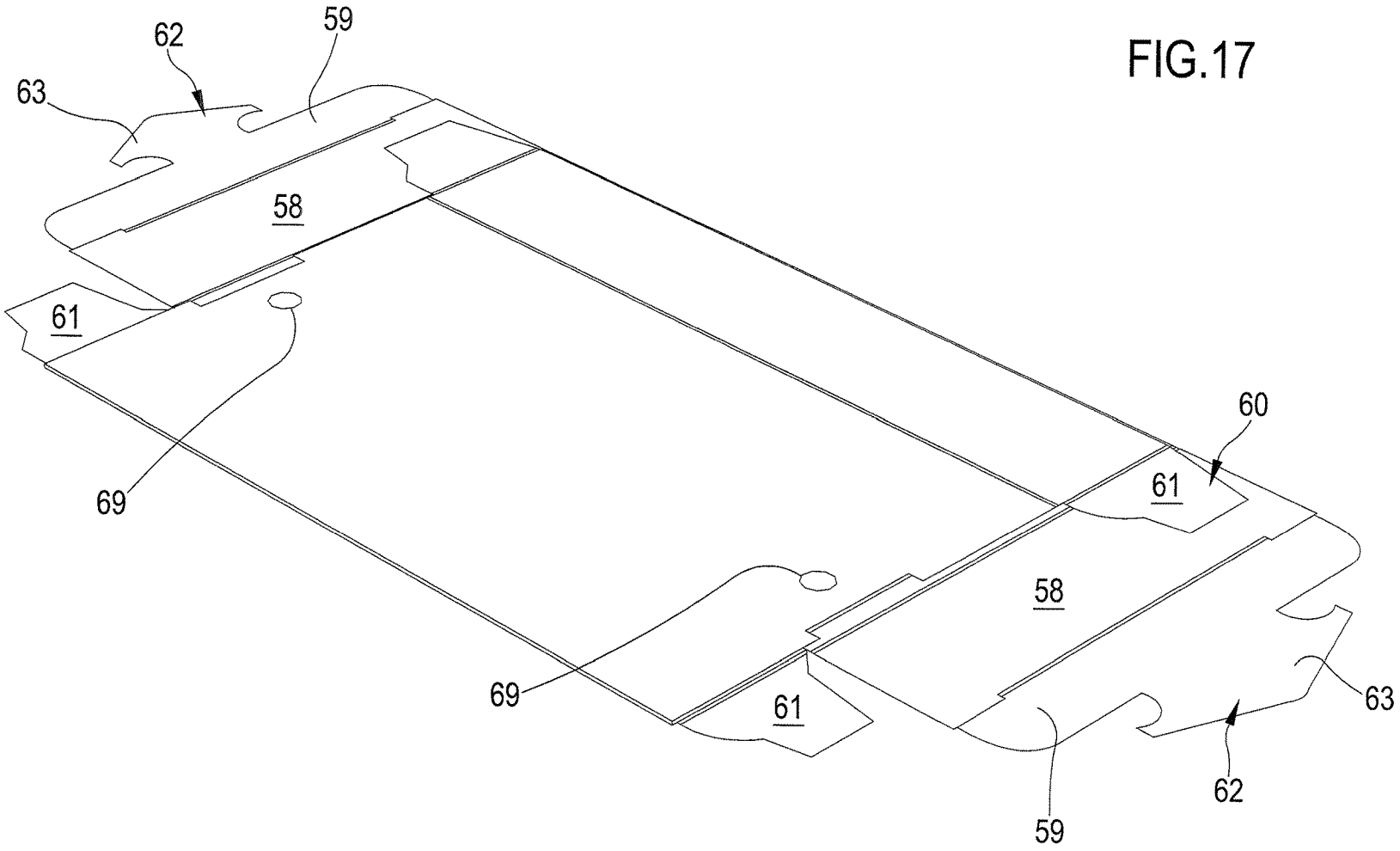
FIG. 17 is a perspective view of a container according to the present invention arranged in a compacted condition.
Figure 18:
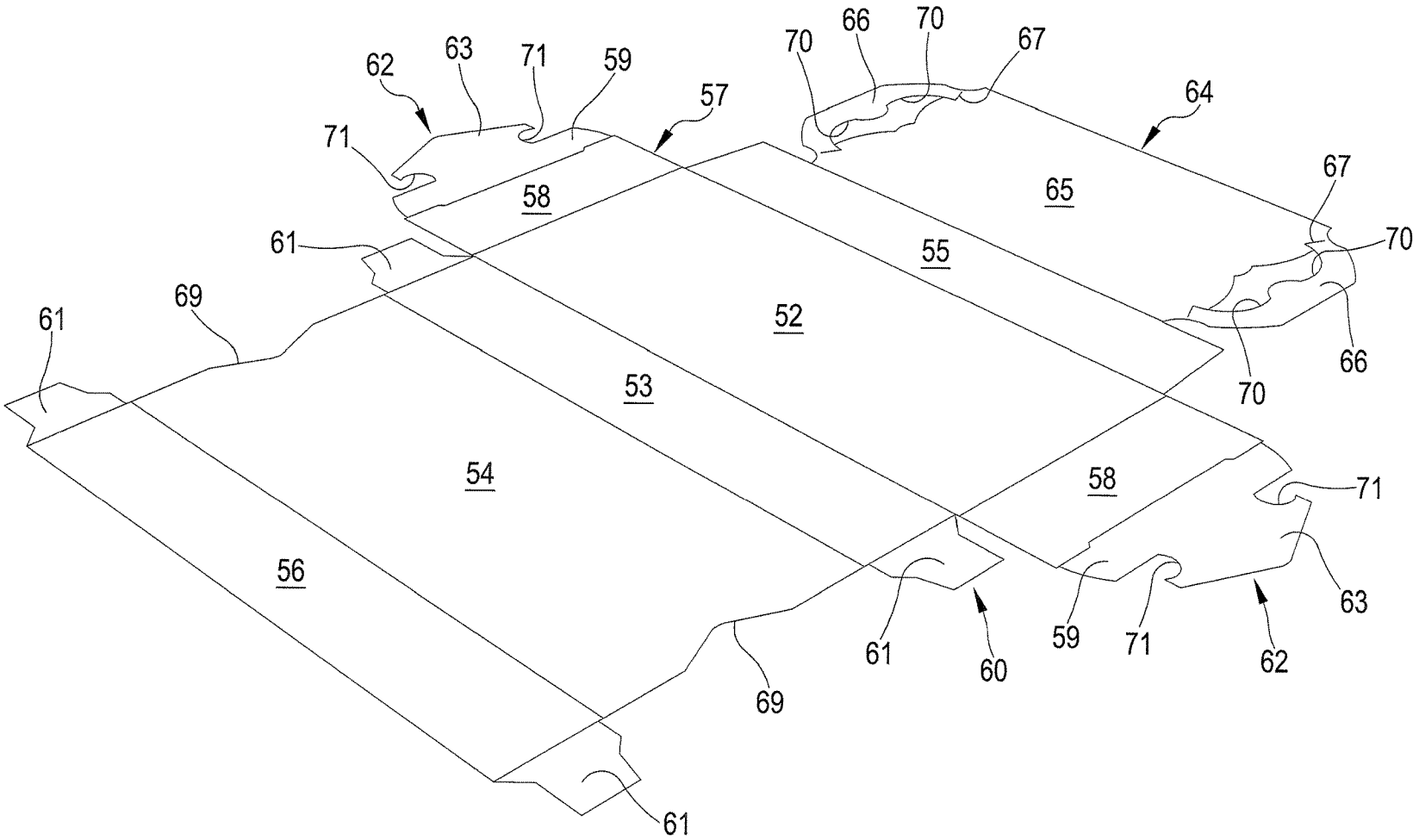
FIG. 18 is a top view of a third embodiment of a blank for making a container according to the present invention, FIGS. 19 and 20 schematically illustrate the steps of folding the blank in FIG. 18 for making a container according to the present invention.
Figure 19:
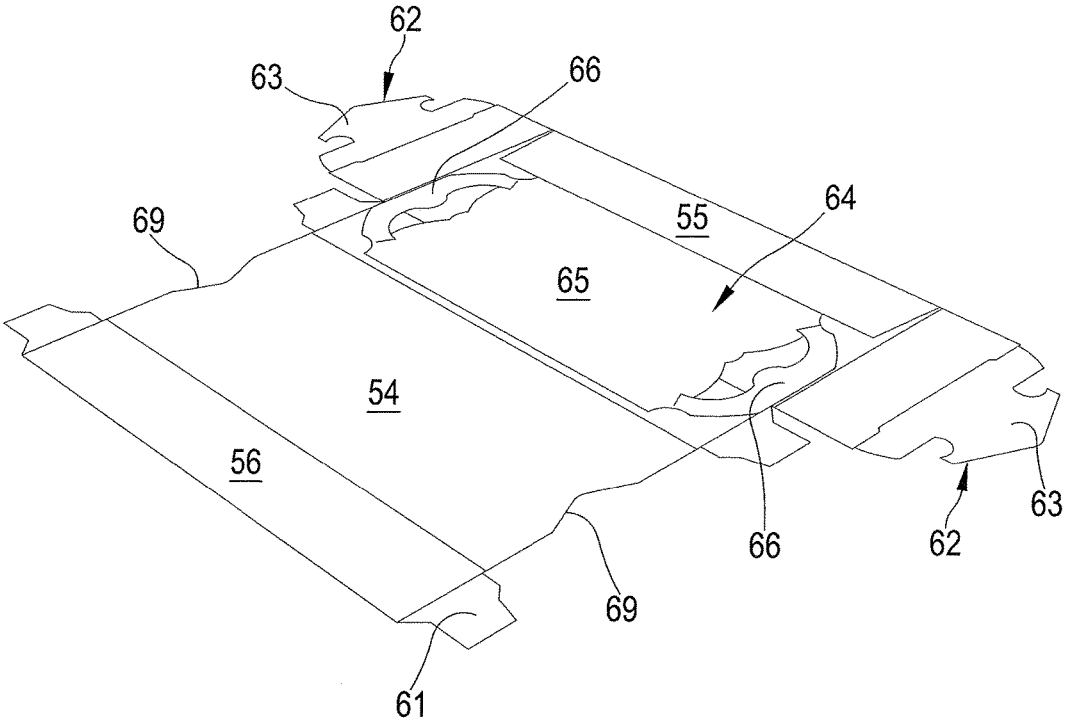
Figure 20:
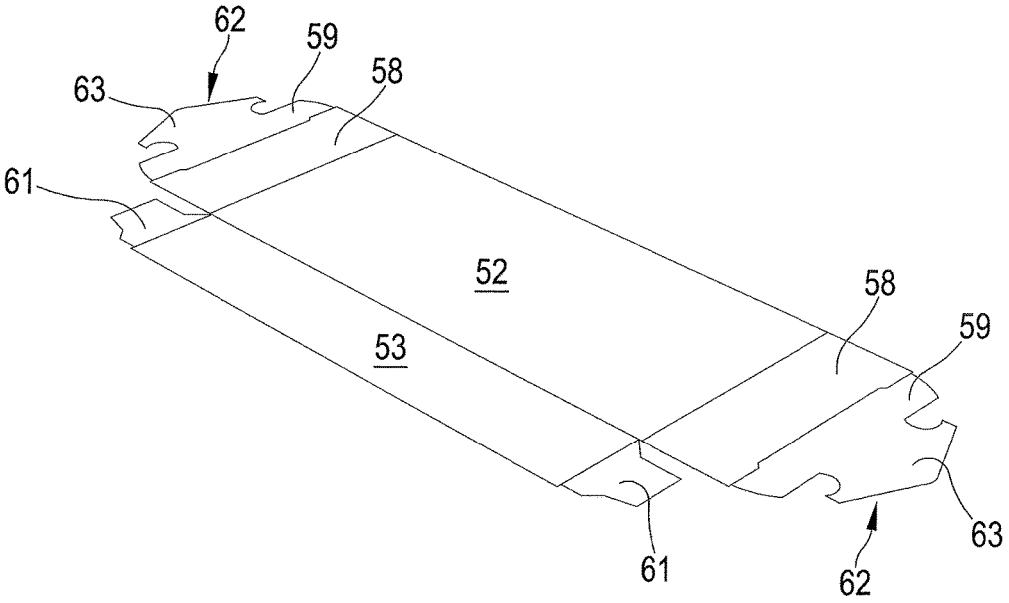

Further, the process can provide a step of predisposing a container 1 arranged in a compacted shape as illustrated in FIG. 17. Particularly, following the single blank 50 formation, the process provides the steps of folding the first sheet 51 in order to couple the portions 55 and 56. Then, the first and second portions 52, 54 are approached and located at least partially in contact with each other. From such condition, it will be sufficient to lift the portions 55 and 56, and also the central portion 53 for arranging the store 2 in the three-dimensional shape with the closure system 7 not already folded (this condition is illustrated in FIGS. 2 and 3). From such condition, the container 1 is ready for receiving the products and then for being closed for the first time: during the container 1 first closure, there is the coupling of the portions 13 and 14 and therefore the safety device 12 is "armed" or activated. In case there are two distinct through openings 5, the process can provide to close a system 7 (arming only one safety device 12), to insert the products in the store 2 and to completely close the container 1 by closing the second and last systems 7 (arming the second and last safety devices 12).

The invention claimed is:

1. A tamper-evident container, comprising:

a storage compartment made of a sheet material, defining an internal volume, and configured for housing products, the storage compartment comprising multiple lateral walls defining a passage opening delimited by a free edge, the passage opening configured to communicate the internal volume of the storage compartment with an external environment, a closure system made of a sheet material, engaged at the free edge of the storage compartment, and movable with respect to the storage compartment, the closure system configured to define at least one closed condition in which the closure system prevents communication between the internal volume of the storage compartment and the external environment, and the closure system configured to define an open condition in which the closure system enables communication between the internal volume of the storage compartment and the external environment, the closure system comprising:

a tab including a closing portion engaged with the free edge of the storage compartment and movable with respect to the free edge, and the tab including an inserting portion configured to insert within the internal volume of the storage compartment in the at least one closed condition of the closure system, and an abutting portion engaged with the free edge of the storage compartment adjacent to the tab, the abutting portion configured to be interposed between the internal volume of the storage compartment and the tab in the closed condition of the closure system, and a safety device made of a sheet material and comprising:

a first coupling portion carried by one or both of the tab and the abutting portion of the closure system, and a second coupling portion engaged with the storage compartment and configured to cooperate with the first coupling portion, wherein the first and the second coupling portions are configured to stably engage one another during a first closed condition of the closure system, wherein one or both of the first and second coupling portions include a removable portion configured to separate from the safety device following a first open condition of the closure system that follows the first closure condition of the closure system to provide an evidence of a tampering with the tamper-evident container, wherein the second coupling portion is arranged internal to the storage compartment and lies substantially parallel to one of the multiple lateral walls of the storage compartment, wherein the first coupling portion is configured to insert at least partially within the internal volume of the storage compartment to stably engage to the second coupling portion in the at least one closed condition of the closure system, wherein the removal portion has a first undercut portion and wherein the other of the first and second coupling portions is configured to engage the first undercut portion in the first closed condition of the closure system, wherein the first undercut portion of the removable portion is delimited by a gripping edge that is completely inside the storage compartment and spaced apart from the free edge of the storage compartment in the first closed condition of the closure system, and wherein the first undercut portion is delimited by a first gripping edge and wherein the other of the first and second coupling portions comprises a second undercut portion delimited by a second gripping edge, the second undercut portion being configured to engage the first undercut portion of the removable portion in the first closed condition of the closure system.

2. The tamper-evident container of claim 1, wherein the first undercut portion of the removable portion comprises a hook defining a seat having a concavity that faces towards at least one of the multiple lateral walls of the storage compartment in the first closed condition of the closure system.

3. The tamper-evident container of claim 1, wherein the first gripping edge of the removable portion is spaced apart from the free edge of the storage compartment in the first closed condition of the closure system, and wherein the first gripping edge of the removable portion is interposed between the free edge of the storage compartment and the second gripping edge of the other of the first and second coupling portions in the first closed condition of the closure system.

4. The tamper-evident container of claim 1, wherein the storage compartment defines a control opening through one of the multiple lateral walls that is parallel to the second coupling portion of the safety device, the control opening arranged at the removable portion of the safety device and at the inserting portion of the tab, wherein the control opening is configured to enable visualization of the removable portion before the first open condition of the closure system, and wherein the control opening is configured to enable visualization of the inserting portion of the tab following the first open condition of the closure system to provide the evidence of the tampering with the tamper-evident container.

5. The tamper-evident container of claim 4, wherein at least a part of the inserting portion of the tab that is visible from the control opening is distinguishable from at least a part of the removable portion that is visible from the control opening, and wherein a difference between visible parts of the inserting portion and the removable portion provide the evidence from outside of the tamper-evident container of the tampering with the tamper-evident container following the first open condition of the closure system.

6. The tamper-evident container of claim 5, wherein the first coupling portion is directly connected to the inserting portion and extends tangentially thereto, the inserting portion interposed between the first coupling portion and the closing portion of the tab, wherein the second coupling portion is directly connected to at least one of the multiple lateral walls of the storage compartment and is oriented parallel to the at least one lateral wall, and wherein the removable portion is provided by the second coupling portion.

7. The tamper-evident container of claim 1, wherein the removable portion comprises two first undercut portions that oppose each other with respect to the removable portion, and wherein the other of the first and second coupling portions comprises two second undercut portions that are configured to engage the two first undercut portions of the removable portion in the first closed condition of the closure system.

8. The tamper-evident container of claim 1, wherein the storage compartment defines a control opening through one of the multiple lateral walls that is parallel to the second coupling portion of the safety device, wherein the control opening is arranged at the removable portion of the safety device and at the inserting portion of the tab, wherein the control opening is configured to enable visualization of the removable portion before the first open condition of the closure system, wherein the control opening is configured to enable visualization of the inserting portion of the tab following the first open condition of the closure system to provide the evidence of the tampering with the tamper-evident container, wherein the safety device is stably engageable with the storage compartment and with the closure system following the first closed condition of the closure system, wherein the removable portion is configured to define, following the first closed condition of the closure device, a tactile projection emerging from one or both of the storage compartment and the closure system, wherein the removable portion, together with the tactile projection, is configured to separate from the safety device following the first open condition of the closure system that follows the first closed condition for providing the evidence of the tampering with the tamper-evident container, wherein the closure system defines a through opening at the free edge above the removable portion in the closed condition of the closure system, and wherein the through opening, following the first closed condition of the closure system and before the first open condition of the closure system, enables the tactile projection to pass through the through opening such that the tactile projection exits the storage compartment.

9. The tamper-evident container of claim 8, wherein the through opening is defined, without interruptions, at least partially on the closing portion and at least partially on the inserting portion of the tab.

10. A tamper-evident container, comprising:

a storage compartment made of a sheet material, defining an internal volume, and configured for housing products, the storage compartment having multiple side walls defining at least one passage opening delimited by a free edge, the passage opening configured to communicate the internal volume of the storage compartment with an external environment, a closure system made of a sheet material, engaged at the free edge of the storage compartment, and movable with respect to the storage compartment, the closure system configured to define at least one closed condition in which the closure system prevents communication between the internal volume of the storage compartment and the external environment, the closure system configured to define an open condition in which the closure system enables communication between the internal volume of the storage compartment and the external environment, the closure system comprising:

a tab including a closing portion engaged with the free edge of the storage compartment and movable with respect to the free edge, and the tab including an inserting portion configured to insert within the internal volume of the storage compartment in the at least one closed condition of the closure system, an abutting portion engaged with the free edge of the storage compartment adjacent to the tab, the abutting portion configured to be interposed between the internal volume of the storage compartment and the tab in the at least one closed condition of the closure system, and a safety device made of a sheet material, stably engageable with the storage compartment and with the closure system following a first closed condition of the closure system, wherein the safety device comprises a removable portion that defines a tactile projection that emerges from one or both of the storage compartment and the closure system following the first closed condition of the closure system, and wherein the removable portion, together with the tactile projection, is configured to be separated from the safety device following the first open condition of the closure system that follows the first closed condition of the closure system to provide an evidence of a tampering with the tamper-evident container.

11. The tamper-evident container of claim 10, wherein the safety device comprises:

a first coupling portion carried by one or both of the tab and the abutting portion of the closure system, a second coupling portion engaged with the storage compartment and configured to cooperate with the first coupling portion, wherein the first and second coupling portions are configured to stably engage each other during the first closed condition of the closure system, wherein one or both of the first and second coupling portions includes a removable portion configured to separate from the safety device following the first open condition of the closure system that follows the first closed condition of the closure system to provide the evidence of the tampering with the tamper-evident container, wherein the second coupling portion is arranged internal to the storage compartment and lies substantially parallel to one of the multiple side walls of the storage compartment, and wherein the first coupling portion is configured to insert at least partially within the internal volume of the storage compartment to stably engage the second coupling portion in the at least one closed condition of the closure system.

12. The tamper-evident container of claim 11, wherein the first and second coupling portions are configured to stably engage one another during the first closed condition of the closure system, and wherein one or both of the first and second coupling portions includes the removable portion that carries the tactile projection configured to separate from the safety device following the first open condition of the closure system that follows the first closed condition of the closure system to provide the evidence of the tampering with the tamper-evident container.

13. The tamper-evident container of claim 11, wherein one of the first and second coupling portions includes the removable portion, the removable portion comprising a first undercut portion, wherein the other of the first and second coupling portions is configured to engage the first undercut portion in the first closed condition of the closure system, the first undercut portion of the removable portion being delimited by a first gripping edge that is spaced apart from the free edge of the storage compartment in the first closed condition of the closure system, wherein the other of the first and second coupling portions comprises a second undercut portion delimited by a second gripping edge, the second undercut portion configured to engage the removable portion in the first closed condition of the closure system.

14. The tamper-evident container of claim 11, wherein one of the first and second coupling portions comprises the removable portion, wherein the removable portion comprises two first undercut portions opposing each other with respect to the removable portion, and wherein the other of the first and second coupling portions comprises two second undercut portions configured to engage the two first undercut portions of the removable portion in the first closed condition of the closure system.

15. The tamper-evident container of claim 10, wherein the tactile projection emerges from one or both of the free edge of the storage compartment and the closure system to extend outside of the internal volume of the storage compartment.

16. The tamper-evident container of claim 10, wherein the tactile projection of the removable portion lies parallel to the inserting portion and projects from the free edge of the storage compartment and transversally with respect to the closing portion in the first closed condition of the closure system, and wherein a tapered shape of the tactile projection that extends from the free edge of the storage compartment is visible from a front view that is normal to the tactile projection, the tapered shape of the projection configured for aiding a tactile perception of the tactile projection during the first closed condition of the closure system and before the first open condition of the closure system.

17. The tamper-evident container of claim 10, wherein the closure system comprises a through opening configured to be placed, in the at least one closed condition of the closure system, at the free edge above the removable portion, wherein the through opening, following the first closure of the closure system and before the first open condition of the closure system, enables the tactile projection to pass through the through opening and to exit the storage compartment.

18. The tamper-evident container of claim 17, wherein the through opening is defined, without interruptions, at least partially on the closing portion and at least partially on the inserting portion of the tab.

* * * * *